US010981390B2

(12) United States Patent
Suzuki et al.

(10) Patent No.: US 10,981,390 B2
(45) Date of Patent: Apr. 20, 2021

(54) LIQUID CONTAINER AND LIQUID INJECTION APPARATUS

(71) Applicant: SEIKO EPSON CORPORATION, Tokyo (JP)

(72) Inventors: Hidenao Suzuki, Matsumoto (JP); Naomi Kimura, Okaya (JP); Shoma Kudo, Shiojiri (JP); Takanori Matsuda, Shiojiri (JP); Koji Kawai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 229 days.

(21) Appl. No.: 16/312,112

(22) PCT Filed: Jun. 12, 2017

(86) PCT No.: PCT/JP2017/021647
§ 371 (c)(1),
(2) Date: Dec. 20, 2018

(87) PCT Pub. No.: WO2018/003473
PCT Pub. Date: Jan. 4, 2018

(65) Prior Publication Data

US 2019/0232668 A1 Aug. 1, 2019

(30) Foreign Application Priority Data

Jun. 28, 2016 (JP) ..... JP2016-127303
Jun. 30, 2016 (JP) ..... JP2016-129804
Jun. 30, 2016 (JP) ..... JP2016-129808

(51) Int. Cl.
*B41J 2/175* (2006.01)
*B41J 29/13* (2006.01)
*B41J 29/02* (2006.01)

(52) U.S. Cl.
CPC ..... *B41J 2/17523* (2013.01); *B41J 2/175* (2013.01); *B41J 2/1754* (2013.01);
(Continued)

(58) Field of Classification Search
CPC .... B41J 2/17523; B41J 29/13; B41J 2/17556; B41J 2/1754; B41J 2/17553; B41J 29/02;
(Continued)

(56) References Cited

U.S. PATENT DOCUMENTS 5,365,262 A 11/1994 Hattori et al.
7,658,480 B2 2/2010 Uehara et al.
(Continued)

FOREIGN PATENT DOCUMENTS

CN 1062693 A 7/1992
EP 2781358 A1 9/2014
(Continued)

OTHER PUBLICATIONS

International Search Report dated Aug. 8, 2017 in PCT/JP2017/021647 with English-language translation (4 pgs.).

*Primary Examiner* — Huan H Tran
(74) *Attorney, Agent, or Firm* — Oliff PLC

(57) ABSTRACT

The liquid container comprises: a first chamber that is surrounded by a plurality of walls and is configured to contain a liquid; a liquid inlet port for pouring the liquid into the first chamber; an air opening port that is opened to air; a liquid lead-out port that leads the liquid out of the first chamber; an air lead-in port that is formed in, out of the plurality of walls surrounding the first chamber, a first wall different from the wall constituting a top surface; and an air communication path that allows the air opening port and the air lead-in port to communicate with each other. The air lead-in port is separated from a corner portion where the first wall crosses with another wall.

19 Claims, 54 Drawing Sheets

(52) U.S. Cl.
CPC ..... *B41J 2/17506* (2013.01); *B41J 2/17509* (2013.01); *B41J 2/17513* (2013.01); *B41J 2/17553* (2013.01); *B41J 2/17556* (2013.01); *B41J 29/02* (2013.01); *B41J 29/13* (2013.01)

(58) Field of Classification Search
CPC .... B41J 2/175; B41J 2/17509; B41J 2/17506; B41J 2/17513; B41J 2002/17573; B41J 2/1752; B41J 2/1755; B41J 2/17566
See application file for complete search history.

(56) References Cited

U.S. PATENT DOCUMENTS

| | | | |
|---|---|---|---|
| 7,712,891 | B2 | 5/2010 | Ishida et al. |
| 7,784,893 | B2 | 8/2010 | Ishida et al. |
| 9,481,180 | B2 | 11/2016 | Kimura et al. |
| 9,487,012 | B2 | 11/2016 | Suzuki et al. |
| 9,493,010 | B2 | 11/2016 | Kudo et al. |
| 9,511,592 | B2 * | 12/2016 | Kobayashi ..... B41J 2/17509 |
| 9,511,952 | B1 | 12/2016 | Kobayashi et al. |
| 9,855,761 | B2 | 1/2018 | Suzuki et al. |
| 2005/0151782 | A1 | 7/2005 | Ishida et al. |
| 2006/0132555 | A1 | 6/2006 | Uehara et al. |
| 2008/0030530 | A1 | 2/2008 | Ishida et al. |
| 2010/0265303 | A1 | 10/2010 | Uehara et al. |
| 2012/0013687 | A1 | 1/2012 | Ishizawa et al. |
| 2016/0009096 | A1 | 1/2016 | Suzuki et al. |
| 2016/0009100 | A1 | 1/2016 | Kudo et al. |
| 2016/0016409 | A1 | 1/2016 | Kimura et al. |
| 2016/0052286 | A1 | 2/2016 | Kimura et al. |
| 2017/0008298 | A1 | 1/2017 | Suzuki et al. |
| 2017/0266968 | A1 | 9/2017 | Ishibe |

FOREIGN PATENT DOCUMENTS

| | | | |
|---|---|---|---|
| EP | 2 946 931 | A1 | 11/2015 |
| JP | 2006-035662 | A | 2/2006 |
| JP | 2006-175856 | A | 7/2006 |
| JP | 2008-012823 | A | 1/2008 |
| JP | 2012-020497 | A | 2/2012 |
| JP | 2014-058086 | A | 4/2014 |
| JP | 2014-180797 | A | 9/2014 |
| JP | 2015-131433 | A | 7/2015 |
| JP | 2015-131434 | A | 7/2015 |
| JP | 2015-139919 | A | 8/2015 |
| WO | WO-2014/132634 | A1 | 9/2014 |
| WO | WO-2016/093304 | A1 | 6/2016 |

* cited by examiner

LIQUID CONTAINER AND LIQUID INJECTION APPARATUS

CROSS-REFERENCE TO RELATED APPLICATIONS

This application is a national stage entry of International Appl. PCT/JP2017/021647, filed Jun. 12, 2017; which claims the benefit of foreign priority to Japanese Patent Applications No. JP2016-129808, filed Jun. 30, 2016, No. 2016-129804, filed Jun. 30, 2016, and No. JP 2016-127303, filed Jun. 28, 2016, all of which are incorporated by reference herein in their entirety.

FIELD

The present invention relates to a liquid container and a liquid injection apparatus.

BACKGROUND

There has been previously known an inkjet printer as an example of a liquid injection apparatus or a printer. An inkjet printer can perform printing on a print medium such as a print paper sheet by discharging an ink as an example of a liquid from a print head (also called liquid injection head) onto the print medium. It has been previously known that such an inkjet printer is configured to supply the ink from a tank or a tank unit to the print head (for example, refer to Patent Literature 1 and Patent Literature 2).

CITATION LIST

Patent Literature

[Patent Literature 1] JP-A-2015-131434
[Patent Literature 2] JP-A-2015-131433

SUMMARY

Technical Problem

The tank described in Patent Literature 1 is an example of a liquid container in which a case made of a synthetic resin and a flexible sheet member are bonded together. The case has an ink containing part capable of containing an ink and walls that partition an air communication path capable of introducing air into the ink containing part. The sheet member is bonded to the walls to block the ink containing part and the air communication path by the sheet member. That is, the ink containing part and the air communication path in the tank are partitioned by the walls provided in the case and the sheet member bonded to the case.

The sheet member can be regarded as one of the walls defining the ink containing part. In the foregoing tank, the connecting portion between the ink containing part and the air communication path overlaps the crossing portion (corner portion) of two of the walls defining the ink containing part. In this tank, the ink is likely to move and flow along the crossing portion of the two walls. Accordingly, the ink in the ink containing part is prone to enter the air communication path. If such an event occurs, the ink in the ink containing part may leak to the outside of the tank via the air communication path. That is, in the previous liquid container, it is difficult to reduce the possibility of leakage of the liquid.

In the liquid injection apparatus described in Patent Literature 2, the tank storing an ink has an ink containing part that stores the ink, an ink inlet part that pours the ink into the containment part, an introduction portion that introduces air into the ink containing part, an air introduction valve that is provided in the introduction portion, and others. The operator can refill the ink containing part with a new ink from the ink inlet part. The air introduction valve can prevent movement of air from the inside to the outside of the ink containing part. Accordingly, the air introduction value can also prevent movement of the liquid stored in the ink containing part from the inside to the outside of the ink containing part. This configuration makes it possible to prevent the leakage of the ink in the ink containing part from the introduction portion to the outside.

However, as for the liquid injection apparatus described in Patent Literature 2, there are demands for reducing the fear of the ink in the ink containing part leaking from the ink inlet part to the outside of the containment part when the operator might mistakenly bring down the tank while trying to refill the tank with a new ink or when the operator might carry the liquid injection apparatus with him/her.

In addition, there have been increasing needs for miniaturization of printers with a reduction in footprint, for example, in recent years. On the other hand, there have been increasing needs for increasing the capacity of ink containers to realize mass-produced prints at low costs with decrease in the frequency of refilling a refillable ink container with an ink or the frequency of replacing a replaceable ink container. However, making an ink container larger leads to an increase of the size of a tank unit in a printer. Accordingly, it is difficult to increase the capacity of the ink container while suppressing increase in the size of the printer, in particular, increase in the footprint of the printer.

Solution to Problem

The present invention is devised to solve at least part of the foregoing problem and can be implemented in the aspects below.

(1) According to a first aspect of the present invention, a liquid container is provided. The liquid container comprises: a first chamber that is surrounded by a plurality of walls and is configured to contain a liquid; a liquid inlet port for pouring the liquid into the first chamber; an air opening port that is opened to air; a liquid lead-out port that leads the liquid out of the first chamber; an air lead-in port that is formed in, out of the plurality of walls surrounding the first chamber, a first wall different from the wall constituting a top surface; and an air communication path that allows the air opening port and the air lead-in port to communicate with each other. The air lead-in port is separated from a corner portion where the first wall crosses with another wall.

According to the liquid container in this aspect, the air lead-in port is separated from the corner portion where the first wall crosses with the other wall. Therefore, the liquid moving along the corner portion where the first wall crosses with the other wall in the first chamber is unlikely to reach the air lead-in port. Accordingly, it is possible to reduce the possibility of the liquid in the first chamber leaking to the outside of the liquid container via the air communication path.

(2) In the liquid container according to the foregoing aspect, out of the plurality of walls, the wall opposed to the first wall may be formed from a film.

According to the liquid container in this aspect, the first wall is opposed to the wall formed from a film. Accordingly, the air lead-in port is separated from the film, which makes it possible to reduce the possibility of the liquid moving along the film and reaching the air lead-in port.

(3) In the liquid container according to the foregoing aspect, the air communication path may include a second chamber, and the second chamber may be positioned on an upstream side of the first chamber in a path of the air flowing from the air opening port through the air lead-in port into the first chamber.

According to the liquid container in this aspect, the second chamber is positioned on an upstream side of the first chamber, and thus the liquid flowing from the first chamber into the air communication path is likely to be retained in the second chamber. Accordingly, it is possible to further reduce the possibility of the liquid in the first chamber leaking to the outside of the liquid container via the air communication path.

(4) In the liquid container according to the foregoing aspect, in the first chamber, the first wall may have a convex portion protruding from the first wall toward the opposing side in the first chamber, at least at part of an outer periphery of the air lead-in port.

According to the liquid container in this aspect, the convex portion is formed around the air lead-in port, which makes the liquid in the first chamber unlikely to reach the air lead-in port. Accordingly, it is possible to further reduce the possibility of the liquid in the first chamber leaking to the outside of the liquid container via the air communication path.

(5) In the liquid container according to the foregoing aspect, the convex portion may be formed in a cylindrical shape to surround the entire periphery of the air lead-in port.

According to the liquid container in this aspect, the convex portion surrounds the entire periphery of the air lead-in port, which makes the liquid in the first chamber further unlikely to reach the air lead-in port.

(6) In the liquid container according to the foregoing aspect, the air communication path may include a communication flow path connecting to the air lead-in port, the air lead-in port may be circular in shape, and an inner diameter of the air lead-in port may be identical to a width of a cross section opening of the communication flow path.

According to the liquid container in this aspect, when the liquid in the first chamber enters from the air lead-in port into the communication flow path, the liquid is likely to return to the first chamber.

(7) In the liquid container according to the foregoing aspect, in the first chamber, the first wall may have a first inner surface and a second inner surface protruding more inward of the first chamber than the first inner surface, and the air lead-in port may be opened to the second inner surface.

According to the liquid container in this aspect, the air lead-in port is opened to the second inner surface protruding more inward of the first chamber than the first inner surface, which makes the liquid in the first chamber unlikely to reach the air lead-in port. Accordingly, it is possible to further reduce the possibility of the liquid in the first chamber leaking to the outside of the liquid container via the air communication path.

(8) In the liquid container according to the foregoing aspect, the liquid lead-out port may be formed on a side opposed to the first wall.

According to the liquid container in this aspect, the liquid in the first chamber flows toward the liquid lead-out port opposed to the air lead-in port, which makes it possible to reduce the possibility of the liquid leaking from the air opening port via the air lead-in port.

(9) The liquid container according to the foregoing aspect may further comprise a second convex portion that surrounds the air opening port.

According to the liquid container, the second convex portion surrounds the air opening port, and thus the liquid flowing out of the air opening port is likely to be blocked at the second convex portion.

(10) In the liquid container according to the foregoing aspect, the plurality of walls may include a visual-recognition wall through which a liquid level in the first chamber is visible. The visual-recognition wall may extend in a direction crossing a horizontal direction in a use posture of the liquid container. The visual-recognition wall may have an upper limit mark indicating an index for an upper limit of an amount of the liquid that can be poured into the first chamber. The air lead-in port may be positioned above the upper limit mark.

According to the liquid container in this aspect, the air lead-in port is positioned above the upper limit mark, and thus even when the liquid in the first chamber reaches the upper limit mark, the liquid in the first chamber is unlikely to reach the air lead-in port. Accordingly, it is possible to further reduce the possibility of the liquid in the first chamber leaking to the outside of the liquid container via the air communication path.

(11) In the liquid container according to the foregoing aspect, the plurality of walls may include a visual-recognition wall through which a liquid level in the first chamber is visible. The visual-recognition wall may extend in a direction crossing a horizontal direction in a use posture of the liquid container. The visual-recognition wall may have an upper limit mark indicating an index for an upper limit of an amount of the liquid that can be poured into the first chamber. When a liquid level in the first chamber reaches the upper limit mark, a volume of the second chamber may be equal to or larger than a volume of the liquid.

According to the liquid container in this aspect, even when the liquid in the first chamber flows out to the air communication path, the liquid in the first chamber can be received in the second chamber. Accordingly, the liquid flowing from the first chamber to the air communication path is likely to be retained in the second chamber. This makes it possible to further reduce the possibility of the liquid in the first chamber leaking to the outside of the liquid container via the air communication path.

(12) In the liquid container according to the foregoing aspect, in a state in which the liquid in the first chamber has reached the upper limit mark in the use posture, when the liquid container is changed to a posture in which the visual-recognition wall is oriented downward, the air lead-in port may be positioned above a level of the liquid in the first chamber.

According to the liquid container in this aspect, in the state in which the liquid in the first chamber has reached the upper limit mark in the use posture, even when the liquid container is changed to a posture in which the visual-recognition wall is oriented downward, the liquid in the first chamber is unlikely to reach the air lead-in port. Accordingly, even when the liquid container is changed to a posture in which the visual-recognition wall is oriented downward, it is possible to reduce the possibility of the liquid in the first chamber leaking to the outside of the liquid container via the air communication path.

(13) In the liquid container according to the foregoing aspect, the liquid inlet port may be provided in, out of the plurality of walls, a second wall that extends in a direction crossing the first wall, and a plate wall protruding from the second wall inward of the first chamber may be provided between the liquid inlet port and the air lead-in port.

According to the liquid container in this aspect, the plate wall is provided between the liquid inlet port and the air lead-in port, and thus when the liquid is poured from the liquid inlet port into the first chamber, it is possible to reduce the possibility of the dispersed liquid attaching to the air lead-in port.

According to another aspect of the present invention, a liquid injection apparatus is provided. The liquid injection apparatus includes: a liquid injection head that is configured to inject a liquid; and a liquid container that is configured to supply the liquid to the liquid injection head. The liquid container includes: a first chamber that is surrounded by a plurality of walls and is configured to contain a liquid; a liquid inlet port for pouring the liquid into the first chamber; an air opening port that is opened to the air; a liquid lead-out port that leads the liquid out of the first chamber; an air lead-in port that is formed in, out of the plurality of walls surrounding the first chamber, a first wall different from the wall constituting a top surface; and an air communication path that allows the air opening port and the air lead-in port to communicate with each other. The air lead-in port is separated from a corner portion where the first wall crosses with the other wall.

According to the liquid injection apparatus in this aspect, in the liquid container that is capable of supplying the liquid to the liquid injection head, the air lead-in port is separated from the corner portion where the first wall crosses with the other wall. Therefore, the liquid moving along the corner portion where the first wall crosses with the other wall in the first chamber is unlikely to reach the air lead-in port. Accordingly, it is possible to reduce the possibility of the liquid in the first chamber leaking to the outside of the liquid container via the air communication path.

(14) According to a second aspect of the present invention, there is provided a liquid container that is configured to contain a liquid to be supplied to a liquid injection head. The liquid container comprises: one liquid containing chamber that is configured to contain the liquid; and one liquid inlet portion that is configured to pour the liquid into the liquid containing chamber. The liquid inlet portion is formed in a first wall defining the liquid containing chamber and has an outer end opened to the outside and an inner end opened in the liquid containing chamber. When the first wall in a use posture is projected onto a horizontal plane, the first wall has a shape of a quadrilateral with a first side and a second side crossing the first side, the quadrilateral is divided into four regions by a first center line passing through a center of the first side and a second center line passing through a center of the second side, and the liquid inlet portion is provided such that the inner end is arranged in any of the four regions.

According to the liquid container in this aspect, the liquid inlet portion is arranged in any of the four regions divided by the first center line passing through the center of the first side and the second center line passing through the center of the second side, which allows the liquid inlet portion to be formed closer to one of the first side and the second side and distant from the other side.

Accordingly, even if the liquid container falls over and the liquid containing chamber is changed in posture such that its surface including a side distant from the region with the liquid inlet portion is positioned at the bottom, the distance between the liquid inlet portion and the bottom surface is longer and thus the liquid is unlikely to leak from the liquid inlet portion to the outside (hereinafter, the lowest surface of the liquid containing chamber will be called bottom surface). That is, even if the liquid container falls over, the liquid inlet portion is positioned higher than the bottom surface, which makes the liquid in the liquid containing chamber unlikely to leak to the outside of the liquid containing chamber.

Further, the one liquid inlet portion and the one liquid containing chamber are provided, and thus only one kind of liquid is to be contained in the liquid container, which keeps the liquid from being mixed with other kinds of color liquids.

(15) In the liquid container according to the foregoing aspect, the liquid containing chamber may have a second wall extending in a direction crossing the first wall, and the first wall may have an inclination portion that is inclined such that the second wall side is lower, and the liquid inlet portion may be provided on the second wall side of the first wall.

According to the liquid container in this aspect, the first wall defines the liquid containing chamber and constitutes a top surface of the liquid containing chamber in the use posture. The second wall crossing the first wall constitutes a side surface of the liquid containing chamber in the use posture.

Even if the liquid container falls down and the liquid containing chamber is changed in posture such that the second wall constitutes the top surface of the liquid containing chamber and the first wall constitutes the side surface of the liquid containing chamber, the liquid inlet portion is positioned on the top surface (the second wall) side and the distance between the liquid inlet portion and the bottom surface is longer, which makes the liquid unlikely to leak from the liquid inlet portion to the outside.

Further, even if the liquid containing chamber is changed in posture such that the second wall constitutes the top surface and the first wall constitutes the side surface of the liquid containing chamber, the first wall constituting the side surface is inclined such that the liquid containing chamber becomes wider from the top surface (the second wall) toward the bottom surface. Accordingly, it is possible to keep low the position of the liquid level as seen from the bottom surface and make the liquid further unlikely to leak from the liquid inlet portion to the outside, as compared to the case in which the first wall constituting the side surface does not incline.

(16) In the liquid container according to the foregoing aspect, the liquid containing chamber may have a second wall that extends in a direction crossing the first wall, and a bottom wall that extends in a direction crossing the second wall and is opposed to the first wall. The bottom wall may have an inclination portion that is inclined such that the second wall side is higher.

According to the liquid container in this aspect, even if the liquid container falls down and the liquid containing chamber is changed in posture such that the second wall constitutes the top surface of the liquid containing chamber, the first wall constitutes one side surface of the liquid containing chamber and the bottom wall constitutes the opposed other side surface, the bottom wall constituting the other side surface is inclined, as with the first wall constituting the one side surface, such that the liquid containing chamber becomes wider from the top surface (the second wall) toward the bottom surface. Therefore, it is possible to keep low the position of the liquid level as seen from the bottom surface and make the liquid unlikely to leak from the liquid inlet portion to the outside, as compared to the case in which the bottom wall constituting the other side surface does not incline.

(17) In the liquid container according to the foregoing aspect, the liquid containing chamber may further have a third wall that extends in a direction crossing the first wall, the second wall, and the bottom wall and a fourth wall that is opposed to the third wall. The liquid inlet portion may be provided on the first wall on a side closer to the third wall than the fourth wall. The bottom wall may have an inclination portion that is inclined from the third wall toward the fourth wall such that the fourth wall side is lower.

According to the liquid container in this aspect, even if the liquid container falls down and the liquid containing chamber is changed in posture such that the third wall constitutes the top surface of the liquid containing chamber, the first wall constitutes one side surface of the liquid containing chamber, the second wall and the bottom wall constitute the opposed other side surface and the fourth wall constitutes the bottom surface, the bottom wall constituting the other side surface is inclined such that the liquid containing chamber becomes wider from the top surface (the third wall) toward the bottom surface (the fourth wall). Therefore, it is possible to keep low the position of the liquid level as seen from the bottom surface and make the liquid unlikely to leak from the liquid inlet portion to the outside, as compared to the case in which the bottom wall constituting the other side surface does not incline.

(18) In the liquid container according to the foregoing aspect, the second wall may have an upper limit line that indicates an index for an upper limit of an amount of the liquid that can be poured into the liquid containing chamber and constitute a visual-recognition wall through which a liquid level in the liquid containing chamber is visible from the outside. When the visual-recognition wall in the use posture is seen from a direction orthogonal to the visual-recognition wall, a center line passing through the center of the liquid inlet portion may be arranged at a position different from a center line passing through a center of the upper limit line.

According to the liquid container in this aspect, when the center line of the upper limit line is arranged at the position different from the center line of the liquid inlet portion, the upper limit line is separated from the liquid inlet portion and is easy to view at the time of infusion of the liquid from the liquid inlet portion. This prevents the liquid from being poured beyond the upper limit line and leaking out of the liquid inlet portion to the outside.

(19) In the liquid container according to the foregoing aspect, the first wall may include a liquid leakage prevention wall that protrudes in such a manner as to separate from the liquid inlet portion and surrounds the liquid inlet portion.

According to the liquid container in this aspect, while the liquid is being poured into the liquid containing chamber in the use posture of the liquid container, even if the liquid leaks out of the liquid inlet portion, the leaking liquid is held by the liquid leakage prevention wall. This makes it possible to prevent the outflow of the liquid to the outside of the liquid leakage prevention wall.

In the liquid container according to the foregoing aspect, the liquid inlet portion may include a cylindrical portion with a through hole communicating with an opening of the outer end and an opening of the inner end.

According to the liquid container in this aspect, the opening of the outer end of the liquid inlet portion is separated (protruded) from the first wall by the cylindrical portion and is arranged to be higher than the first wall. This makes the liquid unlikely to leak from the opening of the outer end of the liquid inlet portion as compared to the case in which the opening of the outer end of the liquid inlet portion is provided to be lower than the first wall, for example.

The liquid container according to the foregoing aspect may further include an air chamber above the liquid containing chamber. The air chamber may have a wall positioned above the liquid inlet portion. The wall may have a concave portion configured to, when the liquid is poured into the liquid inlet portion from a liquid pouring container for pouring the liquid into the liquid containing chamber, separate from a side wall of the liquid pouring container.

According to the liquid container in this aspect, when the liquid is poured from the liquid pouring container into the liquid inlet portion, the liquid pouring container is not in contact with the wall of the air chamber. This allows the liquid pouring container to be stabled in posture and pour the liquid into the liquid containing chamber in a stable manner. Accordingly, for example, it is possible to prevent a failure of leakage of the liquid from the liquid inlet portion because of the difficulty of pouring the liquid into the liquid containing chamber in a stable manner.

In the liquid container according to the foregoing aspect, the liquid containing chamber may further include: a fifth wall opposed to the second wall; a sixth wall that connects the second wall and the fifth wall at a position between the first wall and the bottom wall; and an opening that is provided on the sixth wall to bring an internal space closer to the first wall than the sixth wall of the liquid containing chamber and an internal space closer to the bottom wall than the sixth wall to communicate with each other. When the sixth wall in the use posture is projected onto a horizontal plane, the opening may be provided in a second region diagonal to a first region where the inner end of the liquid inlet portion is formed.

According to the liquid container in this aspect, the sixth wall forms the internal space on the first wall side and the internal space on the side opposite to the first wall. When the liquid poured from the liquid inlet portion is stored in the internal space on the side opposite to the first wall, even if the liquid container falls down and the liquid inlet portion is placed at a low position (closer to the bottom surface), the opening diagonal to the liquid inlet portion is placed at a high position (distant from the bottom surface). Accordingly, the liquid stored in the internal space on the side opposite to the first wall is unlikely to move into the internal space on the first wall side through the opening. Therefore, it is possible to prevent the liquid from moving into the internal space on the first wall side and leaking from the liquid inlet portion to the outside. That is, even if the liquid container falls down and the liquid inlet portion is placed at a low position, the liquid is unlikely to leak form the liquid inlet portion to the outside.

According to another aspect of the present invention, a liquid injection apparatus is provided. The liquid injection apparatus includes: a liquid injection head; and a liquid container that is capable of containing a liquid to be supplied to the liquid injection head. The liquid container includes a liquid containing chamber that is capable of containing the liquid and a liquid inlet portion that is capable of pouring the liquid into the liquid containing chamber. The liquid inlet portion is formed in a first wall defining the liquid containing chamber and has an outer end opened to the outside and an inner end opened in the liquid containing chamber. When the first wall in a use posture is projected onto a horizontal plane, the first wall has a shape of a quadrilateral with a first side and a second side crossing the first side. The quadrilateral is divided into four regions by a first center line passing through the center of the first side and a second center line passing through the center of the second side. The liquid inlet portion is provided such that the inner end is arranged in any of the four regions. The first wall includes a liquid leakage prevention wall that protrudes in such a manner as to separate from the liquid inlet portion and surrounds the liquid inlet portion.

According to the liquid injection apparatus in this aspect, even if the liquid container falls down by mistake during infusion of the liquid into the liquid container or by mistake during movement of the liquid injection apparatus, the liquid inlet portion is placed at a higher position than the bottom surface, which makes the liquid unlikely to leak from the liquid inlet portion to the outside. Even if the liquid leaks to the outside of the liquid container, the leaking liquid is held by the liquid leakage prevention wall. This makes the liquid unlikely to flow to the outside of the liquid leakage prevention wall.

Therefore, it is possible to suppress loss of the liquid leaking from the liquid inlet portion to the outside and harmful effects of the liquid leaking to the outside (for example, a malfunction resulting from liquid stains). This achieves the liquid injection apparatus that operates in a stable manner while suppressing waste of the liquid.

(20) According to a third aspect of the present invention, a liquid injection apparatus is provided. The liquid injection apparatus comprises: a liquid container that is configured to contain a liquid; and a liquid injection mechanism part that includes a liquid injection head configured to inject the liquid supplied from the liquid container toward a target medium and that is configured to change a relative position of the medium to the liquid injection head. In a use posture in which the liquid injection mechanism part is used, an upper end of the liquid container is positioned above an upper end of the liquid injection mechanism part.

In the liquid injection apparatus in this aspect, when the liquid injection apparatus is arranged on a horizontal plane, the liquid injection apparatus is in a use state in which the liquid injection mechanism part is used. The use posture refers to the posture of the liquid injection apparatus and the liquid injection mechanism part when the liquid injection apparatus is arranged on an XY plane aligned with the horizontal plane.

The "upper ends" of the liquid container and the liquid injection mechanism part refer to the uppermost portions of the liquid container and the liquid injection mechanism part in the foregoing "use state". For example, when the liquid container or the liquid injection mechanism part has an upward protrusion portion, the protruding end of the protrusion portion is called "upper end".

According to the liquid injection apparatus in this aspect, the upper end of the liquid container is positioned above the upper end of the liquid injection mechanism in the use posture in which the liquid injection mechanism part is used, which makes it possible to increase the volume of the liquid container for the liquid to achieve larger capacity by using efficiently the upper space of the liquid container in the liquid injection apparatus.

Therefore, it is possible to provide the liquid injection apparatus that has the large capacity of the liquid container while suppressing increase in the footprint of the liquid injection apparatus.

The liquid injection apparatus in the foregoing aspect may include an image reading mechanism part that reads an image on a paper sheet and outputs image data of the image. The upper end of the liquid container may be positioned above a lower end of the image reading mechanism part.

According to the liquid injection apparatus in this aspect, the upper end of the liquid container is positioned above the lower end of the image reading mechanism part, which makes it possible to further increase the capacity of the liquid container while suppressing increase in the footprint of the liquid injection apparatus.

The liquid injection apparatus in the foregoing aspect includes an operation panel with an operation portion for operating the liquid injection apparatus. In the use posture, the upper end of the liquid container may be at a position equal to an upper end of the operation panel or may be positioned above the upper end of the operation panel.

According to the liquid injection apparatus in this aspect, the upper end of the liquid container is positioned above the upper end of the operation panel that is arranged to overlap at least partially the liquid injection mechanism part on the surface along the vertical direction of the liquid injection apparatus, which makes it possible to further increase the capacity of the liquid container while suppressing increase in the footprint of the liquid injection apparatus.

In the liquid injection apparatus in the foregoing aspect, the liquid container may have an air containment part in which air is stored above a liquid level of the stored liquid. In the use posture, at least part of the air containment part may be positioned above the upper end of the liquid injection mechanism part.

According to the liquid injection apparatus in this aspect, it is possible to increase the liquid containing capacity of the liquid container including the air containment part while suppressing increase in the footprint of the liquid injection apparatus, by using efficiently the upper space of the liquid container.

In the liquid injection apparatus in the foregoing aspect, the inside of the liquid container may be divided into a liquid containing chamber for storing the liquid and an air containment chamber as the air containment part.

According to the liquid injection apparatus in this aspect, it is possible to increase the capacity of the liquid container while suppressing increase in the footprint of the liquid injection apparatus. In addition, the inside of the liquid container is divided into the liquid containing chamber that stores the liquid and the air containment chamber as the air containment part, which produces the advantageous effect of suppressing the leakage of the liquid from an air opening port in the air containment part or the like due to a change in the internal pressure of the liquid container.

DESCRIPTION OF EMBODIMENTS

Figure 1:
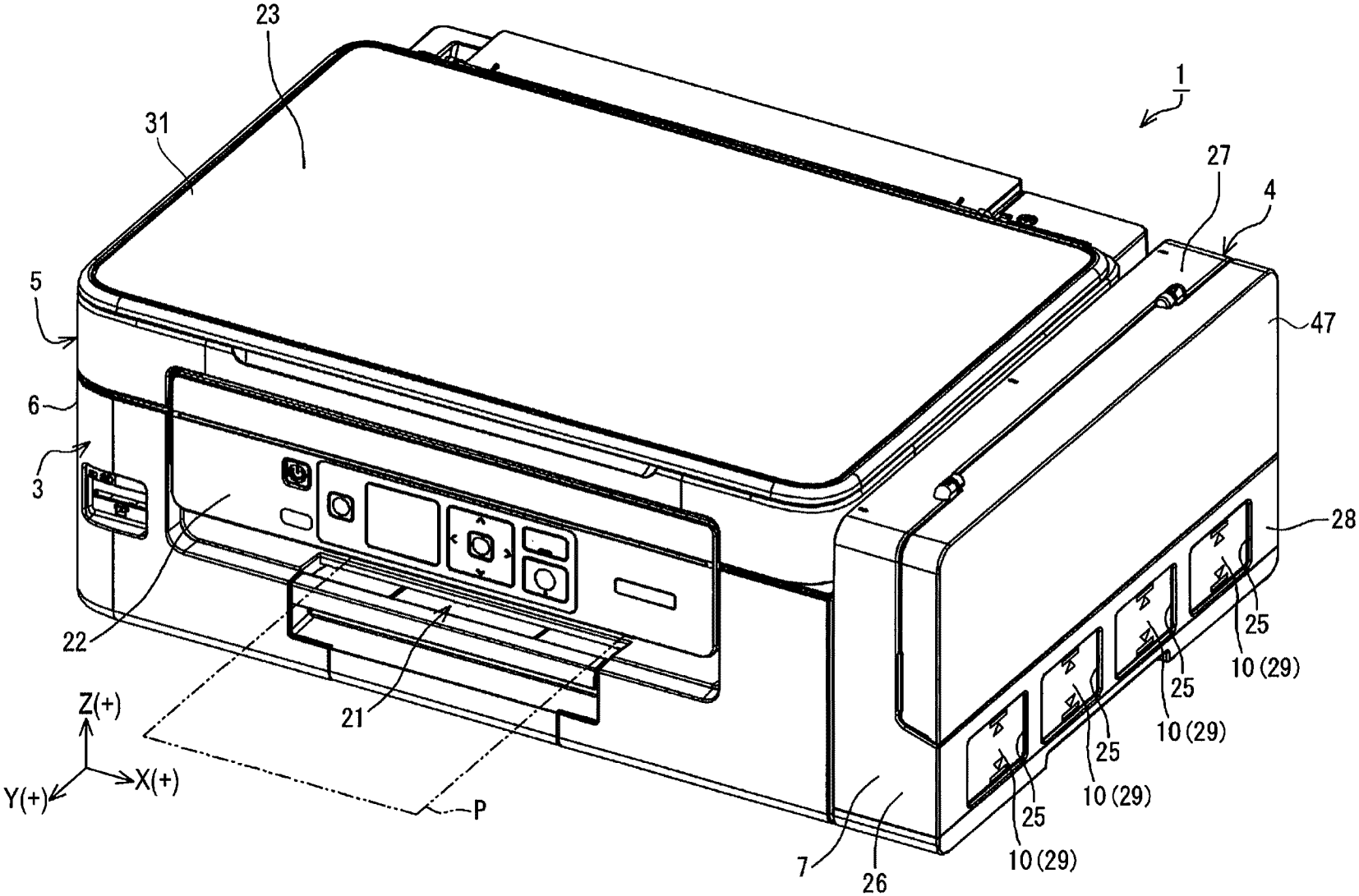
FIG. 1 is a perspective view of a main configuration of a printer according to a first embodiment.

Embodiments will be described with reference to the drawings. In the drawings, components and members may be different in reduced scales so that the components can be illustrated in recognizable sizes.

A. First Embodiment

A printer 1 as a liquid injection apparatus in a first embodiment has: a print unit 3 as a main component of the liquid injection apparatus, a tank unit 4 provided on a side portion of the print unit 3, and a scanner unit 5 as illustrated in FIG. 1. The print unit 3 has a housing 6. The housing 6 constitutes the outer case of the print unit 3. The housing 6 stores a mechanism unit of the print unit 3 (described later). The mechanism unit is also called liquid injection mechanism part. The tank unit 4 has a housing 7 and a plurality of (two or more) tanks 10. The plurality of tanks 10 are stored in the housing 7. Accordingly, the plurality of tanks 10 are provided together with the print unit 3. In the present embodiment, four tanks 10 are provided. The housing 6, the housing 7, and the scanner unit 5 constitute the outer case of the printer 1. The printer 1 may be configured without the scanner unit 5. The printer 1 may produce a print on a print medium P such as a paper sheet for printing by an ink as an example of a liquid. The print medium P is an example of a medium on which a print is produced (printing target). The tanks 10 are an example of a liquid container.

FIG. 1 indicates X, Y, and Z axes as coordinate axes orthogonal to one another. The subsequent drawings also indicate the X, Y, and Z axes as necessary. In this case, the X, Y, and Z axes in the drawings correspond to the X, Y, and Z axes in FIG. 1. FIG. 1 illustrates the printer 1 placed on an XY plane determined by the X axis and the Y axis. In the present embodiment, the state of the printer 1 placed on the XY plane aligned with a horizontal plane is the use state of the printer 1. The posture of the printer 1 placed on the XY plane aligned with the horizontal plane will be called the use posture of the printer 1.

The printer 1 is used in the state in which the print unit 3 and the scanner unit 5 are arranged in sequence in a Z (+) direction on the XY plane aligned with the horizontal plane. This state (illustrated in FIG. 1) is the use posture of the printer 1. That is, the posture of the printer 1 with the XY plane aligned with the horizontal plane is the use posture of the printer 1 with a thickness direction (Z direction) in parallel to a gravity direction. The postures of components and units in the use posture of the printer 1 are the use postures of the components and units.

The "use posture" in the present application means the posture of the tanks 10 in the use posture of the printer 1 (the use posture of the tanks 10). Further, the XY plane is an example of "horizontal plane", and the X direction is an example of a "direction orthogonal to a visual-recognition wall in the use posture".

Hereinafter, the X axis, the Y axis, and the Z axis included in the drawings and descriptions of the components and units of the printer 1 mean the X axis, the Y axis, and the Z axis with the components and units incorporated (installed) in the printer 1. In addition, the postures of the components and units in the use posture of the printer 1 will be called the use postures of the components and units. Hereinafter, the printer 1 and its components, units, and others, will be described on the assumption that they are in the respective use postures unless otherwise specified.

The Z axis is an axis orthogonal to the XY plane. In the use state of the printer 1, the Z-axis direction is a vertically upward direction. In the use state of the printer 1, a −Z-axis direction is a vertically downward direction in FIG. 1. In each of the X, Y, and Z axes, the direction of the arrow indicates a + (positive) direction, and the direction opposite to the arrow indicates a − (negative) direction. The four tanks 10 described above are aligned along the Y axis. Accordingly, the Y-axis direction can also be defined as direction in which the four tanks 10 are aligned.

The print unit 3 has a paper ejection portion 21. In the print unit 3, the paper ejection portion 21 ejects the print medium P. The surface of the print unit 3 with the paper ejection portion 21 is a front surface 22. The front surface 22 of the print unit 3 and the front surface 22 of the scanner unit 5 are positioned on the same plane. That is, the front surface 22 of the printer 1 contains the front surface 22 of the print unit 3 and the front surface 22 of the scanner unit 5.

In the printer 1, the vertically upward surface of the scanner unit 5 is a top surface 23. The tank unit 4 is provided at, out of side portions crossing the front surface 22 and the top surface 23, a side portion facing in the X-axis direction. An open/close cover 47 is attached to the side portion of the tank unit 4 oriented in an X (+) direction. The housing 7 has windows 25. The windows 25 are provided on a side surface 28 of the housing 7 crossing a front surface 26 and a top surface 27. The front surface 26 of the tank unit 4 is oriented in the same direction as the front surface 22 of the printer 1 (the Y-axis direction in the present embodiment). The front surface 26 of the tank unit 4 is positioned in the same plane as the front surface 22 of the printer 1. That is, the front surface 26 of the tank unit 4 is positioned in the same plane as the front surface 22 of the print unit 3. Accordingly, it is possible to reduce asperities on the outer appearance of the printer 1 between the print unit 3 and the tank unit 4. This makes the printer 1 unlikely to hit against the surroundings during transportation.

In the tank unit 4, the windows 25 have light permeability. The four tanks 10 are provided to overlap the windows 25. Each of the tanks 10 has an ink containing part 29 as a liquid containing chamber. In each of the tanks 10, an ink is contained in the ink containing part 29. Each of the windows 25 is provided to overlap the ink containing part 29 of the tank 10. Accordingly, the operator using the printer 1 can see the ink containing parts 29 of the four tanks 10 through the windows 25 from the outside of the housing 7. In the present embodiment, the windows 25 are provided as openings in the housing 7. The operator can see the four tanks 10 through the windows 25 as openings. The windows 25 are not limited to openings but may be formed from light-permeable members, for example.

In the present embodiment, the walls of the ink containing parts 29 facing the windows 25 of the tanks 10 are at least partially light-permeable. The inks in the ink containing parts 29 can be seen through the light-permeable portions of the ink containing parts 29. Therefore, the operator can see the four tanks 10 through the windows 25 to check the amounts of the inks in the ink containing parts 29 of the tanks 10. That is, at least portions of the tanks 10 facing the windows 25 can be used as visual-recognition parts through which the amounts of inks can be seen. Accordingly, the operator can see the visual-recognition parts of the four tanks 10 through the windows 25 from the outside of the housing 7. All the walls of the ink containing parts 29 may be light-permeable. In addition, all the parts of the tanks 10 facing the windows 25 can be used as visual-recognition parts through which the amounts of inks can be seen.

Figure 2:
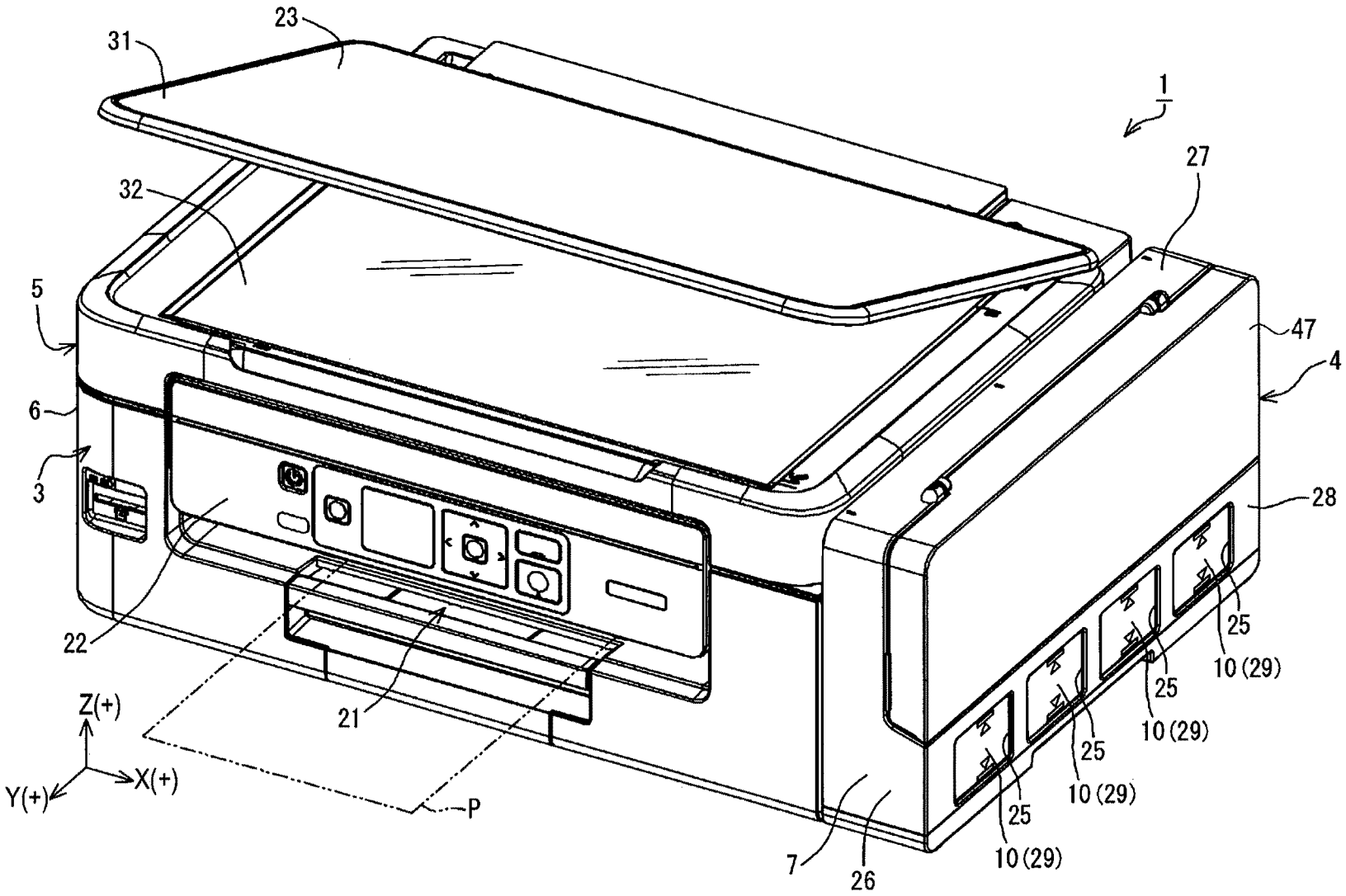
FIG. 2 is a perspective view of the main configuration of the printer according to the first embodiment.

In the printer 1, the print unit 3 and the scanner unit 5 overlap together (in the Z-axis direction). In the state of using the print unit 3, the scanner unit 5 is positioned in the vertically upward direction of the print unit 3. The scanner unit 5 is a flat bed type, and has a document cover 31 that rotates in a manner capable of opening and closing and a document placement plane 32 that is exposed with the document cover 31 opened, as illustrated in FIG. 2. FIG. 2 illustrates the document cover 31 in the opened state. The scanner unit 5 has an imaging element such as an image sensor (not illustrated). The scanner unit 5 can read an image on a document such as a paper sheet placed on the document placement plane 32 as image data via the imaging element, and output the read image data. Accordingly, the scanner unit 5 acts as an image reading device (image reading mechanism part).

Figure 3:
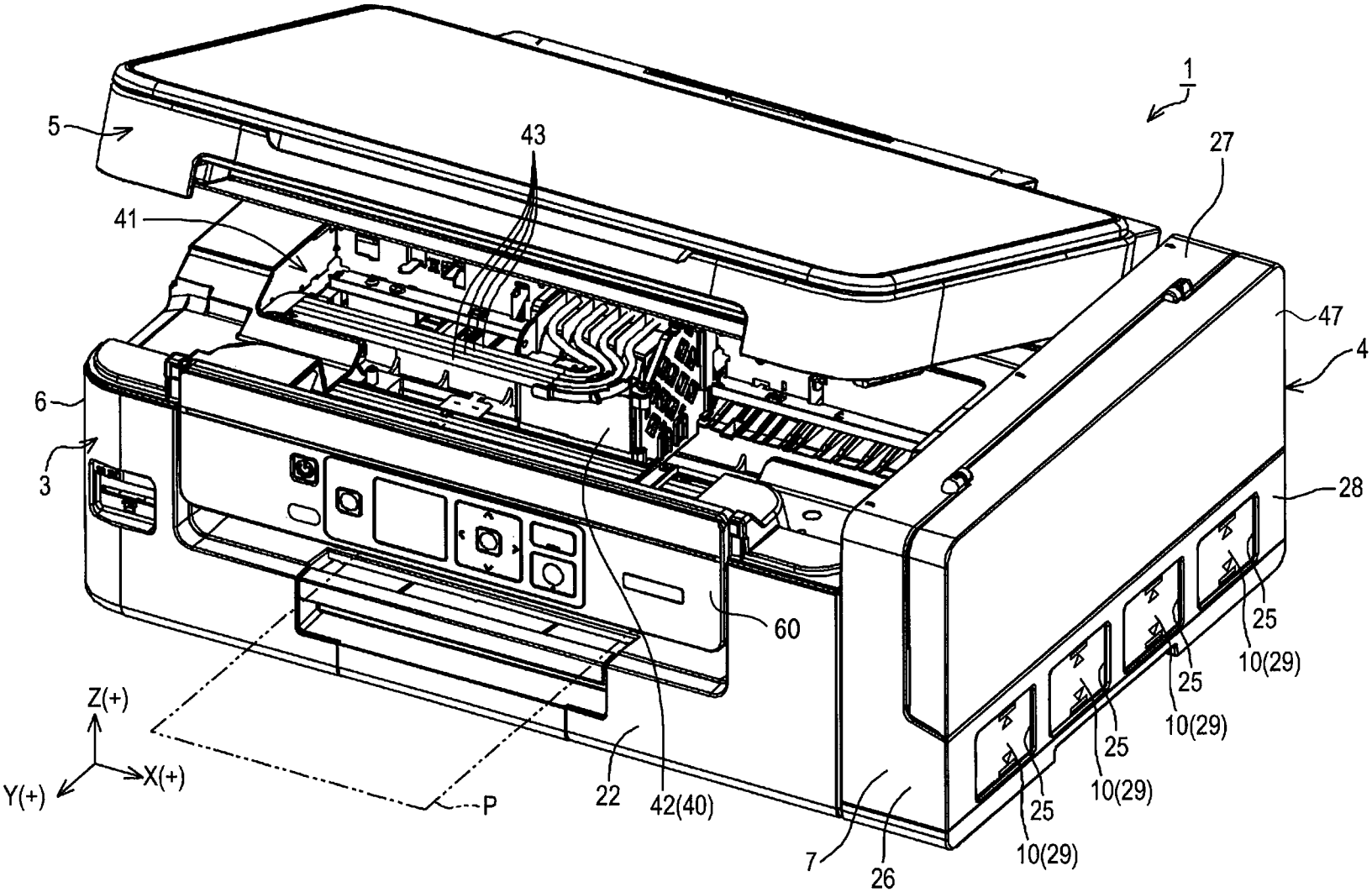
FIG. 3 is a perspective view of the main configuration of the printer according to the first embodiment.

The scanner unit 5 is rotatable with respect to the print unit 3 as illustrated in FIG. 3. The scanner unit 5 also acts as the lid of the print unit 3. The operator can lift the scanner unit 5 in the Z-axis direction to rotate the scanner unit 5 with respect to the print unit 3. Accordingly, the scanner unit 5 acting as the lid of the print unit 3 can be opened to the print unit 3. FIG. 3 illustrates the state in which the scanner unit 5 is opened to the print unit 3.

The print unit 3 has a mechanism unit 41 as illustrated in FIG. 3. The mechanism unit 41 has a print part 42. In the print unit 3, the print part 42 is stored in the housing 6. The print part 42 produces a print with an ink on the print medium P conveyed in the Y-axis direction by a conveyance device (not illustrated). The conveyance device not illustrated intermittently conveys the print medium P in the Y-axis direction. The print part 42 is movable back and forth along the X axis by a movement device (not illustrated) to change the relative position of the print medium P to the print part 42. The tank unit 4 supplies an ink to the print part 42. In the printer 1, at least part of the tank unit 4 protrudes toward the outside of the housing 6. The print part 42 is stored in the housing 6. Accordingly, the print part 42 can be protected by the housing 6.

The direction along the X axis is not limited to the direction completely parallel to the X axis but includes directions inclined due to errors or tolerances, except for the direction orthogonal to the X axis. Similarly, the direction along the Y axis is not limited to the direction completely parallel to the Y axis but includes directions inclined due to errors or tolerances, except for the direction orthogonal to the Y axis. The direction along the Z axis is not limited to the direction completely parallel to the Z axis but includes directions inclined due to errors or tolerances, except for the direction orthogonal to the Z axis. That is, the directions along arbitrary axes or planes are not limited to the directions completely parallel to the arbitrary axes or planes but include directions inclined due to errors or tolerances, except for the directions orthogonal to the arbitrary axes or planes.

As illustrated in FIG. 3, an operation panel 60 including operation portions such as button switches, four-direction push switches, and a center push switch for operating the printer 1 is provided on the front surface 22 of the print unit 3 along the vertical direction at a position at least partially overlapping a liquid injection mechanism part 41 in the vertical direction in the use posture of the printer 1. The operation portions of the operation panel 60 are operated to power on and off, start, cancel, and resume printing, feed and eject paper sheets, and execute various maintenance operations of the printer 1. The operation panel 60 may have a display part such as a liquid crystal display (LCD), that displays guidance images for describing how to operate the operation portions, images indicating the results of operating the operation portions.

The tank unit 4 has the tanks 10. In the present embodiment, the tank unit 4 has a plurality of (four in the present embodiment) tanks 10. The plurality of tanks 10 are positioned outside the housing 6 of the print unit 3. The plurality of tanks 10 are stored in the housing 7. Accordingly, the tanks 10 can be protected by the housing 7. The housing 7 is positioned outside the housing 6. The housing 7 is fixed by screws to the housing 6. That is, the tank unit 4 is fixed by screws to the print unit 3.

In the present embodiment, the tank unit 4 has a plurality of (four) tanks 10. However, the number of the tanks 10 is not limited to four but may be three or less, or larger than four.

Further, in the present embodiment, the plurality of tanks 10 are separately formed. However, the configuration of the tanks 10 as an example of a liquid container body is not limited to this. As a configuration of a liquid container body, the plurality of tanks 10 may be united into one liquid container body. In this case, a plurality of liquid containment parts are provided in one liquid container body. The plurality of liquid containment parts are individually divided to contain different kinds of liquids. In this case, for example, inks of different colors can be contained in the plurality of liquid containment parts. Examples of a method for uniting the plurality of tanks 10 into one liquid container body include bonding or connecting the plurality of tanks 10 and molding integrally the plurality of tanks 10 by integral molding.

Each of the tanks 10 is connected to an ink supply tube 43 as illustrated in FIG. 3. The inks in the tanks 10 are supplied from the tank unit 4 to the print part 42 via the ink supply tubes 43. The print part 42 has a print head (not illustrated) as an example of a liquid injection head. The print head has nozzle openings (not illustrated) oriented toward the print medium P. The print head is an inkjet print head. The inks supplied from the tank unit 4 to the print part 42 via the ink supply tubes 43 are then supplied to the print head. The inks supplied to the print part 42 are discharged as ink droplets from the nozzle openings in the print head toward the target print medium P.

In the foregoing example, the print unit 3 and the tank unit 4 are separately configured. That is, in the foregoing example, the housing 7 and the housing 6 are separated from each other. However, the housing 7 and the housing 6 can be integrally configured. That is, the tank unit 4 can be included in the print unit 3. When the housing 7 and the housing 6 are integrated, the plurality of tanks 10 are stored in the housing 6 together with the print part 42 and the ink supply tubes 43.

The arrangement place of the tanks 10 is not limited to the side part of the housing 6 along the X-axis direction. The tanks 10 can be arranged, for example, on the front surface of the housing 6 along the Y-axis direction.

The thus configured printer 1 produces a print on the print medium P by conveying the print medium P in the Y-axis direction and discharging ink droplets from the print head of the print part 42 at predetermined positions while reciprocating the print part 42 along the X axis.

The inks are not limited to water-based inks or oil-based inks. The water-based inks may be formed such that a solute such as a dye is dissolved in an aqueous solvent or such that a dispersoid such as a pigment is dispersed in an aqueous dispersion medium. The oil-based inks may be formed such that a solute such as a dye is dissolved in a lipid solvent or such that a dispersoid such as a pigment is dispersed in a lipid dispersion medium.

Figure 4:
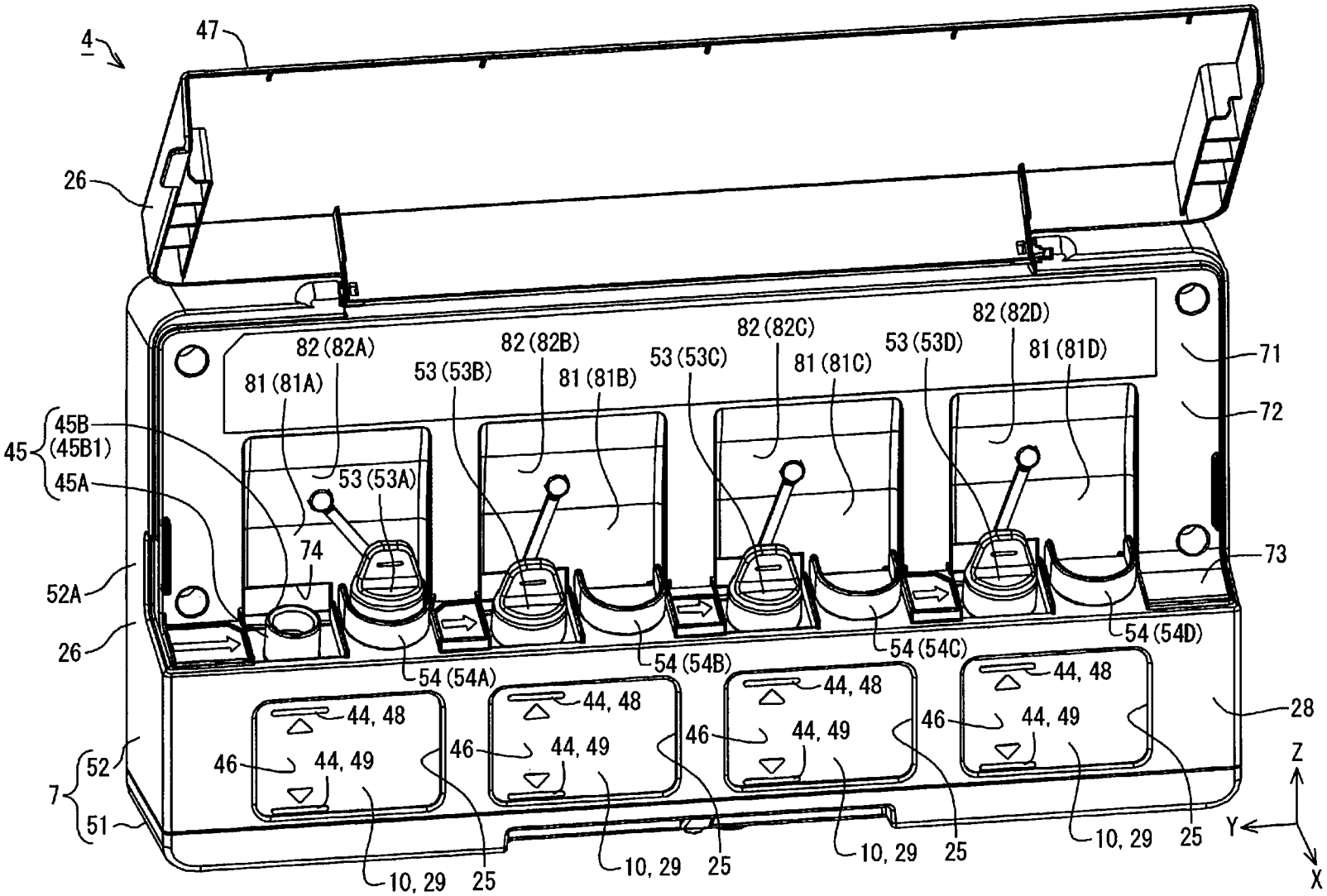
FIG. 4 is a perspective view of a tank unit according to the first embodiment.

In the tank unit 4, signs 44 are added to the tanks 10 as illustrated in FIG. 4. Each of the tanks 10 has an inlet part 45 and a visual-recognition surface 46 as an example of the visual-recognition part described above. In each of the tanks 10, an ink can be poured from the outside into the tank 10 via the inlet part 45. The inlet part 45 communicates with the ink containing part 29 of the tank 10. The inlet part 45 includes a cylindrical portion 45A and an ink introduction port 45B. The cylindrical portion 45A is cylindrically structured and protruded upward from the tank 10. The ink introduction port 45B is an opening at the upper end of the cylindrical portion 45A. The ink introduction port 45B is opened upward. The operator can access the inlet part 45 of the tank 10 from the outside of the housing 7 by opening the cover 47 of the housing 7. The cover 47 is rotatably formed on a main unit 52A via hinges. The upward direction is not limited to the vertically upward direction but includes directions inclined with respect to the vertical directions except for the horizontal direction. Similarly, the downward direction is not limited to the vertically downward direction but includes directions inclined with respect to the vertical directions except for the horizontal direction.

The visual-recognition surface 46 faces the window 25. The operator can visually check the amount of the ink in the ink containing part 29 of each of the tanks 10 by seeing the visual-recognition surface 46 of the tank 10 through the window 25. The amount of the ink in each of the tanks 10 constitutes one piece of information about the ink. The sign 44 indicates the information about the ink. In the present embodiment, the sign 44 is provided on the visual-recognition surface 46 of the tank 10.

Examples of the sign 44 indicating the information about the ink include an upper limit mark 48, a lower limit mark 49, and the like. In the present embodiment, the upper limit mark 48 and the lower limit mark 49 are added to the visual-recognition surface 46 of the tank 10. The operator can grasp the amount of the ink in the tank 10 with reference to the upper limit mark 48 and the lower limit mark 49. The upper limit mark 48 indicates the index for the amount of the ink that will not flow out of the inlet part 45 at the time of ink pouring. The lower limit mark 49 indicates the index for the amount of the ink where the user will be prompted for infusion of the ink. Each of the tanks 10 may be provided with at least one of the upper limit mark 48 and the lower limit mark 49.

The sign 44 indicating the information about the ink may be scales indicating the amount of the ink in each of the tanks 10. The sign 44 may be configured such that the scales are added to the upper limit mark 48 and the lower limit mark 49 or only the scales are provided without the upper limit mark 48 and the lower limit mark 49. The sign 44 indicating the information about the ink may indicate the kind of the ink to be contained in each of the tanks 10. For example, the sign 44 may indicate the color of the ink as the kind of the ink. Examples of the sign 44 indicating the color of the ink include various signs 44 with letters "Bk" for the black ink, "C" for the cyan ink, "M" for the magenta ink, and "Y" for the yellow ink, and indications by color.

The housing 7 includes a first housing 51 and a second housing 52 as illustrated in FIG. 4. The first housing 51 is positioned along the −Z-axis direction of the plurality of tanks 10. The second housing 52 is positioned along the Z-axis direction from the first housing 51 to cover the plurality of tanks 10 from the Z-axis direction of the first housing 51. The plurality of tanks 10 are covered with the first housing 51 and the second housing 52. The second housing 52 includes the main unit 52A and the cover 47. The main unit 52A covers at least some portions of the tanks 10 except for the inlet parts 45. The main unit 52A is an example of a housing. The cover 47 is positioned at an end of the second housing 52 along the X-axis direction. The cover 47 constitutes part of the side surface 28 oriented in the X-axis direction. The cover 47 is configured to be rotatable with respect to the main unit 52A of the second housing 52 as illustrated in FIG. 4. The main unit 52A may cover the entire tanks 10 except for the inlet parts 45.

When the cover 47 is opened to the main unit 52A of the second housing 52, the inlet parts 45 of the plurality of tanks 10 are exposed. Accordingly, the operator can access the inlet parts 45 of the tanks 10 from the outside of the housing 7. The ink introduction ports 45B are sealed with caps 53. To pour an ink into each of the tanks 10, the cap 53 is removed from the inlet part 45 to open the ink introduction port 45B. In the printer 1, the ink introduction ports 45B are oriented upward from the horizontal direction in the use posture.

The one each cap 53 is provided for each of the ink introduction ports 45B. In the present embodiment, the number of the ink introduction ports 45B is the same as the number of the caps 53 (four in the present embodiment). In the following description, for identification of the four caps 53, the four caps 53 will be described as cap 53A, cap 53B, cap 53C, and cap 53D. The caps 53 are attachable to and detachable from the main unit 52A, which are not essential to the printer 1 in the present embodiment.

In the tank unit 4, the main unit 52A has receiving pans 54. The caps 53 removed from the inlet parts 45 can be placed on the receiving pans 54. In the present embodiment, the receiving pans 54 are provided for the purpose of placing thereon the caps 53 removed from the inlet parts 45. The one each receiving pan 54 is provided for each of the ink introduction ports 45B. That is, in the present embodiment, the number of the ink introduction ports 45B is the same as the number of the receiving pans 54 (four in the present embodiment). The plurality of (four in the present embodiment) ink introduction ports 45B are aligned along the Y axis. In addition, the plurality of (four in the present embodiment) receiving pans 54 are also aligned along the Y axis.

In the following description, for identification of the four receiving pans 54, the four receiving pans 54 will be described as receiving pan 54A, receiving pan 54B, receiving pan 54C, and receiving pan 54D. In the following description, for identification of the four ink introduction ports 45B, the four ink introduction ports 45B will be described as ink introduction port 45B1, ink introduction port 45B2, ink introduction port 45B3, and ink introduction port 45B4. Out of the four ink introduction ports 45B, the ink introduction port 45B1 is positioned on the side closest to the Y-axis direction. Specifically, the four ink introduction ports 45B are aligned from the −Y-axis direction toward the Y-axis direction in the order of the ink introduction port 45B4, the ink introduction port 45B3, the ink introduction port 45B2, and the ink introduction port 45B1.

The receiving pan 54A and the cap 53A correspond to the ink introduction port 45B1. The receiving pan 54B and the cap 53B correspond to the ink introduction port 45B2, the receiving pan 54C and the cap 53C correspond to the ink introduction port 45B3, and the receiving pan 54D and the cap 53D correspond to the ink introduction port 45B4.

The main unit 52A of the second housing 52 has a covered part 71 as illustrated in FIG. 4. The covered part 71 is covered with the cover 47 when the cover 47 is closed to the main unit 52A. The covered part 71 includes a wall 72 oriented in the X-axis direction and a wall 73 oriented in a direction crossing the wall 72. The wall 72 is positioned along the −X-axis direction of the side surface 28. The wall 73 is positioned along the −Z-axis direction from the top surface 27 (FIG. 3). The covered part 71 has four opening portions 74. The four opening portions 74 are formed corresponding to the positions of the tanks 10. The opening portions 74 are formed over the wall 72 and the wall 73, straddling a crossing part between the wall 72 and the wall 73. The inlet parts 45 of the tanks 10 are exposed from the main unit 52A through the opening portions 74.

The covered part 71 has concave portions 81. The concave portions 81 are provided to be recessed from the wall 72 in the −X-axis direction. The one each concave portion 81 is provided for each of the ink introduction ports 45B. In the following description, for identification of the four concave portions 81, the four concave portions 81 will be described as concave portion 81A, concave portion 81B, concave portion 81C, and concave portion 81D. The concave portion 81A corresponds to the ink introduction port 45B1, the concave portion 81B corresponds to the ink introduction port 45B2, the concave portion 81C corresponds to the ink introduction port 45B3, and the concave portion 81D corresponds to the ink introduction port 45B4. The concave portions 81 overlap the ink introduction ports 45B and the receiving pans 54 when the main unit 52A is seen from the front, that is, when the main unit 52A is seen in the −X-axis direction. In other words, when the main unit 52A is seen from the front, the ink introduction ports 45B and the receiving pans 54 corresponding to each other are positioned in the regions overlapping the concave portions 81.

Each of the concave portions 81 has an inclined wall 82. Accordingly, the main unit 52A with the four concave portions 81 has the four inclined walls 82. The inclined walls 82 are inclined with respect to the wall 72. In the present embodiment, the wall 72 extends along the YZ plane. Accordingly, the inclined walls 82 are inclined with respect to the YZ plane. The inclined walls 82 are inclined to the −X-axis direction as tending from the upper to lower sides, that is, from the Z-axis direction toward the −Z-axis direction. In other words, the inclined walls 82 are inclined to the inside of the housing 7 as tending from the upper to lower sides, that is, to the print unit 3 (FIG. 3) as tending from the upper to lower sides.

In the following description, for identification of the four inclined walls 82, the four inclined walls 82 will be described as inclined wall 82A, inclined wall 82B, inclined wall 82C, and inclined wall 82D. The inclined wall 82A corresponds to the ink introduction port 45B1, the inclined wall 82B corresponds to the ink introduction port 45B2, the inclined wall 82C corresponds to the ink introduction port 45B3, and the inclined wall 82D corresponds to the ink introduction port 45B4. The wall 72 of the main unit 52A corresponds to the side wall with the inclined walls 82.

Figure 5:
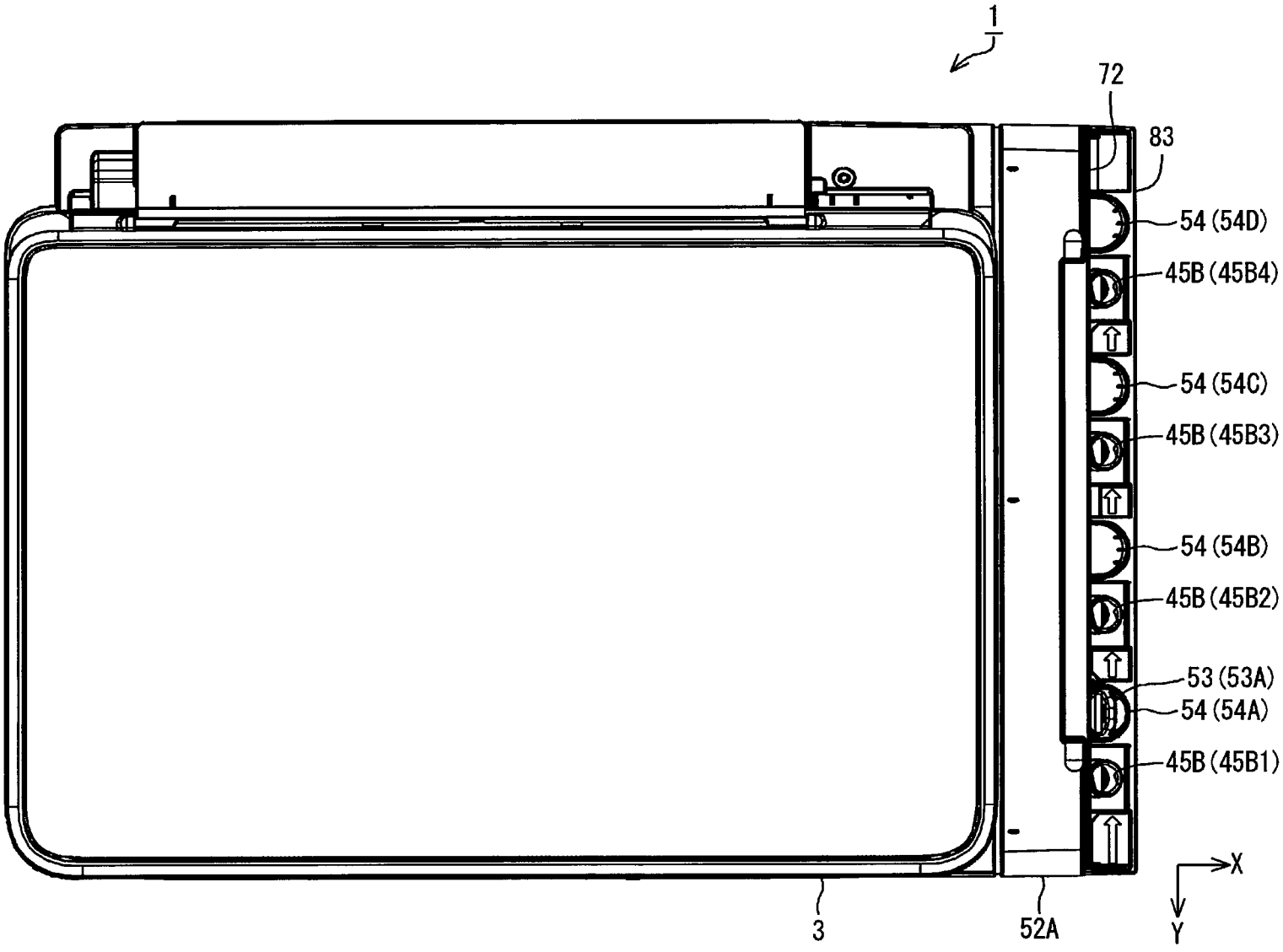
FIG. 5 is a plane view of the main configuration of the printer according to the first embodiment.

When the printer 1 is seen from the Z-axis direction in the use posture of the printer 1, the receiving pans 54 and the ink introduction ports 45B are aligned in a first direction along one side 83 of the printer 1 as illustrated in FIG. 5. In the present embodiment, the first direction along the one side 83 of the printer 1 is equivalent to the Y-axis direction. The four ink introduction ports 45B are positioned in the region of the printer 1 as illustrated in FIG. 5. Specifically, the four ink introduction ports 45B are positioned along the −X-axis direction of the one side 83 of the printer 1, that is, closer to the print unit 3 than the one side 83.

Referring to FIG. 5, the wall 72 of the main unit 52A is located in a position along a second direction of the one side 83, on the assumption that the second direction is a direction crossing the first direction along the one side 83 and tending from the one side 83 to the ink introduction port 45B. In the present embodiment, the second direction crossing the first direction along the one side 83 and tending from the one side 83 to the ink introduction port 45B, is equivalent to the −X-axis direction. The side wall positioned along the second direction of the ink introduction port 45B is equivalent to the wall 72 of the main unit 52A.

Figure 6:
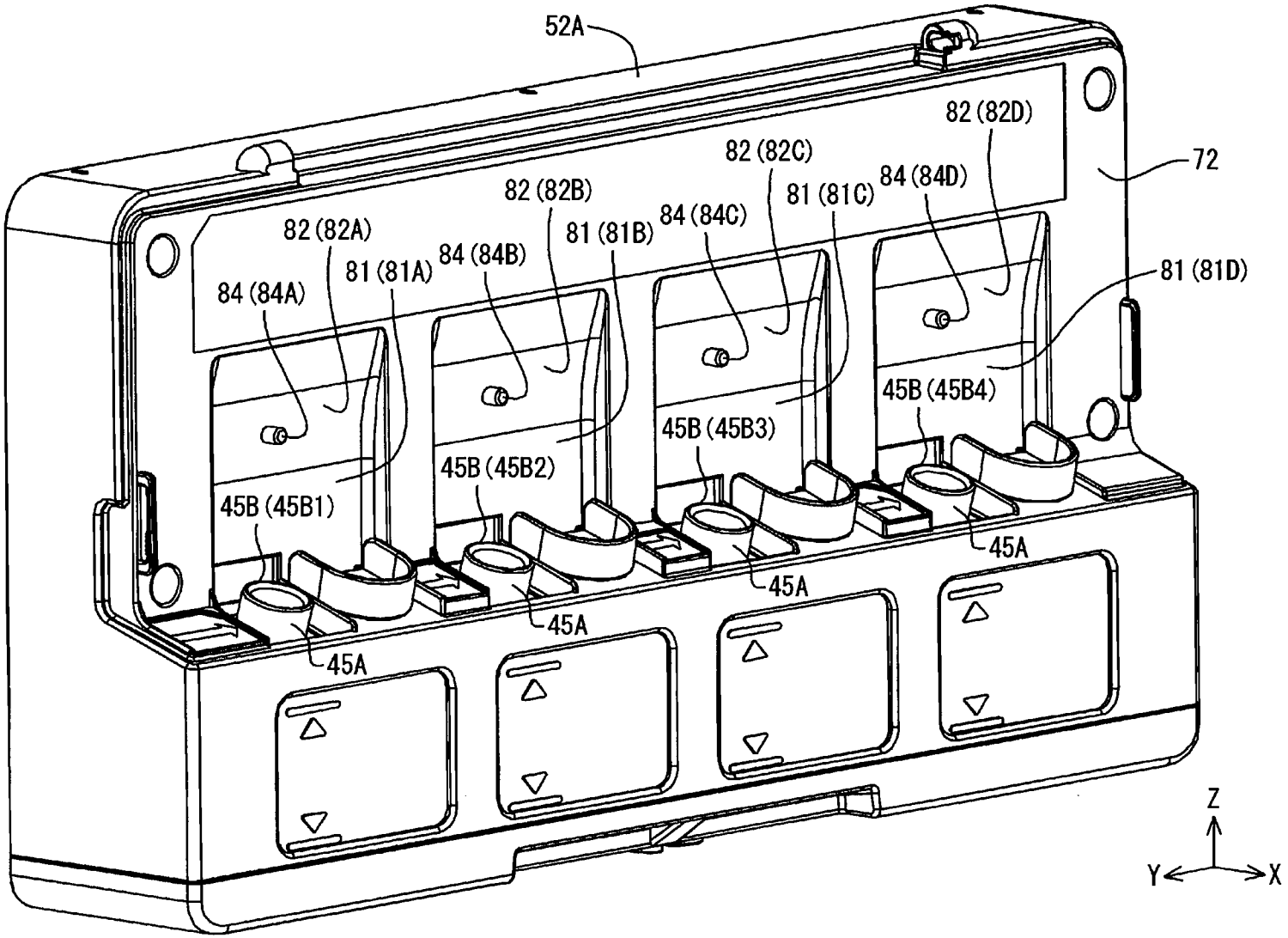
FIG. 6 is a perspective view of part of the tank unit according to the first embodiment.

The main unit 52A has connecting portions 84 as illustrated in FIG. 6. The connecting portions 84 are connected to anchorage portions (described later) provided at the caps 53 (FIG. 4). The one each connecting portion 84 is provided for each of the ink introduction ports 45B. That is, in the present embodiment, the four connecting portions 84 are provided. In the following description, for identification of the four connecting portions 84, the four connecting portions 84 will be described as connecting portion 84A, connecting portion 84B, connecting portion 84C, and connecting portion 84D. The connecting portion 84A corresponds to the ink introduction port 45B1, the connecting portion 84B corresponds to the ink introduction port 45B2, the connecting portion 84C corresponds to the ink introduction port 45B3, and the connecting portion 84D corresponds to the ink introduction port 45B4.

In the main unit 52A, the connecting portions 84 are provided within the concave portions 81. Each of the connecting portions 84 has the form of a projection protruding from the concave portion 81 in the X-axis direction. In the present embodiment, the amount of protrusion of the connecting portion 84 in the X-axis direction fits in the depth of the concave portion 81. Accordingly, the connecting portion 84 does not protrude beyond the depth of the concave portion 81. In each of the concave portions 81, the connecting portion 84 is provided on the inclined wall 82. That is, in the present embodiment, the connecting portions 84 protrude from the inclined walls 82 in the X-axis direction. The inclined walls 82 are not limited to flat surfaces but may have surfaces with asperities or curved surfaces.

Figure 7:
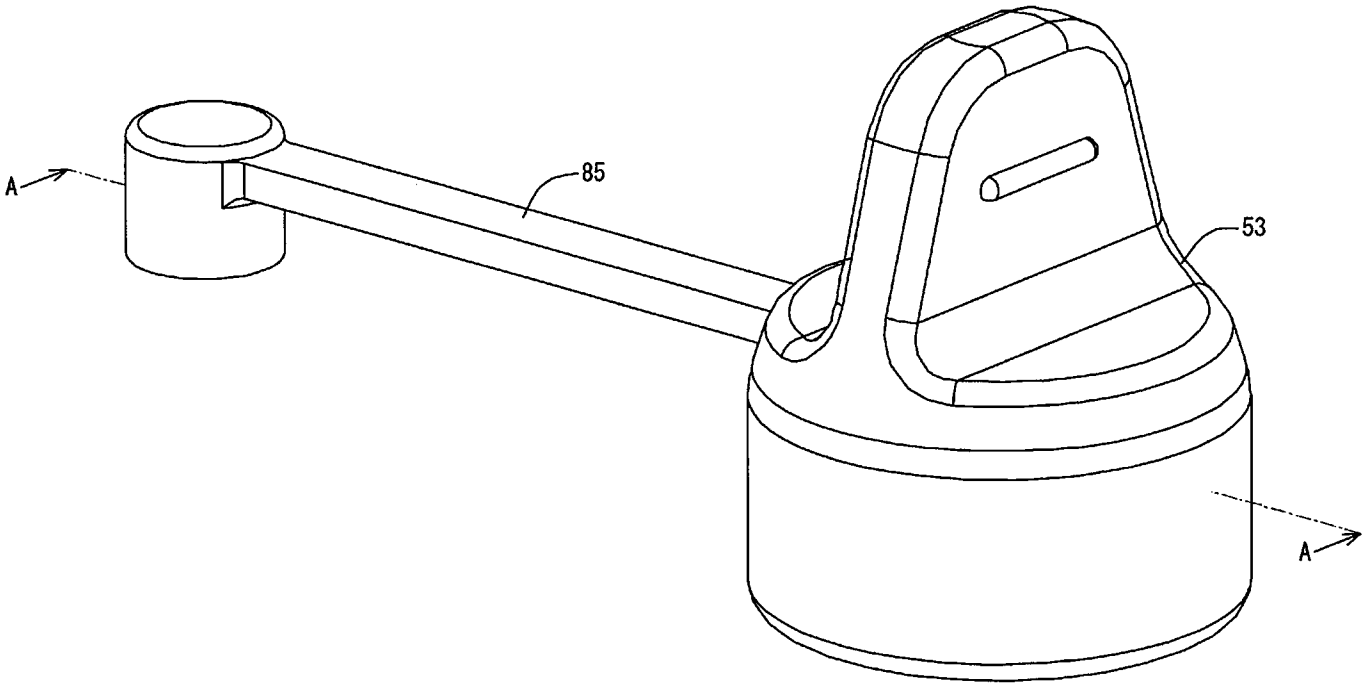
FIG. 7 is a perspective view of a cap according to the first embodiment.
Figure 8:
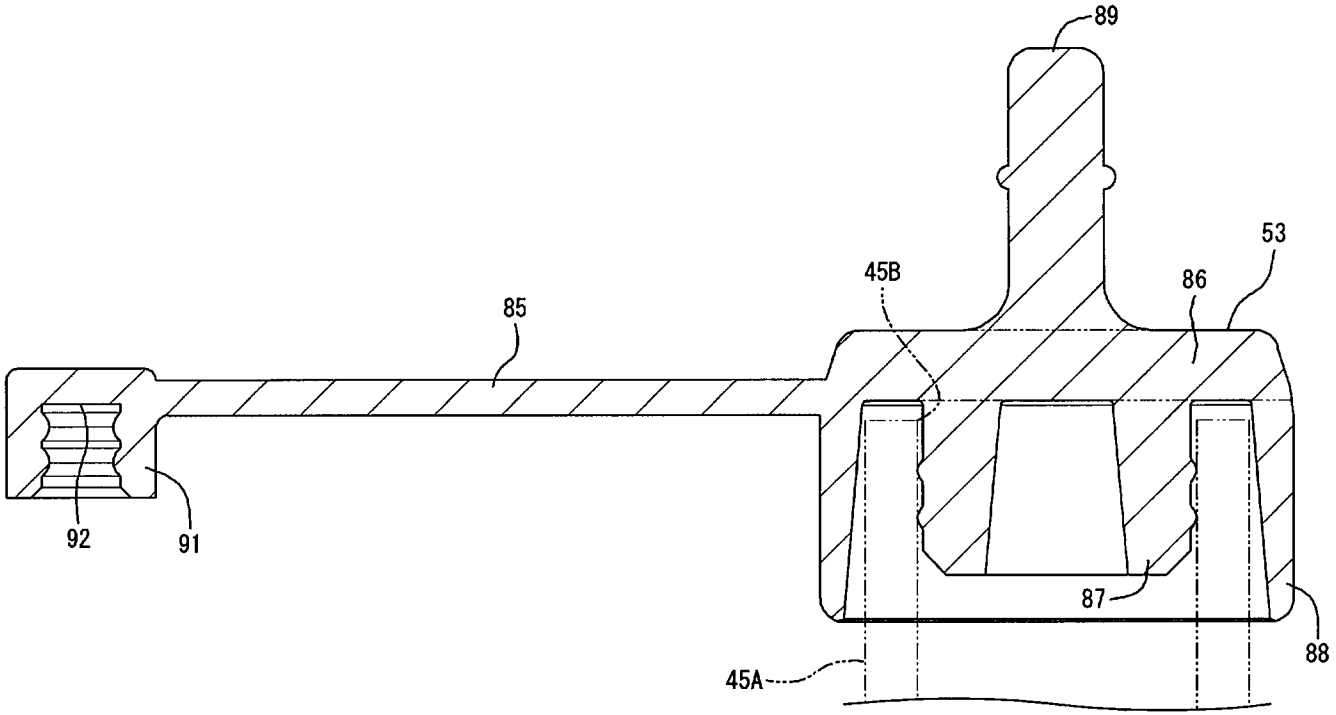
FIG. 8 is a cross-sectional view of FIG. 7 taken along line A-A.

The caps 53 have the anchorage portions 85 as illustrated in FIG. 7. Each of the caps 53 includes a cover portion 86, a seal portion 87, a skirt portion 88, and a grip portion 89 as illustrated in FIG. 8 as a cross-sectional view of FIG. 7 taken along line A-A. Each of the caps 53 is formed from an elastic and flexible material that is less prone to let liquids or gases pass. Examples of a material for the cap 53 include rubber, elastomer, and the like.

The cover portion 86 is sized and shaped enough to cover the ink introduction port 45B from above. In the present embodiment, the cover portion 86 constitutes a plate-like portion that can cover the ink introduction port 45B from above. The seal portion 87 protrudes from the cover portion 86. In the present embodiment, the seal portion 87 protrudes in a cylindrical shape from the cover portion 86 and forms a hollow structure therein. The seal portion 87 is insertable into the ink introduction port 45B. When being inserted in the ink introduction port 45B, the seal portion 87 blocks the ink introduction port 45B. The seal portion 87 and the ink introduction port 45B are in an interference-fit relationship. Specifically, the seal portion 87 is press-fitted into the ink introduction port 45B to block the ink introduction port 45B. Accordingly, when the ink introduction port 45B is blocked by the cap 53, the air tightness between the ink introduction port 45B and the seal portion 87 is enhanced.

In the following description, the state in which the seal portion 87 is inserted into the ink introduction port 45B to block the ink introduction port 45B may also be called the state in which the cap 53 is attached to the inlet part 45. In the following description, unless otherwise specified, the state in which the cap 53 is attached to the inlet part 45 refers to the state in which the seal portion 87 is inserted into the ink introduction port 45B to block the ink introduction port 45B. When the ink introduction port 45B is blocked with the cap 53, the seal portion 87 is inserted into the ink introduction port 45B, and thus the ink in the tanks 10 or the ink deposited on the cylindrical portion 45A may stick to the seal portion 87.

When the cover portion 86 is seen from the seal portion 87 side, the skirt portion 88 is positioned outside the seal portion 87 and protrudes from the cover portion 86. The skirt portion 88 protrudes from the cover portion 86 in the same direction as the direction in which the seal portion 87 protrudes from the cover portion 86. The amount of protrusion of the skirt portion 88 from the cover portion 86 is larger than the amount of protrusion of the seal portion 87 from the cover portion 86. That is, the skirt portion 88 protrudes beyond than the seal portion 87. Accordingly, even if ink is dispersed from the seal portion 87 with momentum when the cap 53 with the ink on the seal portion 87 is extracted from the ink introduction port 45B, the dispersed ink is likely to be caught on the skirt portion 88. This enhances the convenience of the caps 53.

In the present embodiment, when the cover portion 86 is seen from the seal portion 87 side, the skirt portion 88 is provided in the entire region surrounding the seal portion 87. However, the skirt portion 88 is not limited to the mode in which the skirt portion 88 protrudes more greatly than the seal portion 87 in the entire periphery of the region surrounding the seal portion 87. The skirt portion 88 may be partially cut. In this configuration, the effect of reducing the dispersion of the ink can be obtained.

When the seal portion 87 is inserted into the ink introduction port 45B, the cylindrical portion 45A is positioned between the seal portion 87 and the skirt portion 88. In other words, when the seal portion 87 is inserted into the ink introduction port 45B, the cylindrical portion 45A is sandwiched between the seal portion 87 and the skirt portion 88. The skirt portion 88 and the cylindrical portion 45A may be in an interference-fit relationship or a clearance-fit relationship. That is, the skirt portion 88 may be set such that the skirt portion 88 is press-fitted into the cylindrical portion 45A or such that there is a clearance between the skirt portion 88 and the cylindrical portion 45A with the seal portion 87 inserted into the ink introduction port 45B.

The grip portion 89 is provided on the side of the cover portion 86 opposite to the seal portion 87 side. The grip portion 89 protrudes from the cover portion 86 toward the side opposite to the seal portion 87 side. The operator can hold the grip portion 89 to attach or detach the cap 53 to or from the inlet part 45.

The anchorage portion 85 extends in a bar-like manner from the cover portion 86. The anchorage portion 85 extends in a direction crossing the direction in which the seal portion 87 protrudes from the cover portion 86. The anchorage portion 85 has a connected portion 91 at the end opposite to the cover portion 86. The connected portion 91 protrudes in a cylindrical manner from the anchorage portion 85. In the present embodiment, the connected portion 91 protrudes from the anchorage portion 85 in the same direction as the direction in which the seal portion 87 protrudes from the cover portion 86. The connected portion 91 protruding in a cylindrical manner has a concave portion 92 therein.

When the connecting portion 84 (FIG. 6) of the main unit 52A is inserted into the concave portion 92 of the connected portion 91, the anchorage portion 85 is anchored to the connecting portion 84 of the main unit 52A. In the present embodiment, the concave portion 92 and the connecting portion 84 are in an interference-fit relationship. Specifically, the connecting portion 84 is press-fitted into the concave portion 92 to connect the connected portion 91 to the connecting portion 84. This makes it possible to enhance the fixing force of the connected portion 91 to the connecting portion 84. Accordingly, when the anchorage portion 85 is anchored to the connecting portion 84, the cap 53 is unlikely to come off the main unit 52A.

As described above, in the present embodiment, the connecting portions 84 are provided on the inclined walls 82 of the concave portions 81. Accordingly, it is possible to decrease the possibility that, when the anchorage portions 85 of the caps 53 are anchored to the connecting portions 84, the anchorage portions 85 protrude in the X-axis direction from the walls 72 of the main unit 52A.

In the present embodiment, the caps 53 can be attached to the inlet parts 45 while the anchorage portions 85 are anchored to the connecting portions 84 as illustrated in FIG. 4. In addition, the caps 53 removed from the inlet parts 45 can be placed on the receiving pans 54 while the anchorage portions 85 are anchored to the connecting portions 84. Specifically, in the present embodiment, the anchorage portions 85 have a length enough to attach the caps 53 to the inlet parts 45 and place the caps 53 removed from the inlet parts 45 on the receiving pans 54 while the anchorage portions 85 are anchored to the connecting portions 84.

Figure 9:
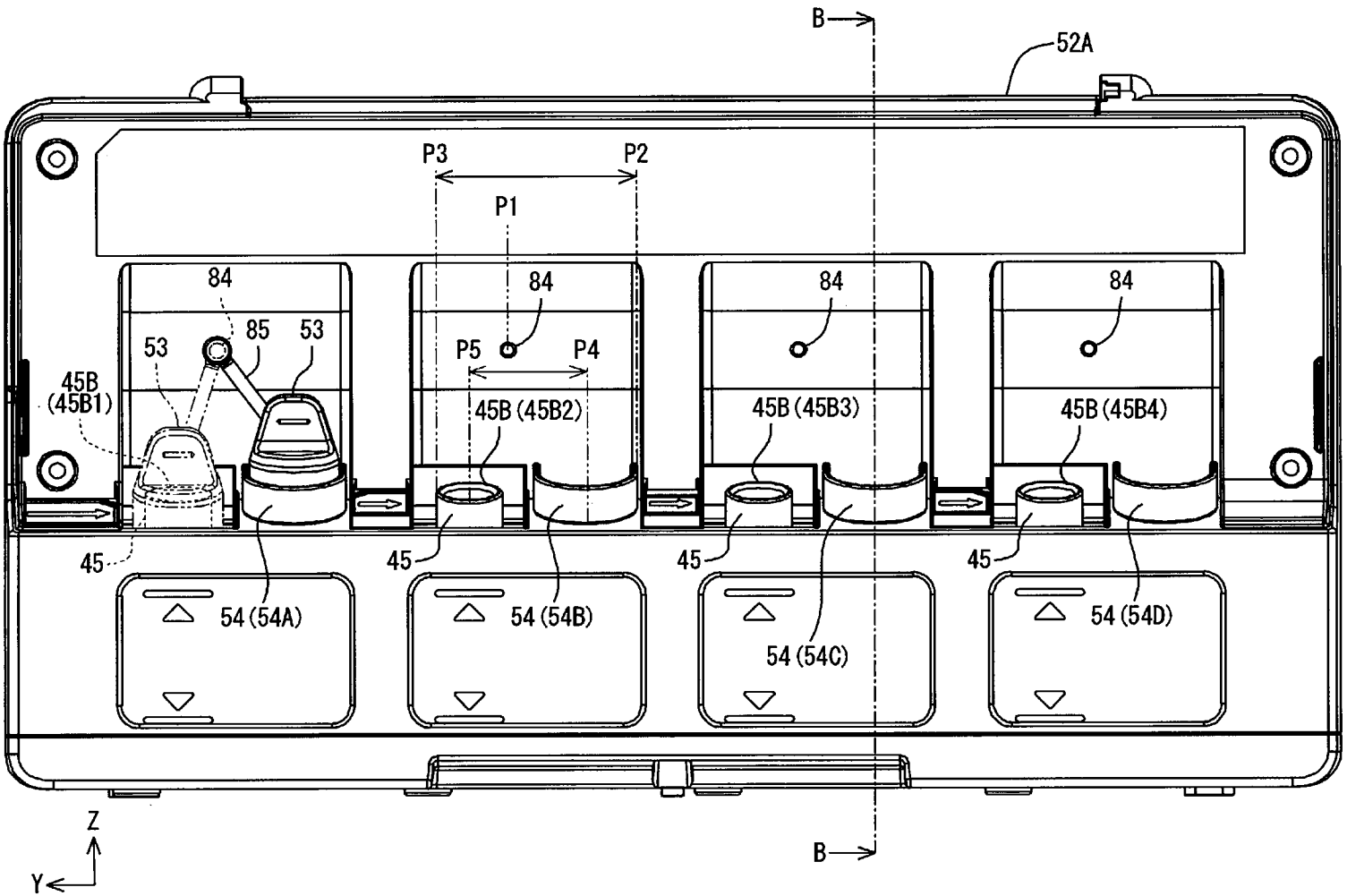
FIG. 9 is a diagram of part of the tank unit according to the first embodiment as seen in an X-axis direction.

While the anchorage portions 85 are anchored to the connecting portions 84, one each of the caps 53 can be placed on only the corresponding one of the four receiving pans 54 as illustrated in FIG. 9. In addition, while the anchorage portions 85 are anchored to the connecting portions 84, one each of the caps 53 can be attached to only the corresponding one of the four inlet parts 45. That is, while the anchorage portions 85 are anchored to the connecting portions 84, the movable area of the one cap 53 is the area between the corresponding ink introduction port 45B and the corresponding receiving pan 54. One of requirements for the foregoing configuration is in that, when the main unit 52A is seen from the front, that is, when the main unit 52A is seen from the −X-axis direction, a position P1 of the connecting portion 84 along the Y-axis direction is located between a position P2 and a position P3.

This is equivalent to the matter that, when the printer 1 is seen from the vertically upward side in the use posture of the printer 1, the position P1 of the connecting portion 84 along the first direction is located between the position P2 along the first direction of the receiving pan 54 and the position P3 along the first direction of the ink introduction port 45B. The position P2 is a position along the Y-axis direction of the receiving pan 54 corresponding to the connecting portion 84. The position P3 is a position along the Y-axis direction of the ink introduction port 45B corresponding to the connecting portion 84. The position P2 is the position of the end of the receiving pan 54 oriented in the −Y-axis direction. The position P3 is the position of the end of the ink introduction port 45B oriented in the Y-axis direction. Accordingly, when the printer 1 is seen from the vertically upward side in the use posture of the printer 1, it is easy to align the distance from the connecting portion 84 to the receiving pan 54 with the distance from the connecting portion 84 to the ink introduction port 45B. According to this requirement, the movable area of the cap 53 can be set to the area between the ink introduction port 45B and the receiving pan 54.

In the present embodiment, when the main unit 52A is seen from the front, that is, when the main unit 52A is seen in the −X-axis direction, the position P1 along the Y-axis direction of the connecting portion 84 is located between a position P4 and a position P5. The position P4 is the position of the center of the receiving pan 54 corresponding to the connecting portion 84. The position P5 is the position of the center of the ink introduction port 45B. This is equivalent to the matter that, when the printer 1 is seen from the vertically upward side in the use posture of the printer 1, the position of the connecting portion 84 along the first direction is located between the position of the center along the first direction of the receiving pan 54 and the position of the center along the first direction of the ink introduction port 45B. Accordingly, when the printer 1 is seen from the vertically upward side in the use posture of the printer 1, it is further easy to align the distance from the connecting portion 84 to the receiving pan 54 with the distance from the connecting portion 84 to the ink introduction port 45B. According to this requirement, the movable area of the cap 53 can be set such that the length of the anchorage portion 85 is short while keeping the area between the ink introduction port 45B and the receiving pan 54. This makes it easy to reduce slack in the anchorage portion 85.

Figure 10:
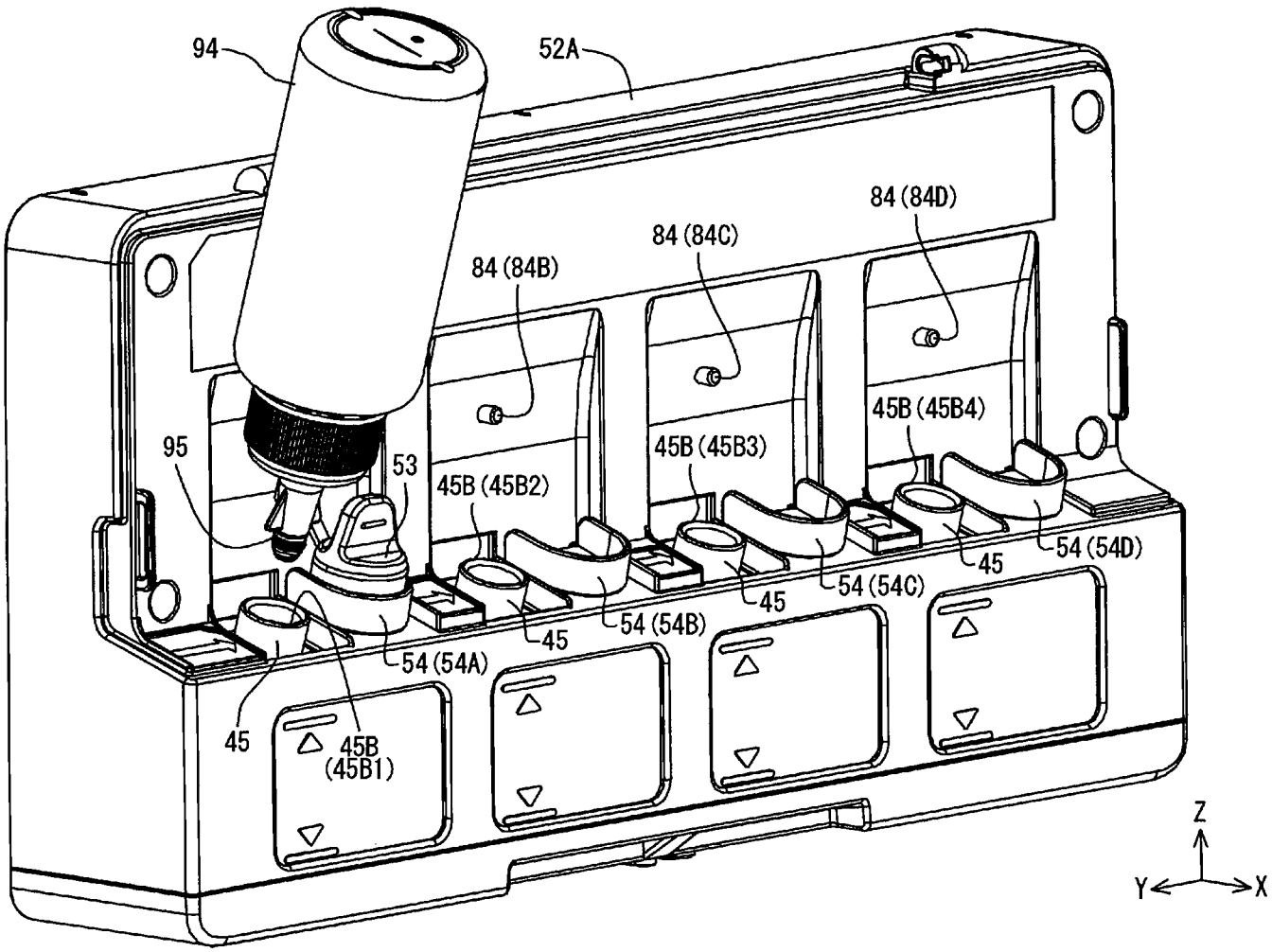
FIG. 10 is a perspective view of part of the tank unit according to the first embodiment and an ink infusion container.

In the present embodiment, as illustrated in FIG. 10, the ink contained in the ink infusion container 94 can be poured into the tank 10. The ink infusion container 94 has a nozzle part 95 that is capable of discharging an ink. The nozzle part 95 has a tubular structure. The ink in the ink infusion container 94 is discharged to the outside of the ink infusion container 94 via the nozzle part 95. With the cap 53 removed from the inlet part 45, the operator inserts the nozzle part 95 of the ink infusion container 94 into the ink introduction port 45B and then pours the ink in the ink infusion container 94 from the inlet part 45 into the tank 10.

Figure 11:
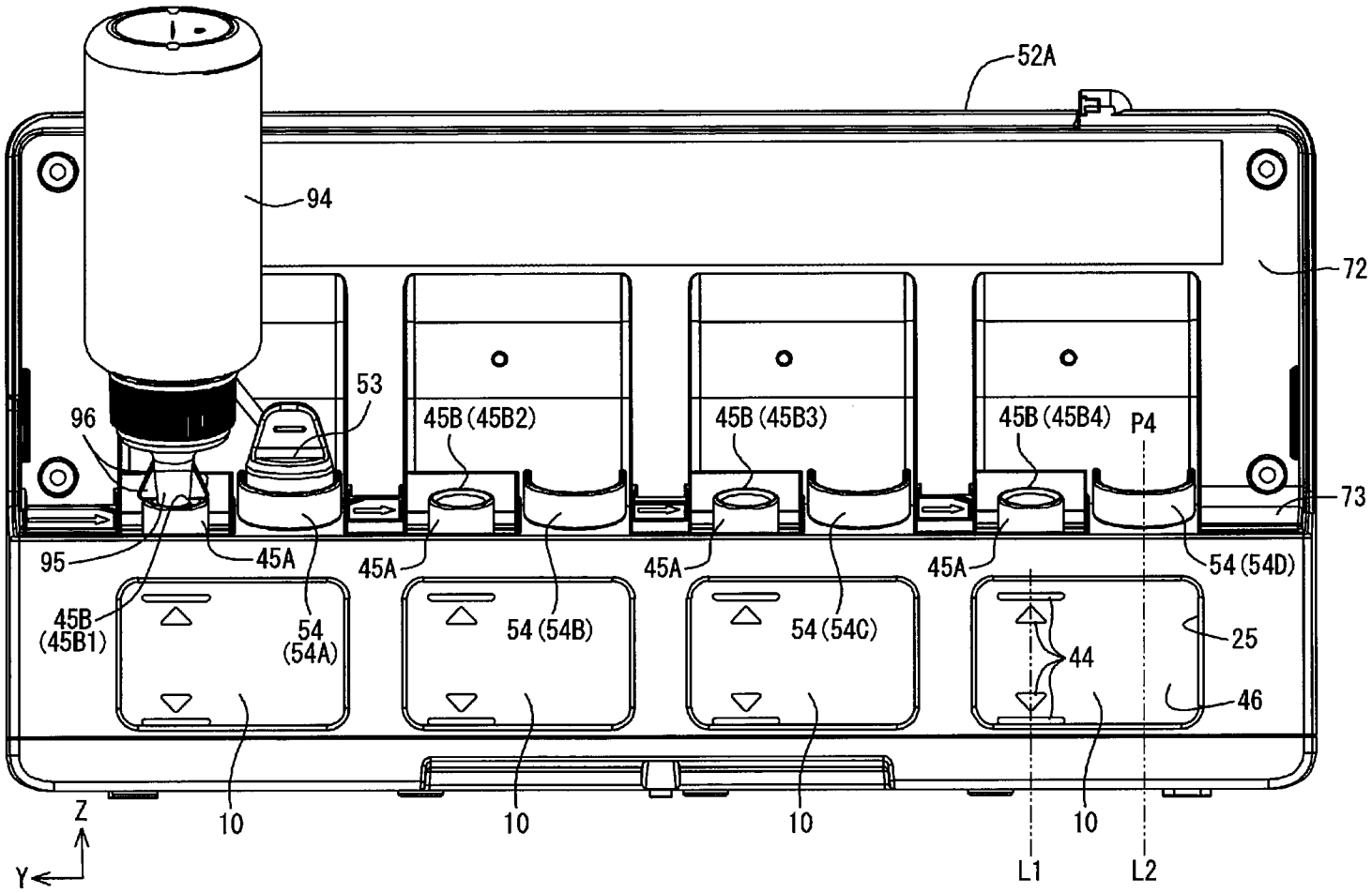
FIG. 11 is a diagram of part of the tank unit according to the first embodiment and the ink infusion container as seen in the X-axis direction.

In this example, the ink infusion container 94 has a positioning part 96 as illustrated in FIG. 11. In the present embodiment, the positioning part 96 is provided on the outside of the tubular nozzle part 95. When the nozzle part 95 is inserted into the ink introduction port 45B, the positioning part 96 abuts with the end (outer end) of the ink introduction port 45B and determines the degree of insertion of the nozzle part 95 into the ink introduction port 45B (also called nozzle insertion). In the present embodiment, when the nozzle part 95 is inserted into the ink introduction port 45B, the positioning part 96 can abut with the end (outer end) of the cylindrical portion 45A constituting the ink introduction port 45B. Accordingly, when the nozzle part 95 of the ink infusion container 94 is inserted into the ink introduction port 45B, the position of the ink infusion container 94 with respect to the tank 10 is easy to control.

In this way, when the positioning part 96 abuts with the end of the cylindrical portion 45A constituting the ink introduction port 45B, there is a clearance between the ink infusion container 94 and the connecting portion 84. Accordingly, when the positioning part 96 of the ink infusion container 94 abuts with the ink introduction port 45B, it is easy to avoid contact with the connected portion 91 of the cap 53 connected to the connecting portion 84. As a result, when the ink is poured into the tank 10 from the ink infusion container 94, it is easy to avoid interference by the connected portion 91 and the connecting portion 84.

Figure 12:
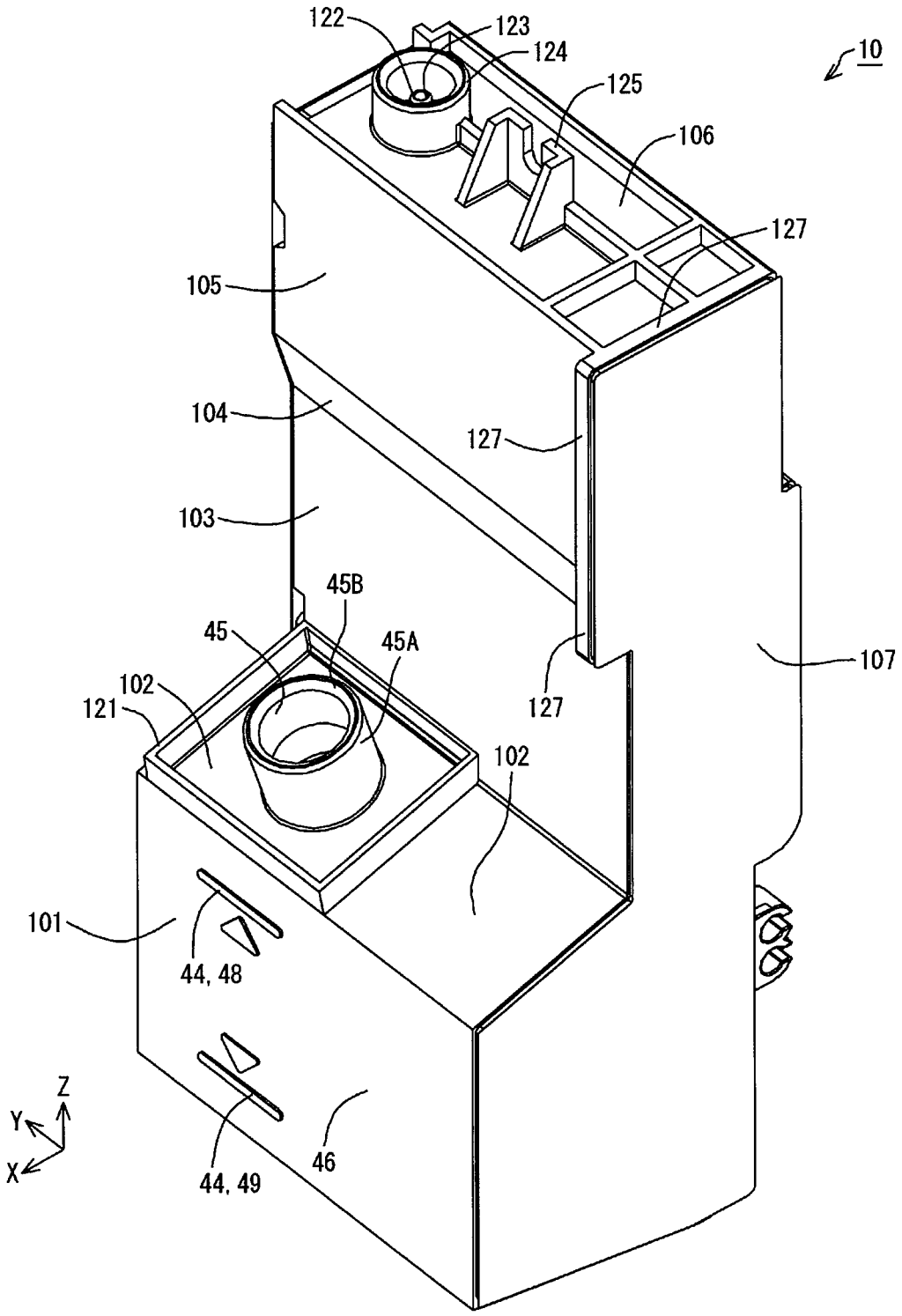
FIG. 12 is a perspective view of a tank according to the first embodiment.
Figure 13:
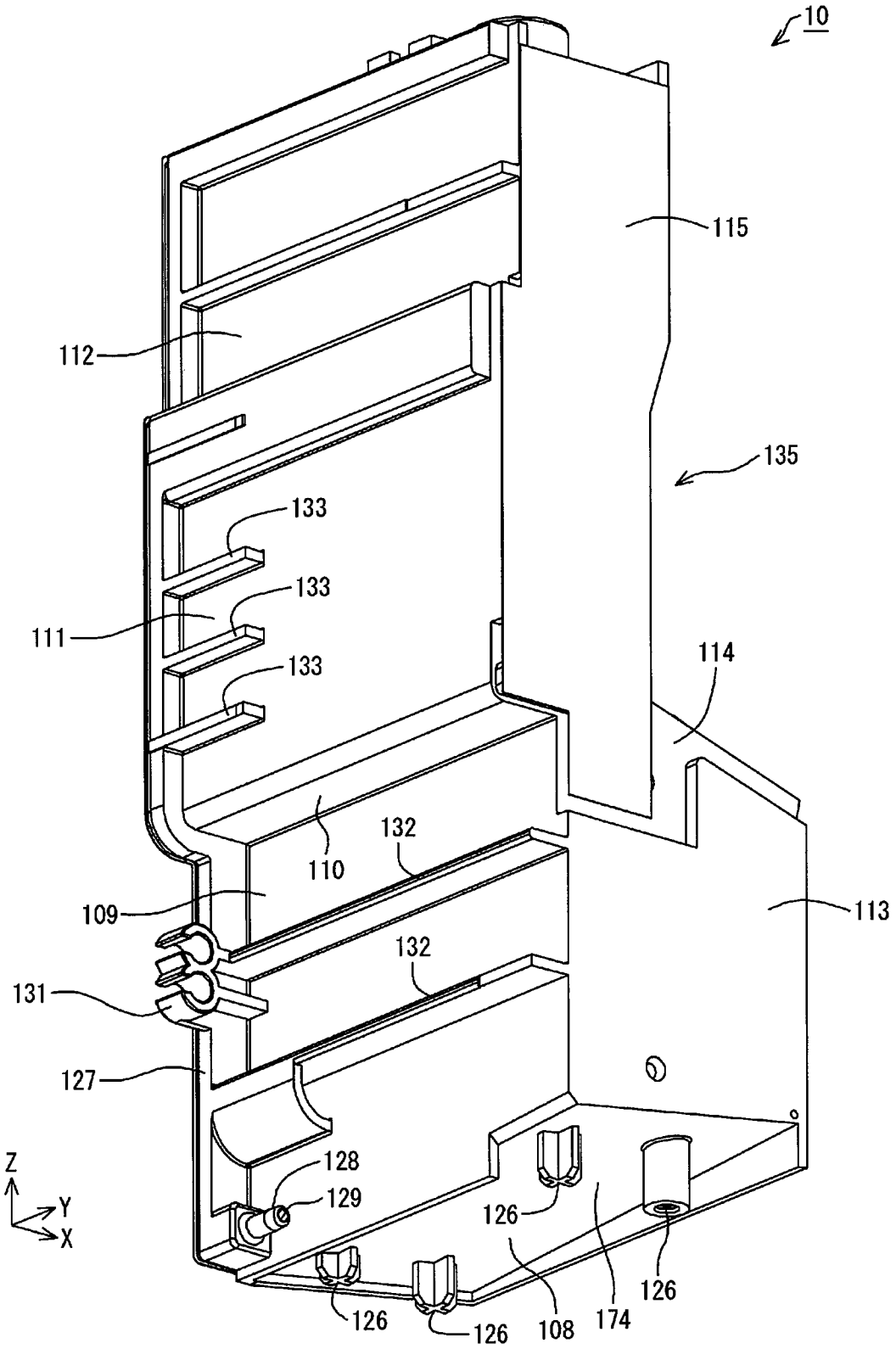
FIG. 13 is a perspective view of the tank according to the first embodiment.
Figure 14:
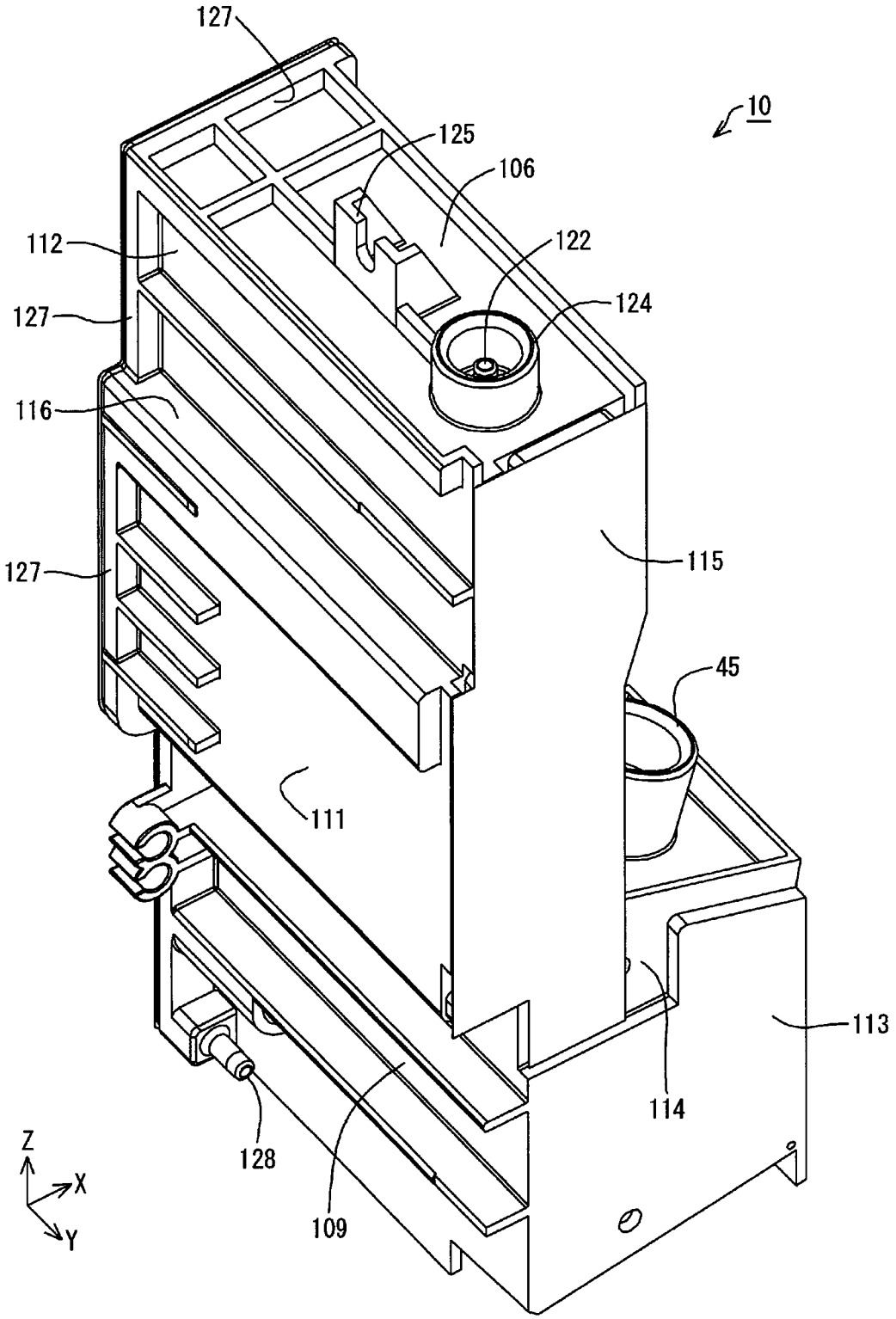
FIG. 14 is a perspective view of the tank according to the first embodiment.

The tank 10 has a surface 101, a surface 102, a surface 103, a surface 104, a surface 105, a surface 106, and a surface 107 as illustrated in FIG. 12. The surfaces 101 to 107 are surfaces oriented outward in the tank 10. In addition, the tank 10 has a surface 108, a surface 109, a surface 110, a surface 111, a surface 112, a surface 113, a surface 114, a surface 115 as illustrated in FIG. 13. The surfaces 108 to 115 are surfaces oriented outward in the tank 10. The tank 10 also has a surface 116 as illustrated in FIG. 14. The surface 116 is a surface oriented outward in the tank 10.

The surfaces 101 to 116 constitute the outer case of the tank 10. The surfaces 101 to 116 are not limited to flat surfaces. The surfaces 101 to 116 may include asperities, steps, curves, and the like. The surfaces 101 to 116 may have protrusions.

The surface 101 is set as the visual-recognition surface 46 described above as illustrated in FIG. 12. The surface 101 has the upper limit mark 48 and the lower limit mark 49 as an example of the signs 44. The upper limit mark 48 and the lower limit mark 49 protrude from the surface 101, which are an example of the protrusions described above. The surface 101 is oriented in the X-axis direction. The surface 101 extends along the YZ plane.

The surface 102 is positioned in the Z-axis direction of the surface 101 and crosses the surface 101. The surface 102 is inclined with respect to the XY plane and the YZ plane. The surface 102 is inclined to the Z-axis direction from the surface 101 to the −X-axis direction. The surface 102 has the inlet part 45. The inlet part 45 is inclined according to the inclination of the surface 102. Accordingly, the cylindrical portion 45A is also inclined according to the inclination of the surface 102. In addition, the ink introduction port 45B is also inclined according to the inclination of the surface 102.

The surface 102 has a surrounding wall 121. The surrounding wall 121 is provided in a tubular shape on the outside of the inlet part 45 and surrounds the inlet part 45 from the outside. The surrounding wall 121 protrudes upward from the surface 102. The surrounding wall 121 is also inclined according to the inclination of the surface 102. Accordingly, the surrounding wall 121 protrudes from the surface 102 to the same direction in which the cylindrical portion 45A protrudes from the surface 102. The cylindrical portion 45A and the surrounding wall 121 are an example of the protrusions.

The surface 103 is oriented in the X-axis direction and extends along the YZ plane. The surface 103 is positioned in the Z-axis direction of the surface 102 and crosses the surface 102. The surface 103 is also located at a position along the −X-axis direction of the surface 101. The surface 104 is positioned in the Z-axis direction of the surface 103 and crosses the surface 103. The surface 104 is inclined with respect to the XY plane and the YZ plane. The surface 104 is inclined to the X-axis direction from the surface 103 to the Z-axis direction.

The surface 105 is oriented in the X-axis direction and extends along the YZ plane. The surface 105 is positioned in the Z-axis direction of the surface 104 and crosses the surface 104. The surface 105 is also located at a position along the X-axis direction of the surface 103 and located at a position along the −X-axis direction from the surface 101. That is, when the tank 10 is seen from the Y-axis direction, the surface 105 is positioned between the surface 101 and the surface 103. The surface 106 is positioned in the −X-axis direction of the surface 105 and crosses the surface 105 at a position along the Z-axis direction of the surface 104. The surface 106 is oriented in the Z-axis direction and extends along the XY plane.

The surface 106 has an air release part 122. The air release part 122 protrudes from the surface 106 to the Z-axis direction. The air release part 122 has an air opening port 123 opened to the Z-axis direction. The surface 106 has a cylindrical wall 124. The cylindrical wall 124 is provided in a cylindrical shape on the outside of the air release part 122 and surrounds the air release part 122 from the outside. The cylindrical wall 124 protrudes from the surface 106 to the Z-axis direction. The surface 106 has a fixed part 125. The fixed part 125 protrudes from the surface 106 to the Z-axis direction. The air release part 122, the cylindrical wall 124, and the fixed part 125 are an example of the protrusions.

The surface 107 is positioned in the −Y-axis direction of the surfaces 101 to 106 and crosses the surfaces 101 to 106. The surface 107 is oriented in the −Y-axis direction and extends along the XZ plane.

The surface extending along the XZ plane is not limited to the surface extending in complete parallel to the XZ plane but includes the surfaces inclined due to errors or tolerances, except for the surface orthogonal to the XZ plane. Similarly, the surface extending along the YZ plane is not limited to the surface extending in complete parallel to the YZ plane but includes the surfaces inclined due to errors or tolerances, except for the surface orthogonal to the YZ plane. The surface extending along the XY plane is not limited to the surface extending in complete parallel to the XY plane but includes the surfaces inclined due to errors or tolerances, except for the surface orthogonal to the XY plane.

The matter that two surfaces cross each other means that the two surfaces are not in parallel to each other. When two surfaces are in direct contact with each other and even when two surfaces are not in direct contact with each other but are separated from each other, in the case where the extension of one surface crosses the extension of the other surface, the two surfaces can be said to cross each other. The angle formed by the two crossing surfaces may be any of right angle, obtuse angle, and acute angle.

Out of the surfaces of the tank 10 oriented outward, the surface 108 is oriented downward as illustrated in FIG. 13. The surface 108 is inclined with respect to the XY plane and the YZ plane. The surface 108 is positioned in the −Z-axis direction of the surface 101 (FIG. 12) and the surface 107 and crosses the surface 101 and the surface 107. The surface 108 is inclined to the −Z-axis direction from the Y-axis direction to the −Y-axis direction. The surface 108 is also inclined to the −Z-axis direction from the X-axis direction to the −X-axis direction.

The surface 108 has leg parts 126 as illustrated in FIG. 13. In the present embodiment, the plurality of leg parts 126 are provided. The leg parts 126 protrude from the surface 108 to the −Z-axis direction. The leg parts 126 are used for positioning and fixation of the tank 10 to the first housing 51 (FIG. 4). The leg parts 126 are an example of the protrusions described above.

The surface 109 is oriented in the −X-axis direction and extends along the YZ plane as illustrated in FIG. 13. The surface 109 is positioned in the Z-axis direction of the surface 108 and crosses the surface 108. The surface 109 has an overhang part 127. The surface 109 has the overhang part 127 at the end along the −Y-axis direction. The overhang part 127 overhangs from the surface 109 to the −X-axis direction. In the present embodiment, the overhang part 127 is provided at the end of the surface 109 along the −Y-axis direction in a region along the Z-axis direction. The back surface of the overhang part 127, that is, the surface of the overhang part 127 on the −Y-axis direction side corresponds to the surface 107 illustrated in FIG. 12.

As illustrated in FIG. 13, the overhang part 127 is oriented in the Y-axis direction and extends along the XZ plane. An ink supply part 128 is provided at the end of the overhang part 127 along the −Z-axis direction. The ink supply part 128 protrudes from the overhang part 127 to the Y-axis direction. The ink supply part 128 has an ink supply port 129 opened to the Y-axis direction. In the present embodiment, the ink supply tube 43 (FIG. 3) is connected to the ink supply part 128. The ink in the tank 10 is supplied from the ink supply port 129 through the ink supply tube 43 to the print part 42 (FIG. 3). The ink supply port 129 corresponds to the liquid lead-out port.

As illustrated in FIG. 13, the surface 109 has a tube hold part 131 and ribs 132. The tube hold part 131 protrudes from the surface 109 to the −X-axis direction. The ribs 132 also protrude from the surface 109 to the −X-axis direction. The tube hold part 131 and the ribs 132 are an example of the protrusions described above. The tube hold part 131 has an annular outer shape with a partial cut. The tube hold part 131 is formed such that the ink supply tube 43 (FIG. 3) is insertable therein. The tube hold part 131 holds the ink supply tube 43. Accordingly, the ink supply tube 43 can be easily fixed and arranged at the time of assembly of the printer 1, for example.

The surface 110 is oriented in the −Z-axis direction and extends along the XY plane as illustrated in FIG. 13. The surface 110 is positioned in the Z-axis direction of the surface 109 and crosses the surface 109. The overhang part 127 continues from the surface 109 to the surface 110. The surface 111 is oriented in the −X-axis direction and extends along the YZ plane. The surface 111 is positioned in the Z-axis direction of the surface 110 and crosses the surface 110. The surface 111 is also located at a position along the −X-axis direction of the surface 109. The overhang part 127 continues from the surface 109 to the surfaces 110 and 111. The surface 111 has ribs 133. The ribs 133 protrudes from the surface 111 to the −X-axis direction. The ribs 133 are an example of the protrusions described above.

The surface 112 is oriented in the −X-axis direction and extends along the YZ plane. The surface 112 is positioned in the −Z-axis direction of the surface 106 illustrated in FIG. 12 and crosses the surface 106. The surface 112 is positioned along the X-axis direction of the surface 111 and positioned along the −X-axis direction from the surface 109 as illustrated in FIG. 13.

In the tank 10, as illustrated in FIG. 14, the surface 116 is positioned between the surface 111 and the surface 112. The surface 116 is oriented in the Z-axis direction and extends along the XY plane. The surface 116 is positioned in the Z-axis direction of the surface 111 and positioned in the −Z-axis direction of the surface 112. The surface 116 crosses the surface 111 at the end in the Z-axis direction of the surface 111 and crosses the surface 112 at the end in the −Z-axis direction of the surface 112. The surface 112 crosses the surface 106 on the side opposite to the surface 116, that is, on the side along the Z-axis direction. The overhang part 127 continues from the surface 111 through the surfaces 116 and 112 to the surface 106. As illustrated in FIG. 12, the overhang part 127 continues from the surface 106 through the surface 105 to the surface 104. That is, the overhang part 127 continuously extends from the surface 109 (FIG. 13) through the surface 110, the surface 111, the surface 116 (FIG. 14), the surface 112, the surface 106, and the surface 105 (FIG. 12) to the surface 104.

As illustrated in FIG. 13, the surface 113 is oriented in the Y-axis direction and extends along the XZ plane. The surface 113 is positioned in the Y-axis direction of the surface 108 and the surface 109 and crosses the surface 108 and the surface 109. The surface 114 is oriented in the Y-axis direction and extends along the XZ plane. The surface 114 is positioned in the Y-axis direction of the surface 109 and crosses the surface 109. The surface 114 is also positioned in the Z-axis direction of the surface 113.

The surface 115 is oriented in the Y-axis direction and extends along the XZ plane. The surface 115 is positioned in the Y-axis direction of the surface 110, the surface 111, the surface 112, and the surface 116 (FIG. 14). The surface 115 crosses the surface 110, the surface 111, the surface 112, and the surface 116 (FIG. 14). As illustrated in FIG. 13, the surface 114 is positioned between the surface 113 and the surface 115. The surface 114 is also located at a position along the −Y-axis direction of the surface 113 and the surface 115. In the following description, the surface 113 to the surface 115 will also be collectively called front surface 135. The front surface 135 is a surface oriented in the Y-axis direction in the tank 10.

Figure 15:
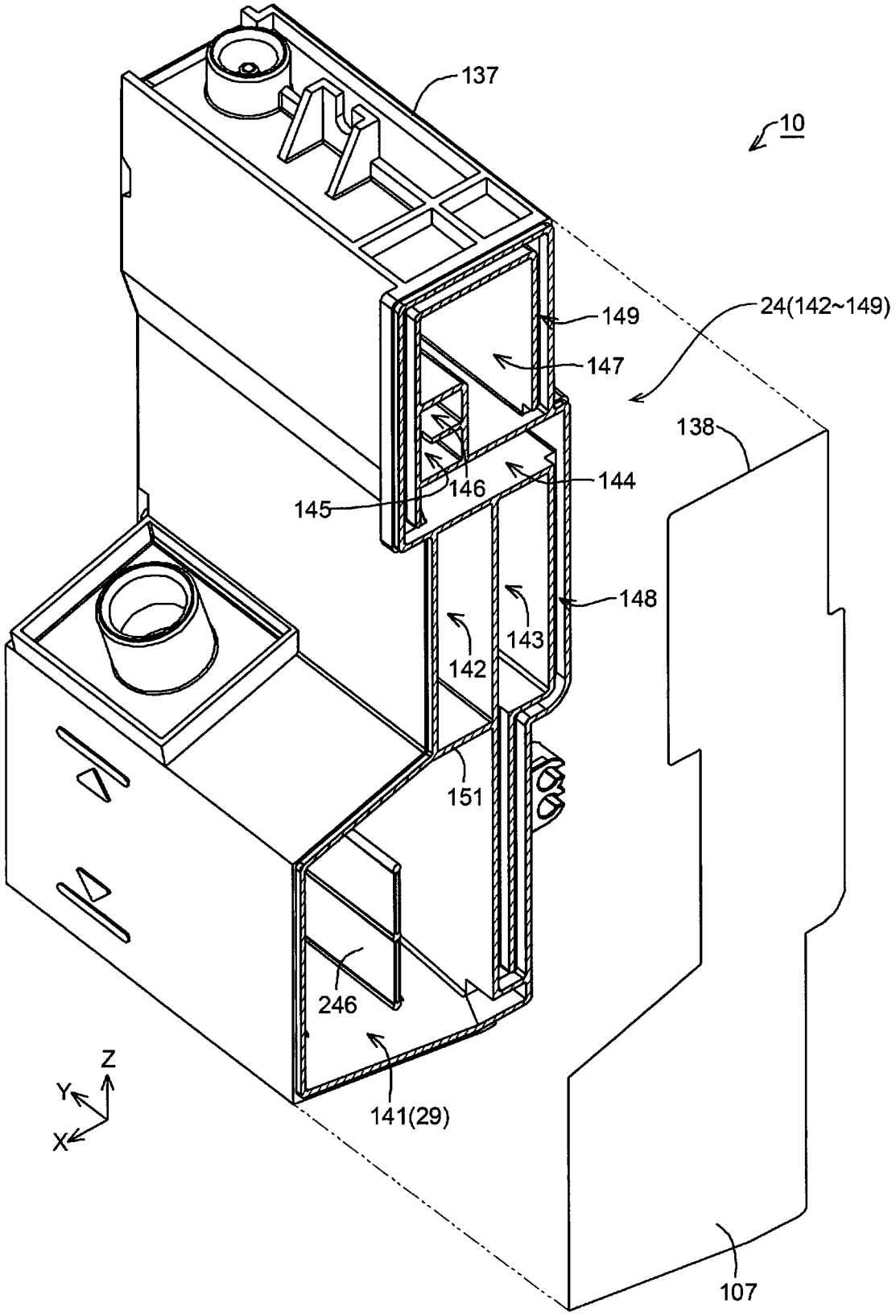
FIG. 15 is an exploded perspective view of the tank according to the first embodiment.

The tank 10 has a case 137 and a sheet member 138 as an example of the film as illustrated in FIG. 15. The case 137 is formed from a synthetic resin such as nylon or polypropylene, for example. The sheet member 138 is made in a film form from a synthetic resin (for example, nylon or polypropylene), and has flexibility. The surface of the sheet member 138 oriented in the −Y-axis direction corresponds to the surface 107 (FIG. 12) of the tank 10.

As illustrated in FIG. 15, the case 137 has a concave portion 141, a concave portion 142, a concave portion 143, a concave portion 144, a concave portion 145, a concave portion 146, a concave portion 147, a concave portion 148, and a concave portion 149. In the case 137, the concave portion 141 to the concave portion 149 are formed to be recessed in the Y-axis direction. In the case 137, the concave portion 141 to the concave portion 149 are opened to the −Y-axis direction. The concave portion 141 to the concave portion 149 are divided from each other by division walls described later. The case 137 also has a joint portion 151. In FIG. 15, the joint portion 151 is hatched for ease of understanding. The joint portion 151 is provided at the ends of the division walls of the concave portion 141 to the concave portion 149 on the −Y-axis direction side.

The sheet member 138 is sized and shaped enough to cover the concave portion 141 to the concave portion 149. The sheet member 138 is joined to the joint portion 151. In the present embodiment, the case 137 and the sheet member 138 are joined together by welding. When the sheet member 138 is joined to the case 137, all the concave portion 141 to the concave portion 149 are blocked by the sheet member 138. The space surrounded by the concave portion 141 and the sheet member 138 constitutes the ink containing part 29. As described above, in the tank 10, the ink containing part 29 contains an ink. The concave portion 142 to the concave portion 149, positioned above the liquid level of the ink contained in the ink containing part 29 and blocked by the sheet member 138, constitute an air containment chamber 24 that is an air containment part divided from the ink containing part 29. In the tank 10, the air containment chamber (air containment part) 24 contains air.

Figure 16:
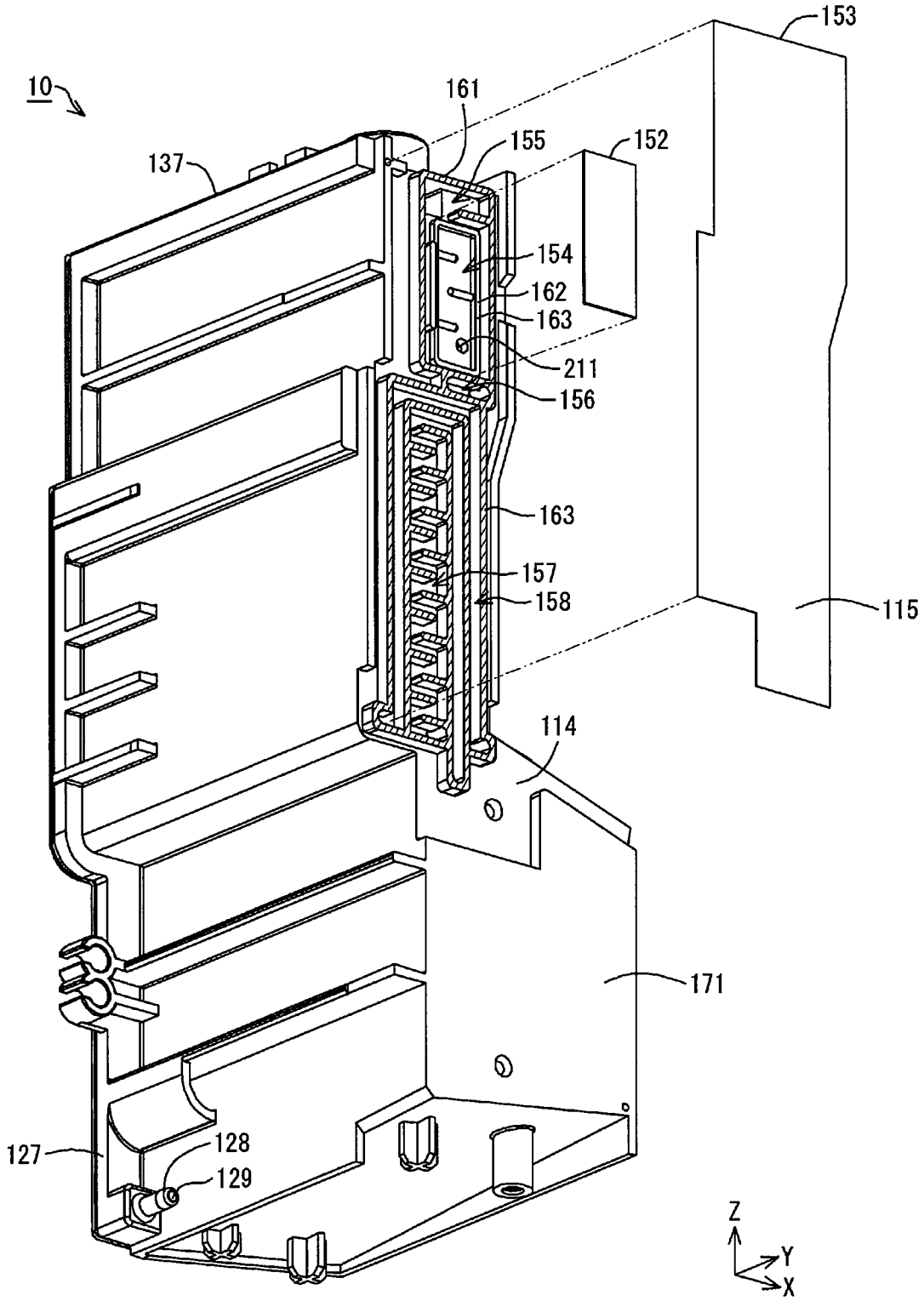
FIG. 16 is an exploded perspective view of the tank according to the first embodiment.

The tank 10 also has a waterproof breathable film 152 and a sheet member 153 as illustrated in FIG. 16. The water-proof breathable film 152 is made in a film form from a material high in liquid resistance, that is, low in liquid permeability, and high in air permeability. The water-proof breathable film 152 is an example of a water-proof breathable member. The sheet member 153 is made in a film form from a synthetic resin (for example, nylon or polypropylene), and has flexibility. In the tank 10, the surface of the sheet member 153 oriented in the Y-axis direction corresponds to the surface 115 (FIG. 13) of the tank 10.

As illustrated in FIG. 16, the case 137 has a concave portion 154, a concave portion 155, a concave portion 156, a concave portion 157, and a concave portion 158. In the case 137, the concave portion 154 to the concave portion 158 are formed to be recessed in the −Y-axis direction. In the case 137, the concave portion 154 to the concave portion 158 are opened to the Y-axis direction. The concave portion 154 is formed inside the concave portion 155. Of the concave portion 154 to the concave portion 158, the concave portion 155 to the concave portion 158 are partitioned from each other by a partition wall 161. The concave portion 154 is partitioned from the concave portion 155 by a partition wall 162.

The partition wall 161 and the partition wall 162 are provided in a bank form on the surface 114. The partition wall 161 and the partition wall 162 protrude from the surface 114 in the Y-axis direction. In the tank 10, the concave portion 155 to the concave portion 158 are formed by the bank-like partition wall 161 protruding from the surface 114 in the Y-axis direction. In the tank 10, the concave portion 154 is formed by the bank-like partition wall 162 protruding from the surface 114 in the Y-axis direction. That is, the concave portion 155 to the concave portion 158 surround the surface 114 as a bottom surface by the partition wall 161. The concave portion 154 surrounds the surface 114 as a bottom surface by the partition wall 162. The partition wall 161 protrudes more greatly than the partition wall 162 in the Y-axis direction. Accordingly, the concave portion 154 falls within the concave portion 155.

The ends of the partition wall 161 and the partition wall 162 on the Y-axis direction side are set as joint portion 163. The water-proof breathable film 152 is sized and shaped enough to cover the concave portion 154 and the partition wall 162. The water-proof breathable film 152 is joined to the joint portion 163 of the partition wall 162. Accordingly, the concave portion 154 is blocked by the water-proof breathable film 152. The sheet member 153 is sized and shaped enough to cover the concave portion 155 to the concave portion 158 and the partition wall 161. The sheet member 153 is joined to the joint portion 163 of the partition wall 161. Accordingly, the concave portion 155 to the concave portion 158 are blocked by the sheet member 153. In the present embodiment, the water-proof breathable film 152 and the sheet member 153 are joined to the joint portion 163 by welding. The concave portion 154 blocked by the water-proof breathable film and the concave portion 155 to the concave portion 158 blocked by the sheet member 153 communicates with each other by a communication hole such as a communication hole 211 via any of the concave portion 142 to the concave portion 149 (see FIG. 15) as described later, and thus act as part of the air containment chamber 24 as an air containment part.

Figure 17:
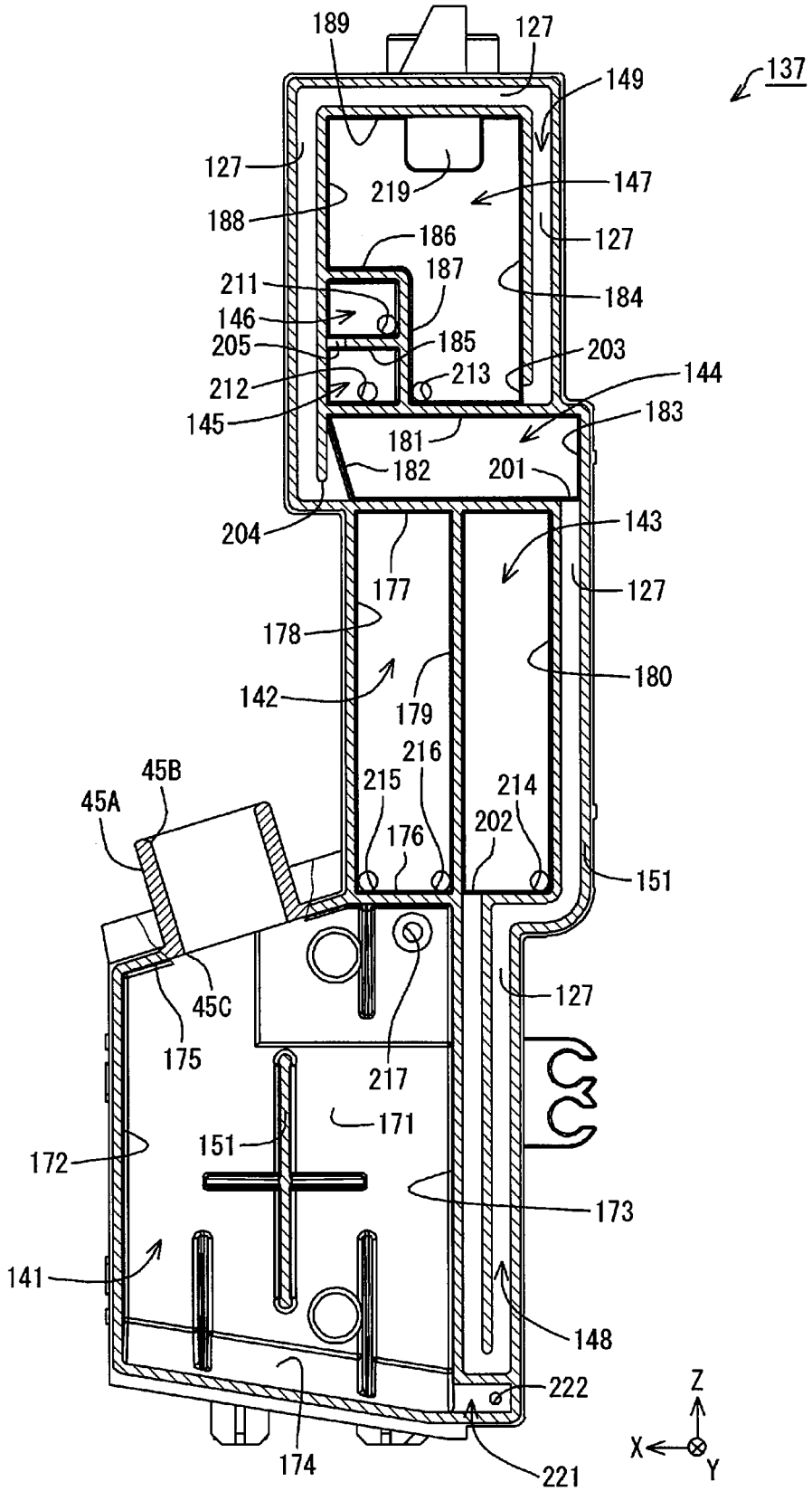
FIG. 17 is a diagram illustrating the outer appearance of a case of the tank according to the first embodiment.

The case 137 has a division wall 171, a division wall 172, a division wall 173, a division wall 174, a division wall 175, and a division wall 176 as illustrated in FIG. 17. The division wall 171 to the division wall 176 partition the concave portion 141. The case 137 has a division wall 177, a division wall 178, a division wall 179, a division wall 180, a division wall 181, a division wall 182, a division wall 183, a division wall 184, a division wall 185, a division wall 186, a division wall 187, a division wall 188, and a division wall 189.

As described above, the space surrounded by the concave portion 141 and the sheet member 138 constitutes the ink containing part 29. The concave portion 141 is partitioned by the division wall 171 to the division wall 176. The concave portion 141 partitioned by the division wall 171 to the division wall 176 is blocked by the sheet member 138 to form the ink containing part 29. Accordingly, the division wall 171 to the division wall 176 and the sheet member 138 can be defined as wall that partitions the ink containing part 29 as an example of the first chamber. The ink containing part 29 is surrounded by the plurality of walls, that is, the division wall 171 to the division wall 176 and the sheet member 138. Of the plurality of walls, that is, the division wall 171 to the division wall 176 and the sheet member 138, the division wall 171 corresponds to a first wall. The sheet member 138 as an example of the film corresponds to the wall opposed to the first wall. Of the plurality of walls, that is, the division wall 171 to the division wall 176 and the sheet member 138, the division wall 172 corresponds to the visual-recognition wall. The surface of the division wall 176 on the concave portion 141 side corresponds to the top surface.

The division wall 171 and the division wall 176 to the division wall 179 partition the concave portion 142. The division wall 171, the division wall 176, the division wall 177, the division wall 179, and the division wall 180 partition the concave portion 143. The division wall 171, the division wall 177, the division wall 181, the division wall 182, and the division wall 183 partition the concave portion 144. The division wall 171, the division wall 181, the division wall 185, the division wall 187, and the division wall 188 partition the concave portion 145. The division wall 171, the division wall 185, the division wall 186, the division wall 187, and the division wall 188 partition the concave portion 146. The division wall 171, the division wall 181, the division wall 184, the division wall 186, the division wall 187, the division wall 188, and the division wall 189 partition the concave portion 147.

The division wall 171 extends along the XZ plane. The surface of the division wall 171 on the Y-axis direction corresponds to the surface 113 and the surface 114 illustrated in FIG. 13. As illustrated in FIG. 17, the division wall 172 to the division wall 176 cross the division wall 171. The division wall 172 to the division wall 176 protrude from the division wall 171 in the −Y-axis direction.

The division wall 172 is positioned at the end of the division wall 171 on the X-axis direction side and extends along the YZ plane. The surface of the division wall 172 opposite to the concave portion 141, that is, the surface of the division wall 172 on the X-axis direction side corresponds to the surface 101 illustrated in FIG. 12. As described above, the surface 101 is set as the visual-recognition surface 46. Accordingly, the ink in the concave portion 141 can be seen through the division wall 172. The division wall 172 is an example of the visual-recognition wall. As illustrated in FIG. 17, the division wall 173 faces the division wall 172 across the concave portion 141. The division wall 173 extends along the YZ plane. The surface of the division wall 173 opposite to the concave portion 141, that is, the surface of the division wall 173 on the −X-axis direction side corresponds to the surface 109 illustrated in FIG. 13.

As illustrated in FIG. 17, the division wall 174 is positioned at the end of the division wall 171 on the −Z-axis direction side. The surface of the division wall 174 opposite to the concave portion 141, that is, the surface of the division wall 174 on the −Z-axis direction side corresponds to the surface 108 illustrated in FIG. 13. The division wall 174 is inclined with respect to the XZ plane. The division wall 174 is inclined with respect to both the XY plane and the YZ plane.

As illustrated in FIG. 17, the division wall 175 is provided on the opposite side of the division wall 174 across the concave portion 141. The division wall 176 is also provided on the opposite side of the division wall 174 across the concave portion 141. The division wall 175 is positioned in the X-axis direction of the division wall 176. The division wall 175 is inclined with respect to both the XY plane and the YZ plane. The division wall 175 is orthogonal to the XZ plane. The division wall 176 extends along the XY plane. The surface of the division wall 175 opposite to the concave portion 141, that is, the surface of the division wall 175 on the Z-axis direction side corresponds to the surface 102 illustrated in FIG. 12.

The surface 102 has the inlet part 45 as described above. That is, the inlet part 45 is provided on the division wall 175. The cylindrical portion 45A of the inlet part 45 is provided on the surface 102 of the division wall 175 and protrudes from the surface 102 to the side opposite to the concave portion 141. The ink introduction port 45B is opened at the upper end of the cylindrical portion 45A on the side opposite to the surface 102. In addition, an ink inlet port 45C is opened at a cross portion between the surface of the division wall 175 opposite to the surface 102, that is, the surface of the division wall 175 on the concave portion 141 side and the cylindrical portion 45A. The ink inlet port 45C is opened to the concave portion 141 on the division wall 175 of the inlet part 45. The ink poured from the ink introduction port 45B flows from the ink inlet port 45C to the concave portion 141 (the ink containing part 29) via the cylindrical portion 45A. The ink inlet port 45C corresponds to the liquid inlet port.

The division wall 172 crosses the division wall 175 at the end along the Z-axis direction. The division wall 172 also crosses the division wall 174 at the end along the −Z-axis direction. The division wall 173 crosses the division wall 176 at the end along the Z-axis direction. The division wall 173 also crosses the division wall 174 at the end along the −Z-axis direction. The division wall 175 crosses the division wall 176 at the end along the −X-axis direction. According to the foregoing configuration, the division wall 172 to the division wall 176 surround part of the division wall 171. This forms the concave portion 141 with the division wall 171 as a bottom portion.

The division wall 177 partitioning the concave portion 142 is provided at a position opposite to the division wall 176 across the concave portion 142, that is, at a position along the Z-axis direction of the division wall 176. The division wall 177 extends along the XY plane. The division wall 178 is located at a position along the X-axis direction of the concave portion 142 and extends along the YZ plane. The surface of the division wall 178 opposite to the concave portion 142, that is, the surface of the division wall 178 on the X-axis direction side corresponds to the surface 103 illustrated in FIG. 12. As illustrated in FIG. 17, the division wall 179 is provided at a position opposite to the division wall 178 across the concave portion 142, that is, at a position along the −X-axis direction of the division wall 178. The division wall 179 extends along the YZ plane.

The division wall 178 crosses the division wall 176 at the end along the −Z-axis direction. The division wall 178 also crosses the division wall 177 at the end along the Z-axis direction. The division wall 179 crosses the division wall 176 at the end along the −Z-axis direction. The division wall 178 also crosses the division wall 177 at the end along the Z-axis direction. According to the foregoing configuration, the division wall 176 to the division wall 179 surround part of the division wall 171. This forms the concave portion 142 with the division wall 171 as a bottom portion. The concave portion 142 is positioned on the Z-axis direction side of the concave portion 141.

The division wall 180 partitioning the concave portion 143 is provided at a position opposite to the division wall 179 across the concave portion 143, that is, at a position along the −X-axis direction of the division wall 179. The division wall 180 extends along the YZ plane. The surface of the division wall 180 opposite to the concave portion 143, that is, the surface of the division wall 180 on the −X-axis direction side corresponds to the surface 111 illustrated in FIG. 13. As illustrated in FIG. 17, the division wall 176 and the division wall 177 cross the division wall 179 in the −X-axis direction from a position along the X-axis direction of the division wall 179, and reach the division wall 180. The division wall 180 crosses the division wall 176 at the end along the −Z-axis direction. The division wall 180 also crosses the division wall 177 at the end along the Z-axis direction.

According to the foregoing configuration, the division wall 176, the division wall 177, the division wall 179, and the division wall 180 surround part of the division wall 171. This forms the concave portion 143 with the division wall 171 as a bottom portion. The concave portion 143 is positioned on the −X-axis direction side of the concave portion 142 across the division wall 179. That is, the concave portion 142 and the concave portion 143 share the division wall 179. The concave portion 142 and the concave portion 143 also share the division wall 176 and the division wall 177. The concave portion 143 is positioned on the Z-axis direction side of the concave portion 141.

The division wall 181 partitioning the concave portion 144 is provided at a position opposite to the division wall 177 across the concave portion 144, that is, at a position along the Z-axis direction of the division wall 177. The division wall 181 extends along the XY plane. The division wall 182 is positioned in the X-axis direction of the concave portion 144. The division wall 182 is inclined with respect to both the XY plane and the YZ plane. The division wall 182 is orthogonal to the XZ plane. The surface of the division wall 182 opposite to the concave portion 144, that is, the surface of the division wall 182 on the X-axis direction side corresponds to the surface 104 illustrated in FIG. 12. As illustrated in FIG. 17, the division wall 183 is positioned in the −X-axis direction of the concave portion 144. The division wall 183 extends along the YZ plane.

According to the foregoing configuration, the division wall 177, the division wall 181, the division wall 182, and the division wall 183 surround part of the division wall 171. This forms the concave portion 144 with the division wall 171 as a bottom portion. The concave portion 144 is positioned on the Z-axis direction side of the concave portion 142 and the concave portion 143 across the division wall 177. That is, the concave portion 142, the concave portion 143, and the concave portion 144 share the division wall 177.

The division wall 185 partitioning the concave portion 145 is provided at a position opposite to the division wall 181 across the concave portion 145, that is, at a position along the Z-axis direction of the division wall 181. The division wall 185 extends along the XY plane. The division wall 188 is located at a position along the X-axis direction of the concave portion 145 and extends along the YZ plane. The division wall 188 extends from the division wall 181 beyond the division wall 185 in the Z-axis direction. The surface of the division wall 188 opposite to the concave portion 145, that is, the surface of the division wall 188 on the X-axis direction side corresponds to the surface 105 illustrated in FIG. 12. As illustrated in FIG. 17, the division wall 187 is provided at a position opposite to the division wall 188 across the concave portion 145, that is, at a position along the −X-axis direction of the division wall 188. The division wall 187 extends along the YZ plane. The division wall 187 extends from the division wall 181 beyond the division wall 185 in the Z-axis direction.

The division wall 185 crosses the division wall 188 at the end along the X-axis direction. The division wall 185 also crosses the division wall 187 at the end along the −X-axis direction. The division wall 187 crosses the division wall 181 at the end along the −Z-axis direction. The division wall 181 crosses the division wall 188 at the end along the X-axis direction. According to the foregoing configuration, the division wall 181, the division wall 185, the division wall 187, and the division wall 188 surround part of the division wall 171. This forms the concave portion 145 with the division wall 171 as a bottom portion. The concave portion 145 is positioned on the Z-axis direction side of the concave portion 144.

The division wall 186 partitioning the concave portion 146 is provided at a position opposite to the division wall 185 across the concave portion 146, that is, at a position along the Z-axis direction of the division wall 185. The division wall 186 extends along the XY plane. The division wall 187 extends from the division wall 181 beyond the division wall 185 in the Z-axis direction and reaches the division wall 186. The division wall 186 crosses the division wall 188 at the end along the X-axis direction. The division wall 186 also crosses the division wall 187 at the end along the −X-axis direction. According to the foregoing configuration, the division wall 185, the division wall 186, the division wall 187, and the division wall 188 surround part of the division wall 171. This forms the concave portion 146 with the division wall 171 as a bottom portion. The concave portion 146 is positioned on the Z-axis direction side of the concave portion 145 across the division wall 185. That is, the concave portion 145 and the concave portion 146 share the division wall 185. The concave portion 145 and the concave portion 146 also share the division wall 188 and the division wall 187.

The division wall 189 partitioning the concave portion 147 is provided at a position opposite to the division wall 181 across the concave portion 147, that is, at a position along the Z-axis direction of the division wall 181. The division wall 189 is positioned in the Z-axis direction of the concave portion 145 and the concave portion 146. That is, the division wall 189 is positioned in the Z-axis direction of the division wall 186. The division wall 189 extends along the XY plane. The surface of the division wall 189 opposite to the concave portion 147, that is, the surface of the division wall 189 on the Z-axis direction side corresponds to the surface 106 illustrated in FIG. 12. As illustrated in FIG. 17, the division wall 184 is located at a position along the −X-axis direction of the concave portion 147 and extends along the YZ plane. The surface of the division wall 184 opposite to the concave portion 147, that is, the surface of the division wall 184 on the −X-axis direction side corresponds to the surface 112 illustrated in FIG. 13.

The division wall 184 crosses the division wall 181 at the end along the −Z-axis direction. The division wall 184 also crosses the division wall 189 at the end along the Z-axis direction. The division wall 189 crosses the division wall 188 at the end along the X-axis direction. According to the foregoing configuration, the division wall 181, the division wall 187, the division wall 186, the division wall 188, the division wall 189, and the division wall 184 surround part of the division wall 171. This forms the concave portion 147 with the division wall 171 as a bottom portion. The concave portion 147 is positioned on the Z-axis direction side of the concave portion 144. As illustrated in FIG. 17, the concave portion 145 and the concave portion 146 are surrounded by the division wall 181, the division wall 188, the division wall 189, and the division wall 184. Accordingly, it can be said that the concave portion 145 and the concave portion 146 are positioned within the concave portion 147.

The concave portion 148 and the concave portion 149 are provided in the overhang part 127. As illustrated in FIG. 17, the concave portion 148 and the concave portion 149 are positioned outside the concave portion 141 to the concave portion 147 when the case 137 is seen in the Y-axis direction. The concave portion 148 and the concave portion 149 are provided in a groove form in the overhang part 127.

The concave portion 148 is divided from the concave portion 143 by the division wall 180 and the division wall 176. The concave portion 148 is also divided from the concave portion 141 by the division wall 173. The concave portion 148 is connected to the concave portion 144 at a portion crossing the division wall 177. Specifically, the concave portion 148 is connected to the concave portion 144 at the portion crossing the division wall 177 by a connecting portion 201 that is opened to the inside of the concave portion 144.

The concave portion 148 extends in the −Z-axis direction from the connecting portion 201 along the division wall 180, turns at the crossing portion between the division wall 180 and the division wall 176, and extends in the X-axis direction along the division wall 176. The concave portion 148 turns in front of the division wall 173 and extends in the −Z-axis direction, then further turns in the Z-axis direction and extends in the Z-axis direction along the division wall 173. The concave portion 148 crosses the division wall 176 and is connected to the concave portion 143. Specifically, the concave portion 148 is connected to the concave portion 143 at the portion crossing the division wall 176 by a connecting portion 202 that is opened to the inside of the concave portion 143.

The concave portion 148 connects to the concave portion 144 at the connecting portion 201, and connects to the concave portion 143 at the connecting portion 202. Accordingly, the concave portion 144 and the concave portion 143 connect to each other via the concave portion 148.

As illustrated in FIG. 17, the concave portion 149 is positioned outside the concave portion 147 when the case 137 is seen in the Y-axis direction. The concave portion 149 is divided from the concave portion 147 by the division wall 184, the division wall 189, and the division wall 188. The concave portion 149 is also divided from the concave portion 145 and the concave portion 146 by the division wall 188.

The concave portion 149 is connected to the concave portion 147 at a crossing portion between the division wall 184 and the division wall 181. The concave portion 149 is connected to the concave portion 147 at a portion of the division wall 184 crossing the division wall 181 by a connecting portion 203 that is opened to the inside of the concave portion 147. The concave portion 149 extends in the Z-axis direction from the connecting portion 203 along the division wall 184, turns at a crossing portion between the division wall 184 and the division wall 189, and extends in the X-axis direction along the division wall 189.

The concave portion 149 turns at a crossing portion between the division wall 189 and the division wall 188, extends in the −Z-axis direction along the division wall 188, and is connected to the concave portion 144 at a crossing portion between the division wall 188 and the division wall 177. That is, the concave portion 149 is connected to the concave portion 144 at a portion of the division wall 188 crossing the division wall 177 by a connecting portion 204 that is opened to the inside of the concave portion 144. The concave portion 149 connects to the concave portion 147 at the connecting portion 203, and connects to the concave portion 144 at the connecting portion 204. Accordingly, the concave portion 144 and the concave portion 147 connect to each other via the concave portion 149.

According to the foregoing configuration, the concave portion 147 and the concave portion 143 connect to each other via the concave portion 149, the concave portion 144, and the concave portion 148. In addition, the concave portion 145 and the concave portion 146 connect to each other via a cut portion 205 in the division wall 185.

The concave portion 154, the concave portion 155, and the concave portion 156 illustrated in FIG. 16 described above are provided in a region of the division wall 171 illustrated in FIG. 17 opposite to the concave portion 145, the concave portion 146, and the concave portion 147. That is, the concave portion 154, the concave portion 155, and the concave portion 156 illustrated in FIG. 16 are provided in the region overlapping the concave portion 145, the concave portion 146, and the concave portion 147 across the division wall 171 illustrated in FIG. 17.

As illustrated in FIG. 17, the division wall 171 has a communication hole 211, a communication hole 212, a communication hole 213, a communication hole 214, a communication hole 215, a communication hole 216, and a communication hole 217. The communication hole 211 is provided in the concave portion 146. The communication hole 212 is provided in the concave portion 145. The communication hole 213 is provided in the concave portion 147. The communication hole 214 is provided in the concave portion 143. The communication hole 215 and the communication hole 216 are provided in the concave portion 142. The communication hole 217 is provided in the concave portion 141. The communication hole 211 to the communication hole 217 penetrate through the division wall 171.

Figure 18:
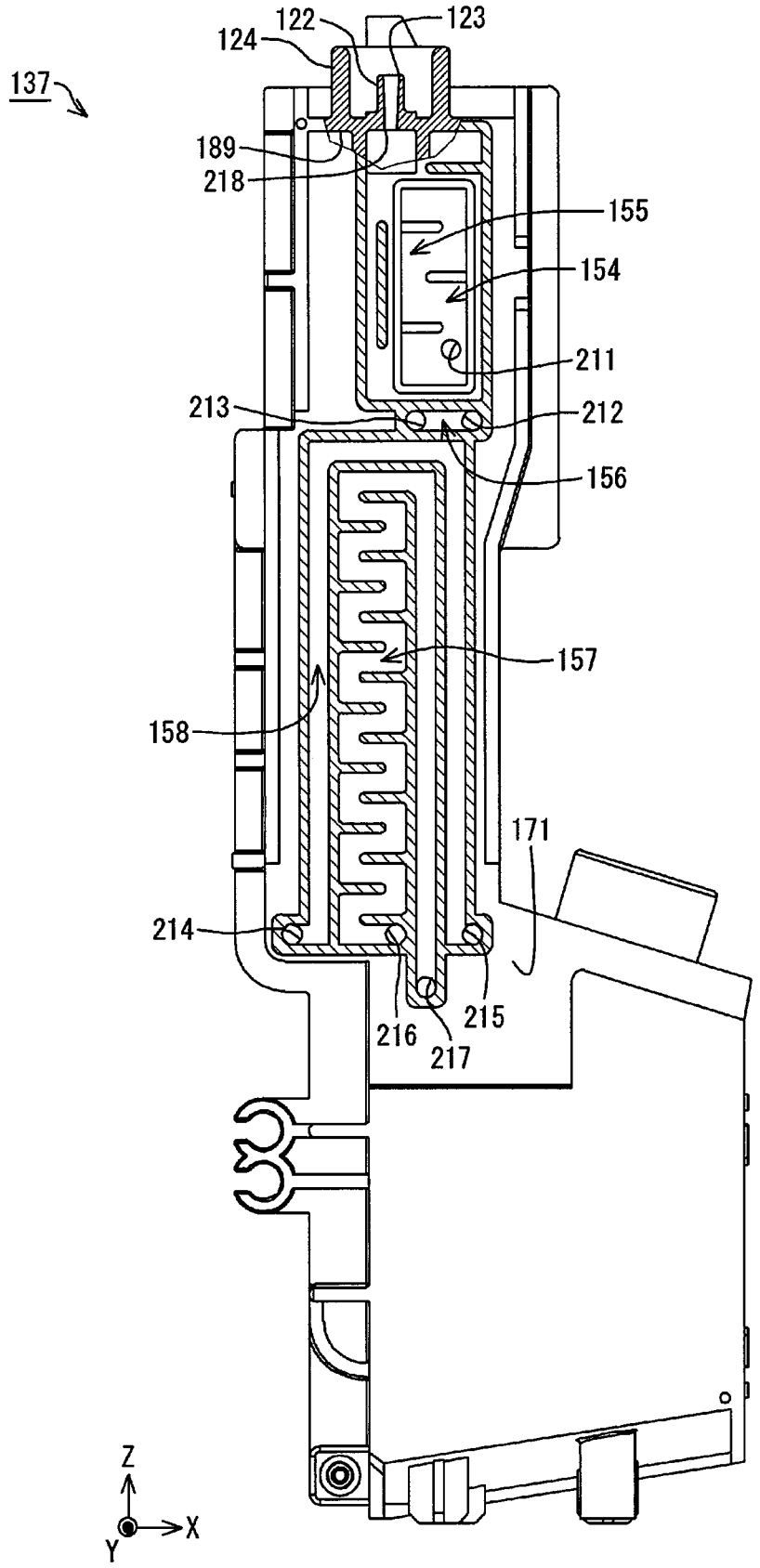
FIG. 18 is a diagram illustrating the outer appearance of the case of the tank according to the first embodiment.

The communication hole 211 in the concave portion 146 penetrates through the division wall 171 and communicates with the concave portion 154 as illustrated in FIG. 18. The division wall 189 has a communication port 218 communicating with the air opening port 123. The communication port 218 is an opening portion that is opened to a portion of the division wall 189 crossing the air release part 122. The communication port 218 is opened toward the inside of the concave portion 155. The division wall 189 is shared between the concave portion 155 and the concave portion 147 illustrated in FIG. 17. The concave portion 147 and the concave portion 155 are divided by the division wall 219 protruding to the inside of the concave portion 147. The concave portion 155 communicates with the concave portion 154 via the water-proof breathable film 152 as illustrated in FIG. 16.

The concave portion 154 communicates with the concave portion 146 illustrated in FIG. 17 via the communication hole 211. The communication hole 212 in the concave portion 145 communicates with the concave portion 156 as illustrated in FIG. 18. The communication hole 213 also communicates with the concave portion 156. That is, the communication hole 212 communicates with the concave portion 147 illustrated in FIG. 17 via the concave portion 156 and the communication hole 213. The communication hole 214 in the concave portion 143 communicates with the concave portion 158 as illustrated in FIG. 18.

The communication hole 215 also communicates with the concave portion 158. That is, the communication hole 214 communicates with the concave portion 142 illustrated in FIG. 17 via the concave portion 158 and the communication hole 215. The communication hole 216 also communicates with the concave portion 142. The communication hole 216 communicates with the concave portion 157 as illustrated in FIG. 18. The concave portion 157 communicates with the concave portion 141 illustrated in FIG. 17 via the communication hole 217.

A concave portion 221 is provided on the −X-axis direction side of the concave portion 141 and on the −Z-axis direction side of the concave portion 148. The concave portion 221 is connected to the concave portion 141 at a portion of the division wall 173 crossing the division wall 174. The concave portion 221 has a communication port 222. The communication port 222 communicates with the ink supply port 129 via the ink supply part 128 illustrated in FIG. 13.

Figure 19:
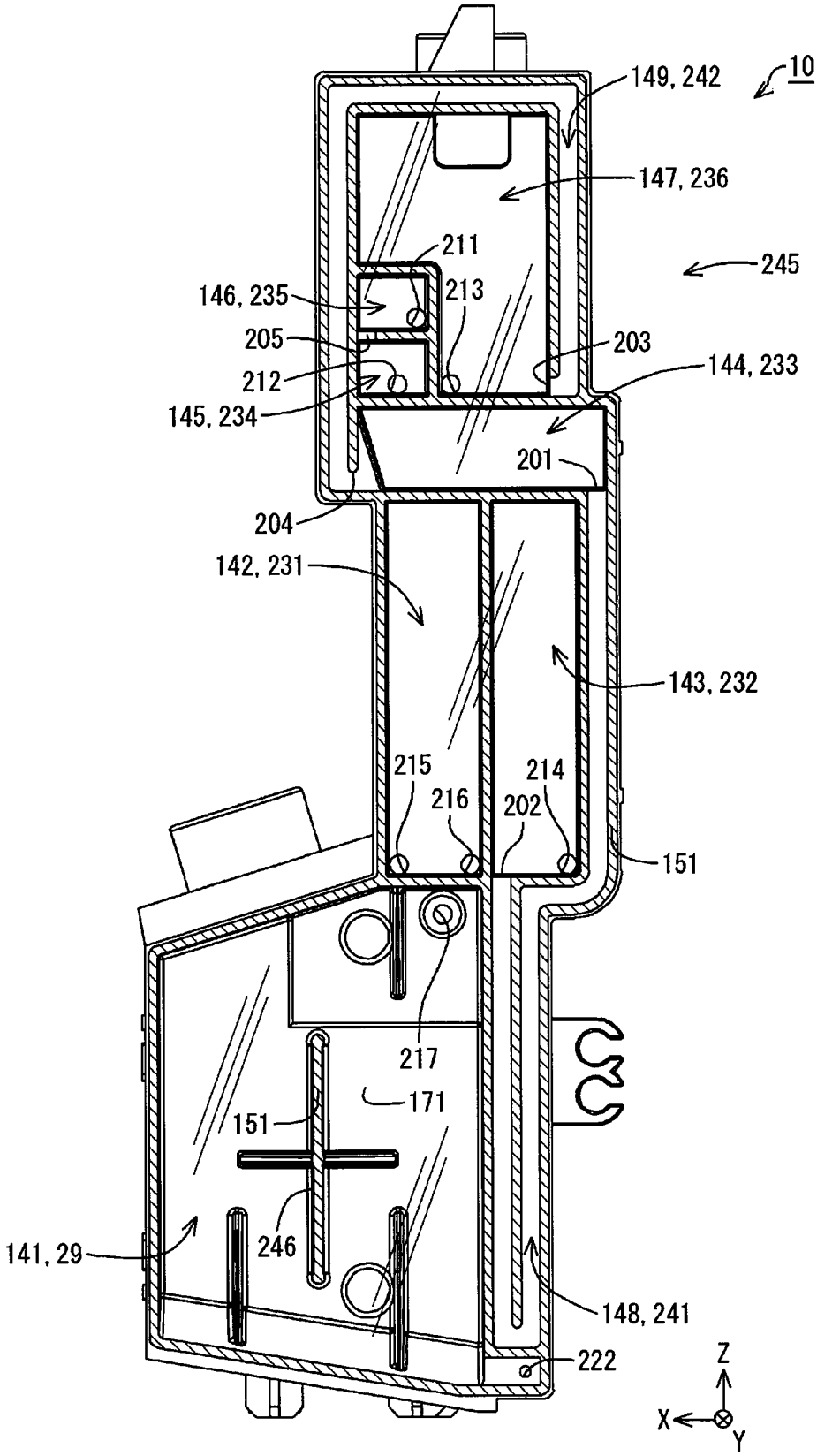
FIG. 19 is a diagram illustrating the outer appearance of the tank according to the first embodiment.

When the sheet member 138 is joined to the case 137 configured as described above, the concave portion 141 forms the ink containing part 29 as illustrated in FIG. 19. In addition, the concave portion 142 forms a buffer chamber 231, the concave portion 143 forms a buffer chamber 232, the concave portion 144 forms a buffer chamber 233, the concave portion 145 forms a buffer chamber 234, the concave portion 146 forms a buffer chamber 235, and the concave portion 147 forms a buffer chamber 236.

The concave portion 148 forms a communication path 241, the concave portion 149 forms a communication path 242, and the cut portion 205 forms a communication path 243. The buffer chamber 231 to the buffer chamber 236, and the communication path 241 to the communication path 243 form part of an air communication path 245. FIG. 19 illustrates the case 137 as seen through the sheet member 138 for ease of understanding. In FIG. 19, the joint portion 151 is hatched.

In this example, the ink containing part 29 has a support portion 246 therein as illustrated in FIG. 19. The support portion 246 is provided on the division wall 171. The support portion 246 protrudes from the division wall 171 in the −Y-axis direction. The support portion 246 is separated from the division wall 172, the division wall 173, the division wall 174, the division wall 175, and the division wall 176. The support portion 246 has a plate-like outer shape extending along the YZ plane. The amount of protrusion of the support portion 246 from the division wall 171 is set to be equal to the amount of protrusion of the division wall 172 to the division wall 176 from the division wall 171. The joint portion 151 is provided at the end of the support portion 246 on the side opposite to the division wall 171, that is, along the −Y-axis direction. That is, in the tank 10, the sheet member 138 is also joined to the joint portion 151 in the support portion 246. According to this configuration, the deformation of the sheet member 138 can be controlled by the support portion 246.

Figure 20:
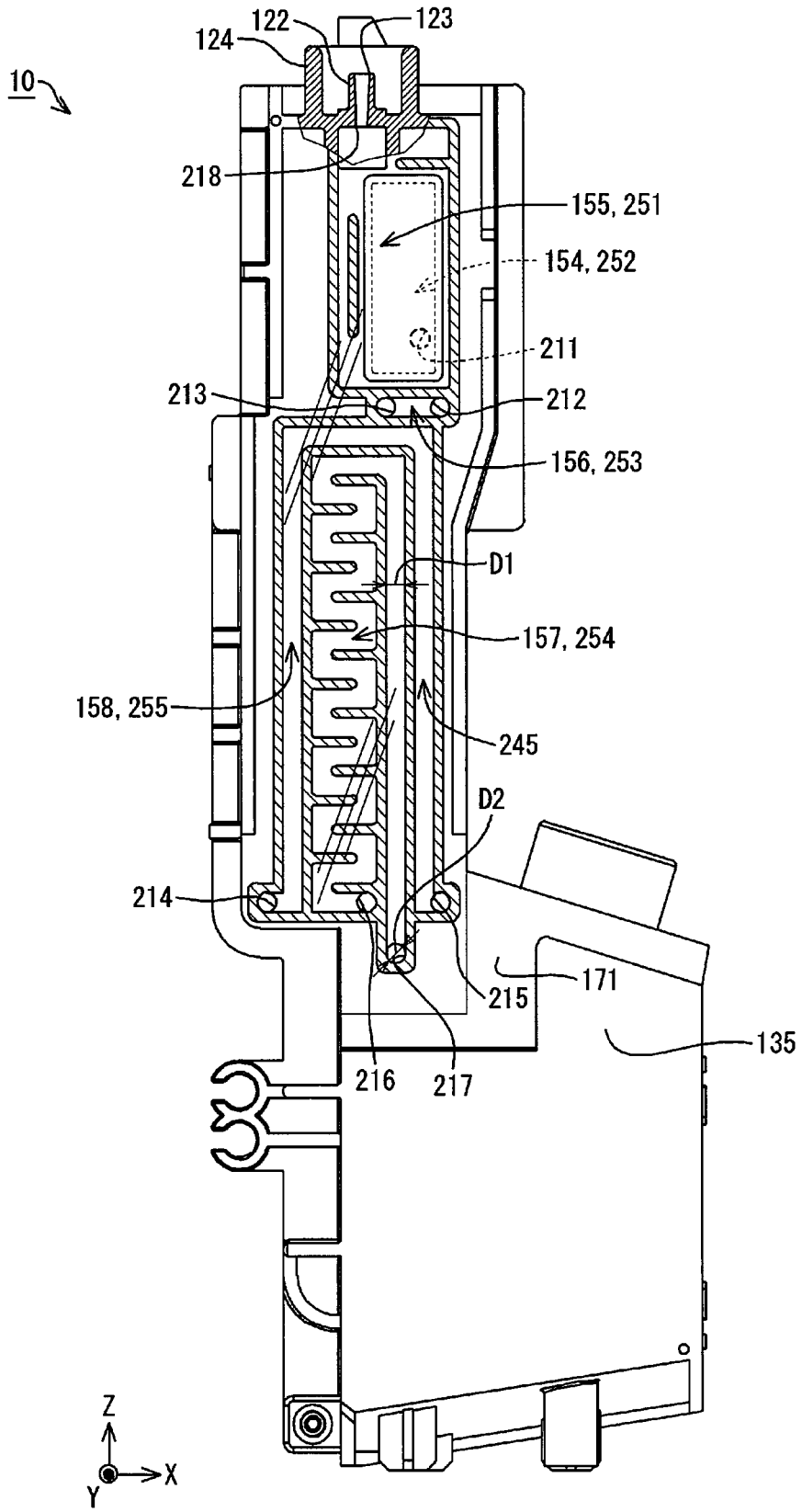
FIG. 20 is a diagram illustrating the outer appearance of the tank according to the first embodiment.

When the waterproof breathable film 152 (FIG. 16) and the sheet member 153 are joined to the case 137, part of the air communication path 245 is formed on the Y-axis direction side of the division wall 171, that is, on the front surface 135 of the tank 10, as illustrated in FIG. 20. Part of the air communication path 245 formed on the front surface 135 of the tank 10 is a region surrounded by the concave portion 155, the concave portion 156, the concave portion 157, the concave portion 158, and the sheet member 153. In addition, part of the air communication path 245 formed on the front surface 135 of the tank 10 also includes a region surrounded by the concave portion 154 (FIG. 16) and the water-proof breathable film 152. The air communication path 245 also includes the air release part 122.

Accordingly, in the tank 10, the air communication path 245 is formed ranging from the air opening port 123 to the communication hole 217 in the ink containing parts 29 illustrated in FIG. 19. The air communication path 245 allows the air opening port 123 and the communication hole 217 to communicate each other. Accordingly, the tank 10 is configured to introduce the air from the air communication path 245 into the ink containing part 29. That is, the air communication path 245 communicates with the ink containing part 29. Accordingly, the tank 10 has a flow path from the air opening port 123 through the ink containing part 29 to the ink supply port 129 (FIG. 13). Part of the flow path includes the air communication path 245.

When the water-proof breathable film 152 and the sheet member 153 are joined to the case 137, the region surrounded by the concave portion 155 and the sheet member 153 is formed as a buffer chamber 251 as illustrated in FIG. 20. The region surrounded by the concave portion 154 and the waterproof breathable film 152 is formed as a buffer chamber 252. The region surrounded by the concave portion 156 and the sheet member 153 is formed as a communication path 253, the region surrounded by the concave portion 157 and the sheet member 153 is formed as a communication path 254, and the region surrounded by the concave portion 158 and the sheet member 153 is formed as a communication path 255. Accordingly, the air communication path 245 includes the air release part 122, the buffer chamber 251, and the communication path 253 to the communication path 255.

The communication path 253 is positioned along the −Z-axis direction of the buffer chamber 251 and extends along the X axis. The communication path 253 allows the communication hole 212 and the communication hole 213 to communicate with each other. The communication path 255 is positioned along the −Z-axis direction of the communication path 253 and allows the communication hole 214 and the communication hole 215 to communicate each other. The communication hole 214 and the communication hole 215 are positioned along the −Z-axis direction of the communication path 253. The communication hole 214 is positioned along the −X-axis direction of the communication hole 215. The communication path 255 extends from the communication hole 214 in the Z-axis direction, then turns at a position along the −Z-axis direction of the communication path 253, and extends in the X-axis direction. The communication path 255 then turns at a position along the −X-axis direction of the communication hole 212, extends in the −Z-axis direction, and then reaches the communication hole 215.

The communication path 254 is positioned along the −Z-axis direction of the communication path 253 and allows the communication hole 216 and the communication hole 217 to communicate with each other. The communication hole 216 and the communication hole 217 are positioned along the −Z-axis direction of the communication path 253. The communication hole 216 and the communication hole 217 are positioned along the −X-axis direction of the communication hole 215 and are positioned along the X-axis direction of the communication hole 214. The communication path 254 extends in the Z-axis direction while meandering from the communication hole 216. The communication path 254 then turns at a position along the −Z-axis direction of the communication path 253, extends in the −Z-axis direction, and then reaches the communication hole 217. As illustrated in FIG. 20, the communication path 255 circles around the outside of the communication path 254. In the tank 10, it is possible to suppress evaporation of the liquid component of the ink in the ink containing part 29 (FIG. 19) by the meandering communication path 254.

Figure 21:
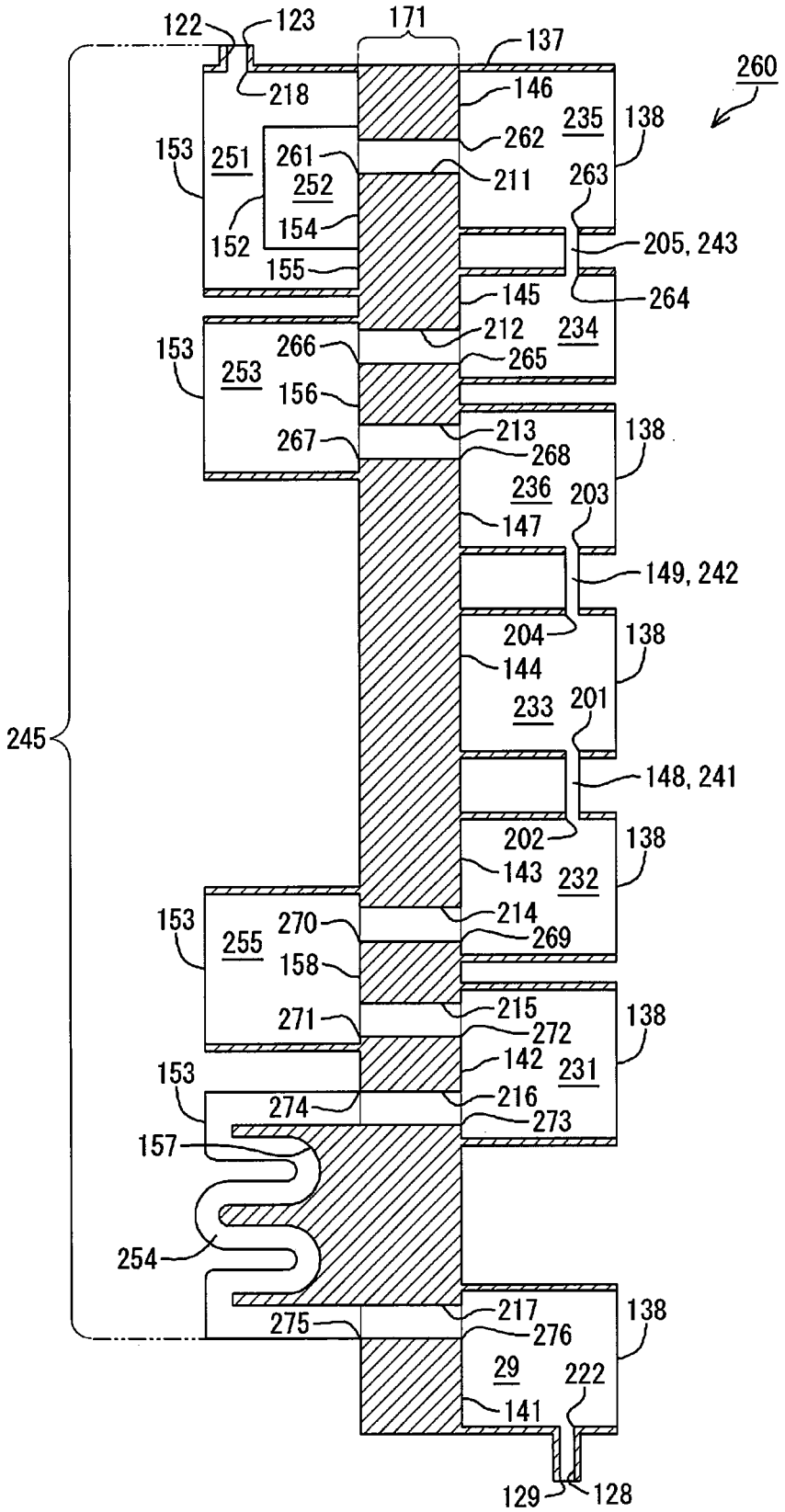
FIG. 21 is a diagram schematically illustrating a flow path in the tank according to the first embodiment.

The flow path from the air opening port 123 to the ink supply port 129 will be described with reference to the schematic diagram. For ease of understanding, the flow path from the air opening port 123 to the ink supply port 129 will be described here in a schematic manner. The direction tending from the air opening port 123 to the ink supply port 129 is regarded as flowing direction of a fluid. The "upstream" and "downstream" sides are determined with reference to the foregoing flowing direction. Specifically, the air opening port 123 is located on the upstream side of the ink supply port 129, and the ink supply port 129 is located on the downstream side of the air opening port 123. A flow path 260 tending from the air opening port 123 to the ink supply port 129 includes the air communication path 245, the ink containing part 29, and the ink supply part 128 as illustrated in FIG. 21.

The buffer chamber 251 is provided on the downstream side of the air release part 122. The opening in the air release part 122 on the buffer chamber 251 side constitutes the communication port 218. The buffer chamber 251 has a region surrounded by the concave portion 155 and the sheet member 153 of the case 137. The buffer chamber 252 is provided on the downstream side of the buffer chamber 251. The buffer chamber 252 has a region surrounded by the concave portion 154 and the water-proof breathable film 152. The buffer chamber 252 is positioned in the buffer chamber 251. The air is movable between the buffer chamber 251 and the buffer chamber 252 via the waterproof breathable film 152.

The buffer chamber 235 is provided on the downstream side of the buffer chamber 252. The buffer chamber 235 has a region surrounded by the concave portion 146 and the sheet member 138 of the case 137. The buffer chamber 252 and the buffer chamber 235 communicate with each other via the communication hole 211 penetrating though the division wall 171 of the case 137. The opening in the communication hole 211 on the buffer chamber 252 side is described as communication port 261. The communication port 261 corresponds to the connection port between the buffer chamber 252 and the communication hole 211. The opening in the communication hole 211 on the buffer chamber 235 side is described as communication port 262. The communication port 262 corresponds to the connection port between the buffer chamber 235 and the communication hole 211.

The buffer chamber 234 is provided on the downstream side of the buffer chamber 235. The buffer chamber 234 has a region surrounded by the concave portion 145 and the sheet member 138 of the case 137. The buffer chamber 235 and the buffer chamber 234 communicate with each other via the communication path 243 of the case 137. The communication path 243 has a region surrounded by the cut portion 205 formed on the division wall 185 (FIG. 17) and the sheet member 138. The opening in the communication path 243 on the buffer chamber 235 side is described as communication port 263. The communication port 263 corresponds to the connection port between the buffer chamber 235 and the communication path 243. The opening in the communication path 243 on the buffer chamber 234 side is described as communication port 264. The communication port 264 corresponds to the connection port between the buffer chamber 234 and the communication path 243.

The communication path 253 is provided on the downstream side of the buffer chamber 234. The communication path 253 has a region surrounded by the concave portion 156 and the sheet member 153 of the case 137. The buffer chamber 234 and the communication path 253 communicate with each other via the communication hole 212 penetrating though the division wall 171 of the case 137. The opening in the communication hole 212 on the buffer chamber 234 side is described as communication port 265. The communication port 265 corresponds to the connection port between the buffer chamber 234 and the communication hole 212. The opening in the communication hole 212 on the communication path 253 side is described as communication port 266. The communication port 266 corresponds to the connection port between the communication path 253 and the communication hole 212.

The buffer chamber 236 is provided on the downstream side of the communication path 253. The buffer chamber 236 has a region surrounded by the concave portion 147 and the sheet member 138 of the case 137. The communication path 253 and the buffer chamber 236 communicate with each other via the communication hole 213 penetrating though the division wall 171 of the case 137. The opening in the communication hole 213 on the communication path 253 side is described as communication port 267. The communication port 267 corresponds to the connection port between the communication path 253 and the communication hole 213. The opening in the communication hole 213 on the buffer chamber 236 side is described as communication port 268. The communication port 268 corresponds to the connection port between the buffer chamber 236 and the communication hole 213.

The buffer chamber 233 is provided on the downstream side of the buffer chamber 236. The buffer chamber 233 has a region surrounded by the concave portion 144 and the sheet member 138 of the case 137. The buffer chamber 236 and the buffer chamber 233 communicate with each other via the communication path 242 of the case 137. The communication path 242 has a region surrounded by the concave portion 149 (FIG. 17) and the sheet member 138 of the case 137. The opening in the communication path 242 on the buffer chamber 236 side constitutes the connecting portion 203. The opening in the communication path 242 on the buffer chamber 233 side constitutes the connecting portion 204.

The buffer chamber 232 is provided on the downstream side of the buffer chamber 233. The buffer chamber 232 has a region surrounded by the concave portion 143 and the sheet member 138 of the case 137. The buffer chamber 233 and the buffer chamber 232 communicate with each other via the communication path 241 of the case 137. The communication path 241 has a region surrounded by the concave portion 148 (FIG. 17) and the sheet member 138 of the case 137. The opening in the communication path 241 on the buffer chamber 233 side constitutes the connecting portion 201. The opening in the communication path 241 on the buffer chamber 232 side constitutes the connecting portion 202.

The communication path 255 is provided on the downstream side of the buffer chamber 232. The communication path 255 has a region surrounded by the concave portion 158 and the sheet member 153 of the case 137. The buffer chamber 232 and the communication path 255 communicate with each other via the communication hole 214 penetrating though the division wall 171 of the case 137. The opening in the communication hole 214 on the buffer chamber 232 side is described as communication port 269. The communication port 269 corresponds to the connection port between the buffer chamber 232 and the communication hole 214. The opening in the communication hole 214 on the communication path 255 side is described as communication port 270. The communication port 270 corresponds to the connection port between the communication path 255 and the communication hole 214.

The buffer chamber 231 is provided on the downstream side of the communication path 255. The buffer chamber 231 has a region surrounded by the concave portion 142 and the sheet member 138 of the case 137. The communication path 255 and the buffer chamber 231 communicate with each other via the communication hole 215 penetrating though the division wall 171 of the case 137. The opening in the communication hole 215 on the communication path 255 side is described as communication port 271. The communication port 271 corresponds to the connection port between the communication path 255 and the communication hole 215. The opening in the communication hole 215 on the buffer chamber 231 side is described as communication port 272. The communication port 272 corresponds to the connection port between the buffer chamber 231 and the communication hole 215.

The communication path 254 is provided on the downstream side of the buffer chamber 231. The communication path 254 has a region surrounded by the concave portion 157 (FIG. 18) and the sheet member 153 of the case 137. The buffer chamber 231 and the communication path 254 communicate with each other via the communication hole 216 penetrating though the division wall 171. The opening in the communication hole 216 on the buffer chamber 231 side is described as communication port 273. The communication port 273 corresponds to the connection port between the buffer chamber 231 and the communication hole 216. The opening in the communication hole 216 on the communication path 254 side is described as communication port 274. The communication port 274 corresponds to the connection port between the communication path 254 and the communication hole 216.

The ink containing part 29 is provided on the downstream side of the communication path 254. The ink containing part 29 has a region surrounded by the concave portion 141 and the sheet member 138 of the case 137. The communication path 254 and the ink containing part 29 communicate with each other via the communication hole 217 penetrating though the division wall 171. The opening in the communication hole 217 on the communication path 254 side is described as communication port 275. The communication port 275 corresponds to the connection port between the communication path 254 and the communication hole 217. The opening in the communication hole 217 on the ink containing part 29 side is described as communication port 276. The communication port 276 corresponds to the connection port between the ink containing part 29 and the communication hole 217. The communication port 276 corresponds to an air lead-in port. Accordingly, the air communication path 245 allows the air opening port 123 and the communication port 276 to communicate with each other.

The ink supply part 128 is provided on the downstream side of the ink containing part 29. The opening in the ink supply part 128 on the ink containing part 29 side is the communication port 222. The communication port 222 corresponds to the connection port between the ink containing part 29 and the ink supply part 128. The opening in the ink supply part 128 on the side opposite to the ink containing part 29 is the ink supply port 129. In the tank 10, the flow path 260 from the air opening port 123 to the ink supply port 129 is configured as described above.

When the ink in the ink containing part 29 is supplied to the print part 42 (FIG. 3) via the ink supply port 129, the amount of the ink in the ink containing part 29 decreases. When the amount of the ink in the ink containing part 29 decreases, the pressure in the ink containing part 29 becomes likely to be lower than the atmospheric pressure. In the present example, the ink containing part 29 communicates with the air communication path 245 from the air opening port 123 to the communication hole 217. Accordingly, when the amount of the ink in the ink containing part 29 decreases and the pressure in the ink containing part 29 becomes lower than the atmospheric pressure, the air can be introduced into the ink containing part 29 via the air communication path 245. As a result, the pressure in the ink containing part 29 is likely to be kept at the atmospheric pressure.

At this time, the air introduced into the ink containing part 29 flows from the air opening port 123 into the buffer chamber 251 via the air release part 122. The air having flown into the buffer chamber 251 then flows into the buffer chamber 252 through the water-proof breathable film 152. The air having flown into the buffer chamber 252 then flows from the communication port 261 into the buffer chamber 235 through the communication port 262 of the communication hole 211. The air having flown into the buffer chamber 235 then flows from the communication port 263 into the buffer chamber 234 through the communication port 264 of the communication path 243.

The air having flown into the buffer chamber 234 then flows from the communication port 265 into the communication path 253 through the communication port 266 of the communication hole 212. The air having flown into the communication path 253 then flows from the communication port 267 into the buffer chamber 236 through the communication port 268 of the communication hole 213. The air having flown into the buffer chamber 236 then flows from the connecting portion 203 into the buffer chamber 233 through the connecting portion 204 of the communication path 242. The air having flown into the buffer chamber 233 then flows from the connecting portion 201 into the buffer chamber 232 through the connecting portion 202 of the communication path 241.

The air having flown into the buffer chamber 232 then flows from the communication port 269 into the communication path 255 through the communication port 270 of the communication hole 214. The air having flown into the communication path 255 then flows from the communication port 271 into the buffer chamber 231 through the communication port 272 of the communication hole 215. The air having flown into the buffer chamber 231 then flows from the communication port 273 into the communication path 254 through the communication port 274 of the communication hole 216. The air having flown into the communication path 254 then flows from the communication port 275 into the ink containing part 29 through the communication port 276 of the communication hole 217.

Figure 22:
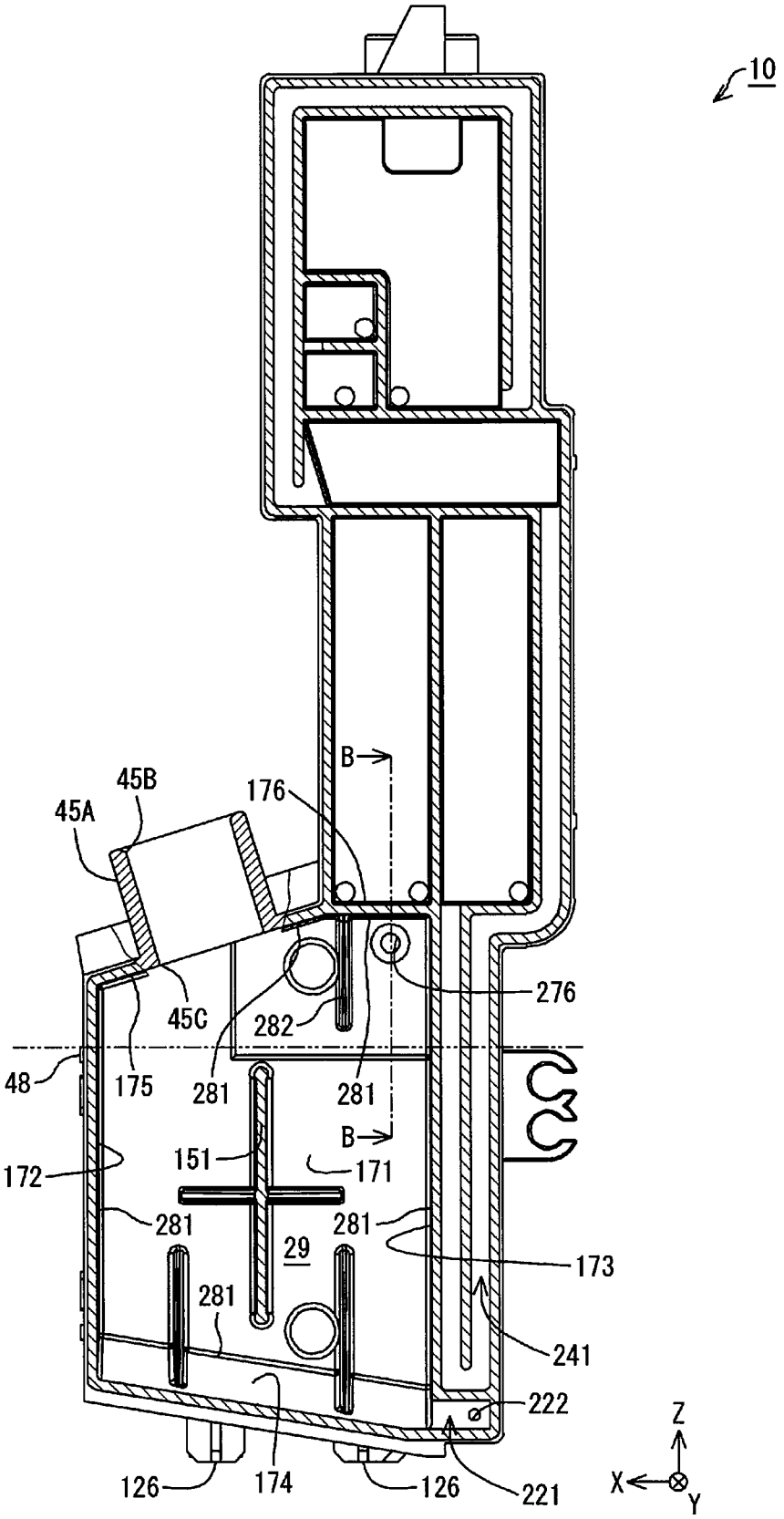
FIG. 22 is a diagram illustrating the outer appearance of the tank according to the first embodiment.

In the tank 10, the communication port 276 is formed in the ink containing part 29 at a position separated from a corner portion 281 where the division wall 171 and the other walls cross each other as illustrated in FIG. 22. In the ink containing part 29, the other walls crossing the division wall 171 are the division wall 172 to the division wall 176. In the tank 10, the communication port 276 is separated from the corner portion 281 where these walls and the division wall 171 cross each other. Accordingly, the ink moving along the corner portion 281 where the division wall 171 and the other walls cross each other in the ink containing part 29 is unlikely to reach the communication port 276. Accordingly, it is possible to reduce the possibility of the ink in the ink containing part 29 leaking to the outside of the tank 10 via the air communication path 245.

It has been discovered that a capillary action may appear at the corner portion where the division wall 172 to the division wall 176 and the sheet member 138 of the case 137 cross each other in the ink containing part 29. That is, in the tank with the air lead-in port at the corner portion where the division wall 172 to the division wall 176 and the sheet member 138 cross each other, the ink contained in the ink containing part 29 may enter the air communication path 245 along the boundary portions between the walls of the case 137 and the sheet member 138. At the occurrence of such an event, the ink in the ink containing part 29 may leak to the outside of the tank via the air communication path 245. The place where the capillary action appears is not limited to the corner portion where the walls of the case 137 and the sheet member 138 cross each other. The sheet member 138 can be regarded as one of the walls defining the ink containing part 29. Therefore, the capillary action can appear the crossing portion (corner portion) of two of the walls defining the ink containing part 29.

In the tank 10, the communication port 276 is separated from the corner portion 281, which reduces the possibility of the ink moving upward along the corner portion 281 due to the capillary action and reaching the communication port 276. Accordingly, it is possible to reduce the possibility of the ink in the ink containing part 29 leaking to the outside of the tank 10 via the air communication path 245.

In the tank 10, the wall opposed to the division wall 171 with the communication port 276 is formed from the sheet member 138. Accordingly, the communication port 276 is separated from the sheet member 138, which reduces the possibility of the ink moving along the sheet member 138 and reaching the communication port 276. In general, a liquid is more likely to move (slide) over the sheet member 138 than over the resin material for the case 137. The communication port 276 can be separated from the sheet member 138 over which a liquid is likely to move, and thus the ink is further unlikely to reach the communication port 276. The sheet member 138 corresponds to a film.

In the tank 10, the air communication path 245 includes the buffer chamber 231, the buffer chamber 232, the buffer chamber 233, the buffer chamber 234, the buffer chamber 235, and the buffer chamber 236. The buffer chamber 231, the buffer chamber 232, the buffer chamber 233, the buffer chamber 234, the buffer chamber 235, and the buffer chamber 236 are positioned on the upstream side of the ink containing part 29. According to this configuration, the ink flowing from the ink containing part 29 to the air communication path 245 is likely to be retained in the buffer chamber 231 to the buffer chamber 236. This further reduces the possibility of the ink in the ink containing part 29 leaking to the outside of the tank 10 via the air communication path 245. The buffer chamber 231, the buffer chamber 232, the buffer chamber 233, the buffer chamber 234, the buffer chamber 235, and the buffer chamber 236 correspond to a second chamber.

In the tank 10, a width D1 of the cross section opening in the communication path 254 (FIG. 20) connected to the circular communication port 276 is identical to an inner diameter D2 of the communication port 276. The identical state here is not limited to the completely identical state but includes inconsistencies due to errors or tolerances. The width of the cross section opening in the communication path 254 is the inner width along the direction orthogonal to the direction of a fluid flowing in the communication path 254. For example, referring to FIG. 20, in the region of the communication path 254 extending from the communication hole 217 in the Z-axis direction, the width corresponds to the inner width along the X-axis direction. Since the inner diameter of the communication port 276 is identical to the width of the cross section opening in the communication path 254, even when the ink in the ink containing part 29 enters from the communication port 276 into the communication path 254, the ink having entered the communication path 254 is likely to return to the ink containing part 29. The communication path 254 corresponds to a communication flow path.

In the tank 10, the ink supply port 129 is located at a position along the −Y-axis direction of the division wall 171, that is, on the side opposed to the division wall 171 as illustrated in FIG. 16. Accordingly, the ink in the ink containing part 29 flows toward the ink supply port 129 on the side opposed to the communication port 276. In other words, the ink in the ink containing part 29 flows in the direction away from the communication port 276. This reduces the possibility of the ink leaking from the air opening port 123 via the communication port 276.

In the tank 10, as illustrated in FIG. 12, the cylindrical wall 124 is provided to surround the air opening port 123. Accordingly, the ink flowing out of the air opening port 123 is likely to be retained on the cylindrical wall 124 surrounding the air opening port 123. The cylindrical wall 124 corresponds to a second convex portion.

In the tank 10, as illustrated in FIG. 22, the upper limit mark 48 is provided on the division wall 172 extending in the direction (Z-axis direction) crossing the horizontal direction (Y-axis direction) in the use posture. In the tank 10, the communication port 276 is positioned above the upper limit mark 48. Accordingly, even when the liquid level of the ink in the ink containing part 29 has hit the upper limit mark 48, the ink in the ink containing part 29 is unlikely to reach the communication port 276. This further reduces the possibility of the ink in the ink containing part 29 leaking to the outside of the tank 10 via the air communication path 245.

In the tank 10, the sum of the volumes of the buffer chamber 231, the buffer chamber 232, the buffer chamber 233, the buffer chamber 234, the buffer chamber 235, and the buffer chamber 236 is equal to or larger than the volume of the ink in the ink containing part 29 when the liquid level of the ink has hit the upper limit mark 48. Accordingly, even when the ink in the ink containing part 29 flows into the air communication path 245, the ink in the ink containing part 29 can be received by the buffer chamber 231 to the buffer chamber 236. Thus, the ink flowing from the ink containing part 29 into the air communication path 245 is likely to be retained in the buffer chamber 231 to the buffer chamber 236, which further reduces the possibility of the ink in the ink containing part 29 leaking to the outside of the tank 10 via the air communication path 245.

In the tank 10, when the use posture of the tank 10 in which the level of the ink in the ink containing part 29 has hit the upper limit mark 48 is changed to the posture in which the division wall 172 is oriented downward, the communication port 276 is positioned above the liquid level of the ink in the ink containing part 29. Accordingly, even when the use posture of the tank 10 in which the level of the ink in the ink containing part 29 has hit the upper limit mark 48 is changed to the posture in which the division wall 172 is oriented downward, the ink in the ink containing part 29 is unlikely to reach the communication port 276. Accordingly, it is possible to reduce the possibility that, even when the posture of the tank 10 is changed to the posture in which the division wall 172 is oriented downward (in other words, the division wall 172 is faced toward the placement surface (XY plane) of the printer 1), the ink in the ink containing part 29 leaks to the outside of the tank 10 via the air communication path 245.

In the tank 10, the division wall 176 extending in the direction crossing the division wall 171 may include a plate wall 282 that protrudes from the division wall 176 toward the inside of the ink containing part 29 (in the −Y-axis direction) as illustrated in FIG. 22. The plate wall 282 is provided between the ink inlet port 45C and the communication port 276. The plate wall 282 divides the ink inlet port 45C from the communication port 276. Accordingly, when the ink is poured from the ink inlet port 45C into the ink containing part 29, the dispersed ink is unlikely to attach to the communication port 276, which further reduces the possibility of the ink leaking from the communication port 276 to the outside of the tank 10. The plate wall 282 is provided at least between the ink inlet port 45C and the communication port 276, and may be provided on the division wall 175, for example. The division wall 175 and the division wall 176 correspond to a second wall.

First Modification Example

Figure 23:
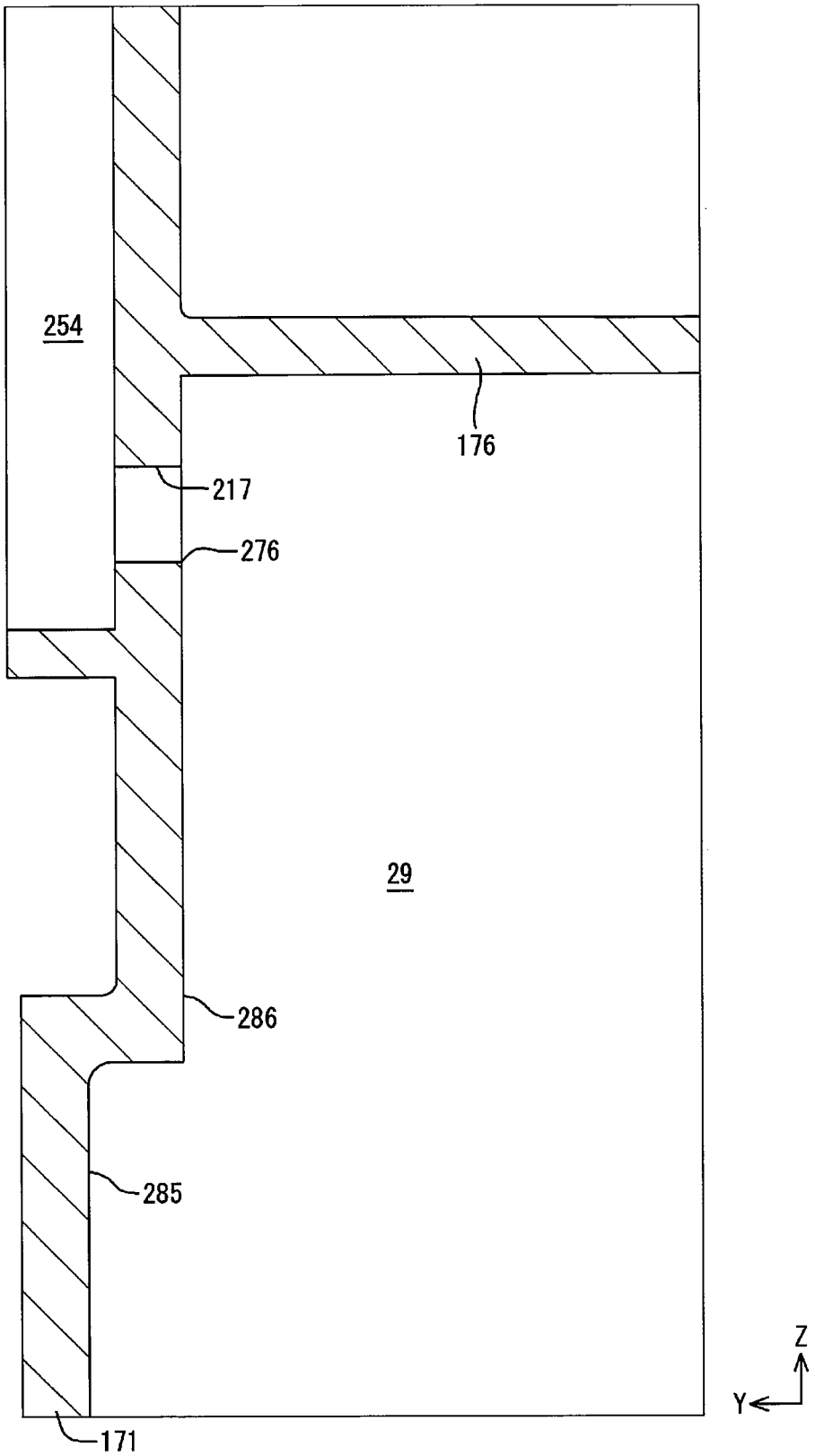
FIG. 23 is a cross-sectional view of a communication port in a first modification example.

In the tank 10, the communication port 276 may be formed on a second inner surface 286 that protrudes toward the inside of the ink containing part 29 (in the −Y-axis direction) beyond a first inner surface 285 of the division wall 171 as illustrated in FIG. 23 that is a cross-sectional view of a first modification example for describing the communication port 276. The cross-sectional view of FIG. 23 corresponds to the cross-sectional view of FIG. 22 taken along line B-B. In the example illustrated in FIG. 23, the surface of the division wall 171 on the ink containing part 29 side has the first inner surface 285 and the second inner surface 286. The first inner surface 285 and the second inner surface 286 have a step portion in the Y-axis direction. The second inner surface 286 protrudes beyond the first inner surface 285 in the −Y-axis direction. The communication port 276 is opened in the second inner surface 286. In this configuration, the communication port 276 is opened in the second inner surface 286 protruding beyond the first inner surface 285 toward the inside of the ink containing part 29, and thus the ink in the ink containing part 29 is unlikely to reach the communication port 276. This further reduces the possibility of the ink in the ink containing part 29 leaking to the outside of the tank 10 via the air communication path 245.

Second Modification Example

Figure 24:
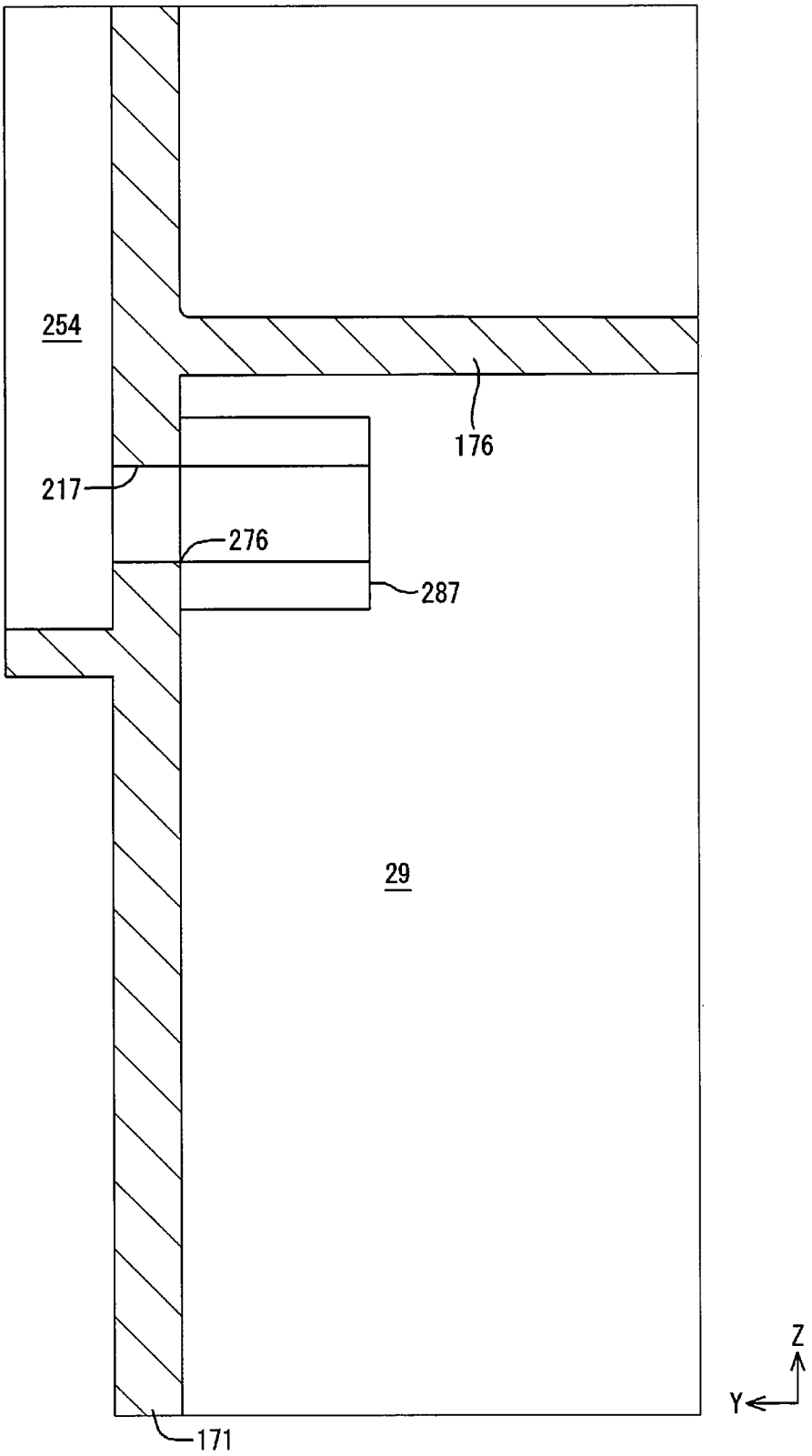
FIG. 24 is a cross-sectional view of a communication port in a second modification example.

In the tank 10, as illustrated in FIG. 24, a convex portion 287 protruding from the opposed side of the division wall 171 in the ink containing part 29 may be provided at part of outer periphery of the communication port 276 on the division wall 171 in the ink containing part 29. In the tank 10, the opposed side of the division wall 171 in the ink containing part 29 is the −Y-axis direction side of the division wall 171, that is, the sheet member 138 (FIG. 15) side. In this configuration, the convex portion 287 is formed around the communication port 276, which makes the ink in the ink containing part 29 unlikely to reach the communication port 276. This further reduces the possibility of the ink in the ink containing part 29 leaking to the outside of the tank 10 via the air communication path 245.

Third Modification Example

Figure 25:
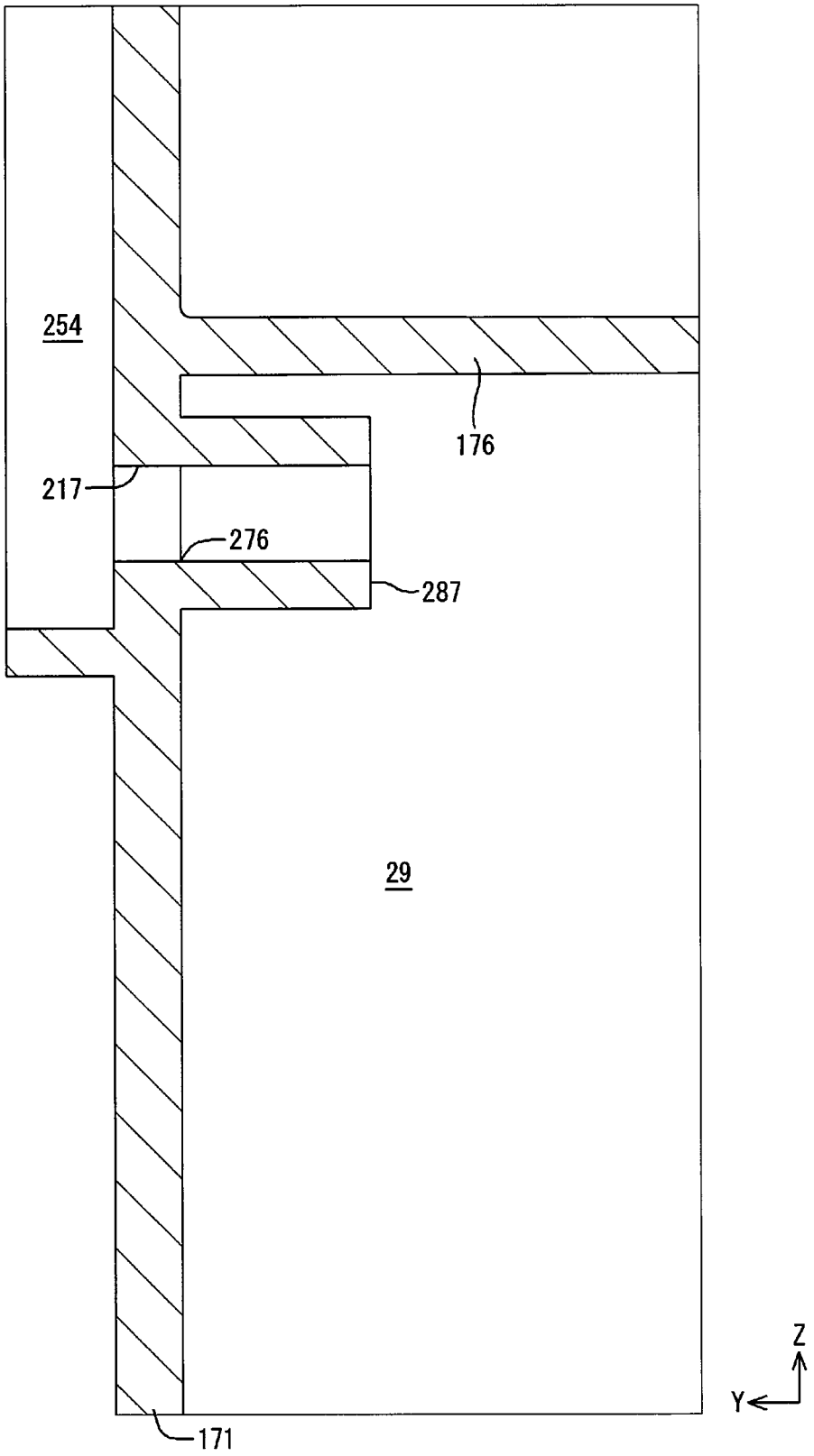
FIG. 25 is a cross-sectional view of a communication port in a third modification example.

In the tank 10, as illustrated in FIG. 25, the convex portion 287 may be formed in a cylindrical shape to surround the entire periphery of the communication port 276. In this configuration, the convex portion 287 surrounds the entire periphery of the communication port 276, which makes the ink in the ink containing part 29 further unlikely to reach the communication port 276.

Fourth Modification Example

Figure 26:
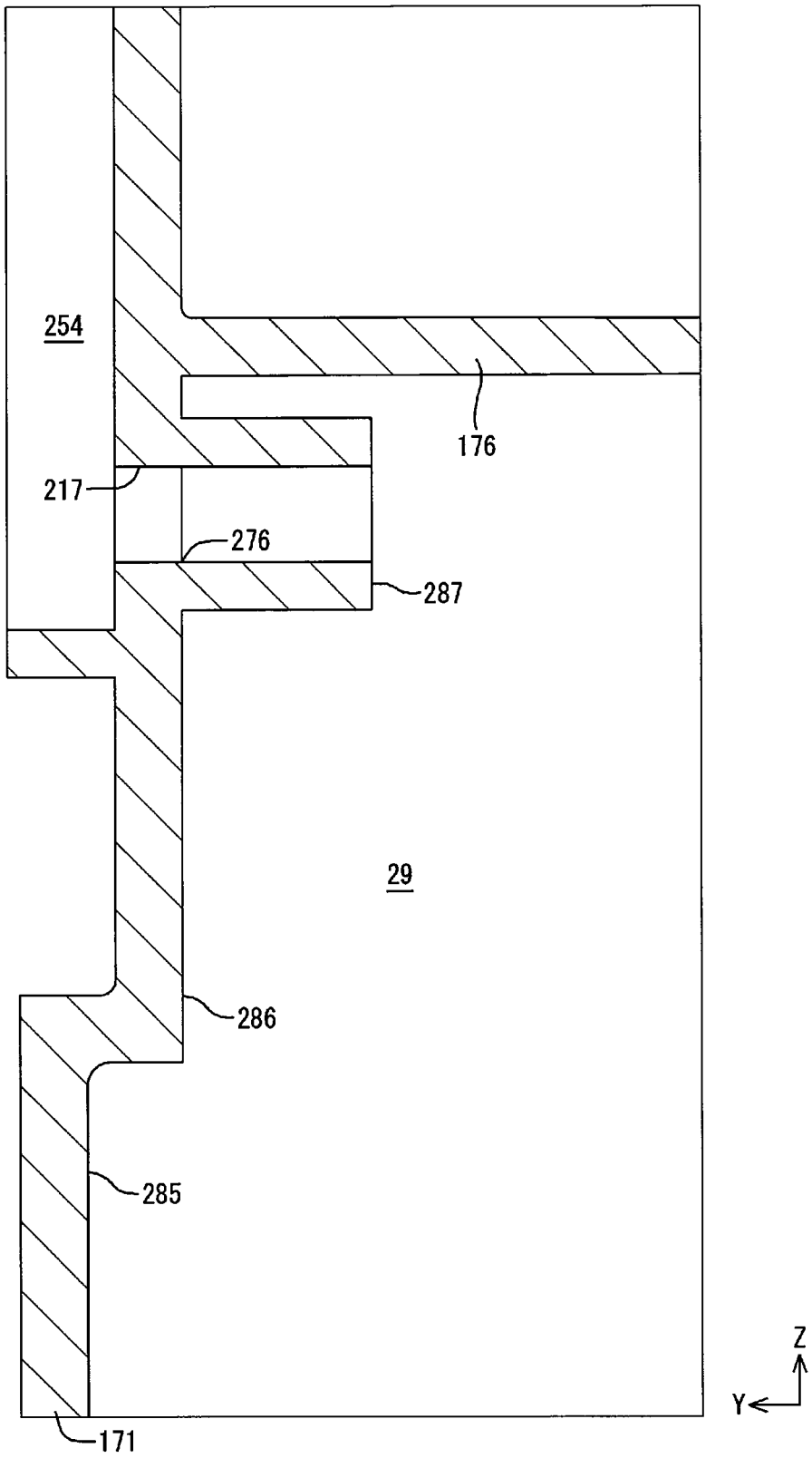
FIG. 26 is a cross-sectional view of a communication port in a fourth modification example.

In the tank 10, as illustrated in FIG. 26, the communication port 276 may be formed on the second inner surface 286 and the cylindrical convex portion 287 may be provided to surround the entire periphery of the communication port 276. According to this configuration, the ink in the ink containing part 29 is further unlikely to reach the communication port 276.

Fifth Modification Example

Figure 27:
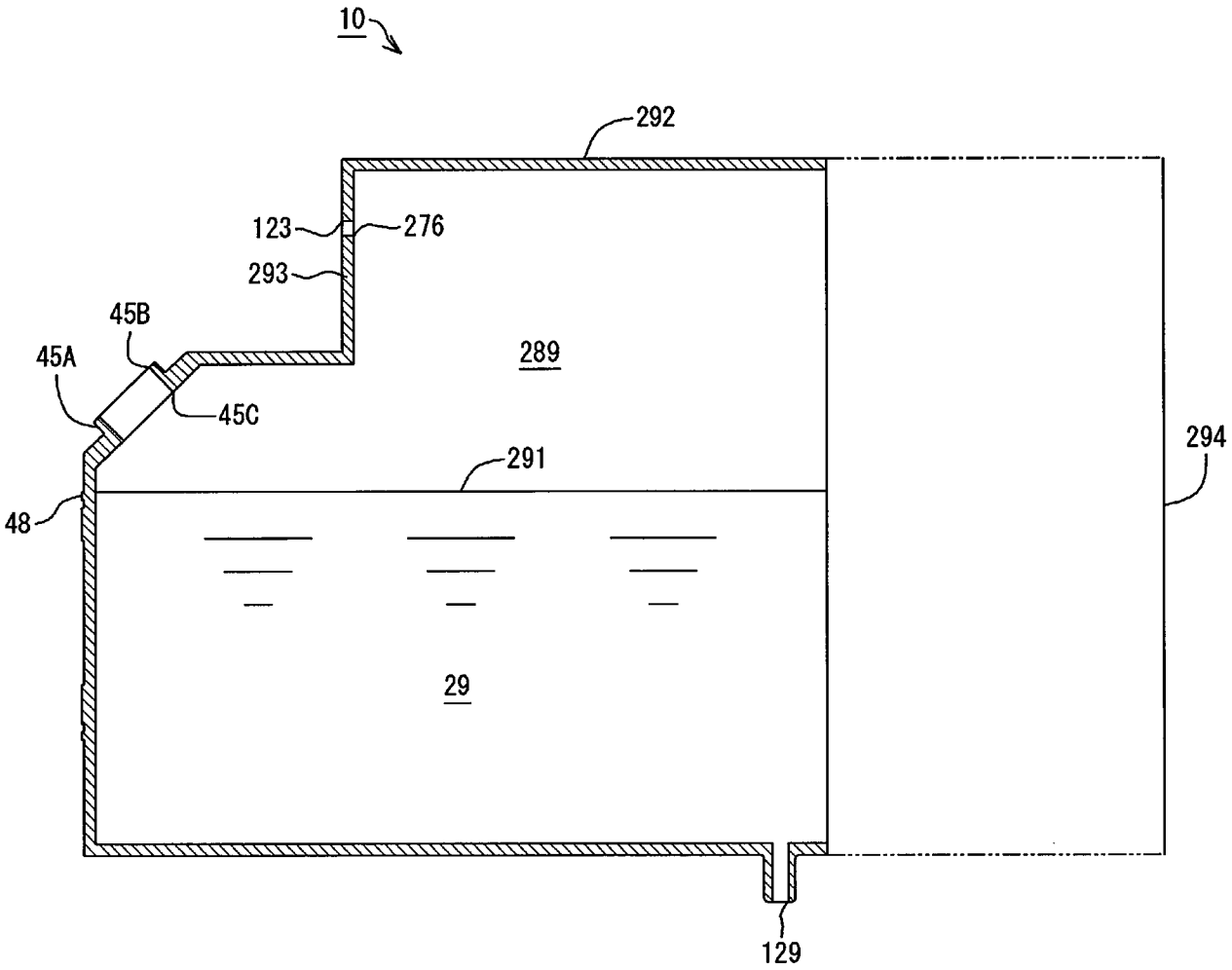
FIG. 27 is a diagram describing a general configuration of a tank according to a fifth modification example.

The tank 10 is not limited to the foregoing structures and shapes. The tank 10 may be structured such that an air chamber 289 is formed in the ink containing part 29 as illustrated in FIG. 27, for example. In the tank 10 of a fifth modification example, a space is formed above an ink 291 in the ink containing part 29 when the level of the ink 291 has hit the upper limit mark 48. In the tank 10 of the fifth modification example, the space above the ink 291 is formed as the air chamber 289. The communication port 276 is opened in a wall 293 of a case 292. The wall 293 corresponds to the first wall and is opposed to a sheet member 294. The case 292 is formed from the same material as that for the case 137, and the sheet member 294 is formed from the same material as that for the sheet member 138.

In the tank 10 of the fifth modification example as well, the communication port 276 is formed in the ink containing part 29 at a position separated from the corner portion 281 where the wall 293 and the other walls cross each other. The wall 293 with the communication port 276 is opposed to the sheet member 294, and the communication port 276 is separated from the sheet member 294. In the tank 10 of the fifth modification example, the plate wall 282 may be provided between the ink inlet port 45C and the communication port 276.

In the tank 10, the division wall 174 is inclined downward from the division wall 172 to the division wall 173 as illustrated in FIG. 22. In other words, the division wall 174 is inclined downward in the −Z-axis direction with increasing proximity to the −X-axis direction. The division wall 174 is also inclined downward from the division wall 171 to the sheet member 138 (FIG. 15). In other words, the division wall 174 is inclined downward in the −Z-axis direction with increasing proximity to the −Y-axis direction. Accordingly, it can be said that: the tank 10 includes the division wall 172, the division wall 173 opposed to the division wall 172, and the division wall 174 connecting the division wall 172 and the division wall 173; the division wall 171 crosses the division wall 174, the division wall 172, and the division wall 173; the sheet member 138 crosses the division wall 174, the division wall 172, and the division wall 173; the division wall 174 inclines downward from the division wall 172 to the division wall 173, and inclines downward from the division wall 171 to the sheet member 138; and the ink supply part 128 is provided at the lowermost part of the division wall 174.

That is, the division wall 174 inclines downward from the corner portion 281 between the division wall 171 and the division wall 172 to the ink supply part 128. In other words, when viewed in the −Z-axis direction, the division wall 174 inclines along a diagonal line from the corner portion 281 between the division wall 171 and the division wall 172 to the ink supply part 128. According to this configuration, the ink in the ink containing part 29 flows toward the ink supply part 128 along the inclination of the division wall 174. Accordingly, the ink is unlikely to remain on the division wall 174, which reduces the amount of residual ink in the ink containing part 29. Further, applying a liquid-repellent treatment or lyophilic treatment to the division wall 174 further reduces the amount of residual ink in the ink containing part 29.

In the tank 10, as illustrated in FIG. 13, the plurality of leg parts 126 are provided on the surface 108 oriented in the −Z-axis direction of the division wall 174. In the tank 10, as illustrated in FIG. 22, the plurality of leg parts 126 are different in the amount of protrusion from the division wall 174 according to the positions along the X-axis direction. The plurality of leg parts 126 are also different in the amount of protrusion from the division wall 174 according to the positions along the Y-axis direction. This is caused by the inclination of the division wall 174. Specifically, in the tank 10, the leg parts 126 are smaller in the amount of protrusion along the inclination of the division wall 174, that is, from the corner portion 281 between the division wall 171 and the division wall 172 to the ink supply part 128. Accordingly, even with the inclination of the division wall 174, the use posture of the tank 10 can be maintained.

In the tank 10, as illustrated in FIG. 16, the ink supply part 128 is provided on the Y-axis direction side of the overhang part 127 and protrudes from the overhang part 127 in the Y-axis direction. According to this configuration, it is possible to increase the degree of freedom to arrange the ink supply tube 43 (FIG. 3) connected to the ink supply part 128.

In the tank 10, as illustrated in FIG. 14, the cylindrical wall 124 is provided to surround the air release part 122. In the printer 1, the tank 10 may be tested for air tightness while the tank 10 is incorporated in the printer 1. At the air-tightness testing of the tank 10, while the inlet part 45 and the cylindrical wall 124 are closed, either the inlet part 45 or the cylindrical wall 124 is pressurized to check pressure leak. At this time, the cylindrical wall 124 can be used. The cylindrical wall 124 is opened more widely than the air release part 122, and thus closing the cylindrical wall 124 is mechanically easier than closing the air release part 122.

Figure 28:
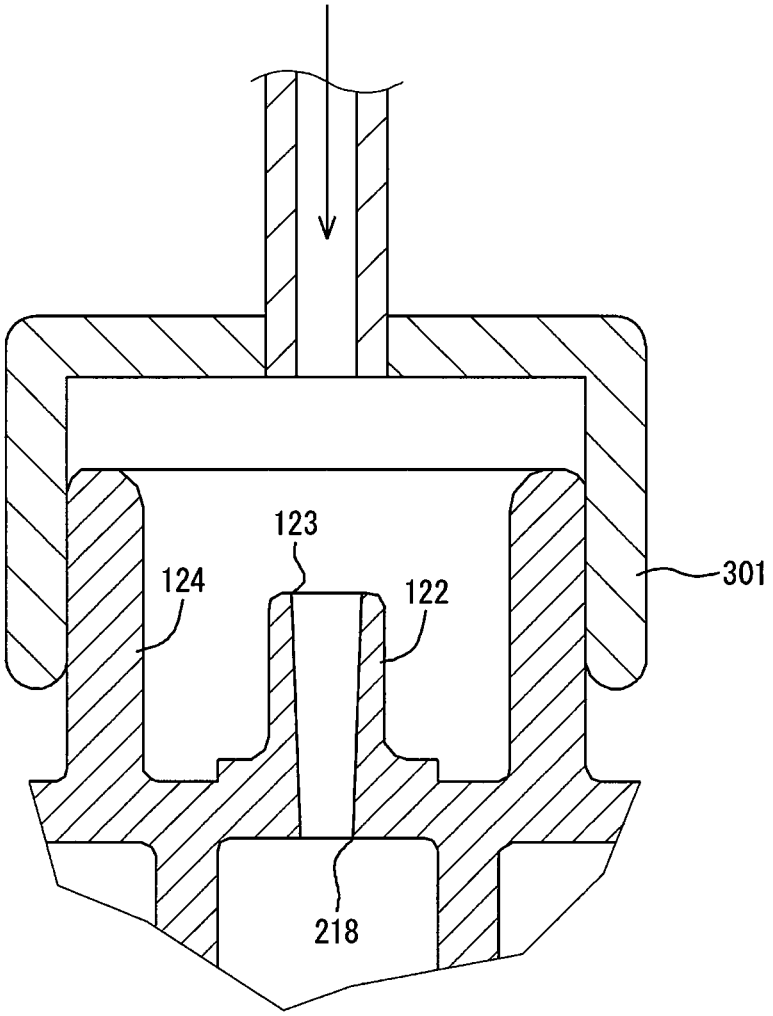
FIG. 28 is a cross-sectional view of a cylindrical wall of the tank according to the first embodiment.

As illustrated in FIG. 28, a seal member 301 formed from rubber or elastomer is pressed on the cylindrical wall 124. At this time, closing the more widely opened cylindrical wall 124 rather than closing the air release part 122 permits the position accuracy of the seal member 301. In this regard, closing the cylindrical wall 124 is mechanically easier than closing the air release part 122. With the cylindrical wall 124 closed by the seal member 301, supplying the compressed air enhances the pressure in the tank 10. An up-and-down motion mechanism such as a cylinder, for example, can be used as a mechanism for moving the seal member 301 upward and downward.

When the seal member 301 is pressed on the cylindrical wall 124, the tank 10 is likely to be displaced due to the pressure of the seal member 301. The tank 10 has the fixed part 125 as illustrated in FIG. 14. The fixed part 125 has a U-shaped cut. In the tank 10, the fixed part 125 is fixed by screws to the housing 6 of the printer 1. This can easily suppress the displacement of the tank 10 due to the pressure of the seal member 301.

In the tank 10, the fixed part 125 is provided on the surface 106 that corresponds to the top plate of the tank 10. According to this configuration, the tank 10 is fixed at a position near the uppermost part, which makes it easy to suppress the displacement of the tank 10 due to the pressure of the seal member 301 in an effective manner. The fixed part 125 can be fixed by not only screwing but also various fixation methods such as hook engagement and joining by adhering and welding. The shape of the cylindrical wall 124 may be not only a cylinder but also various shapes such as oval and polygon.

Figure 29:
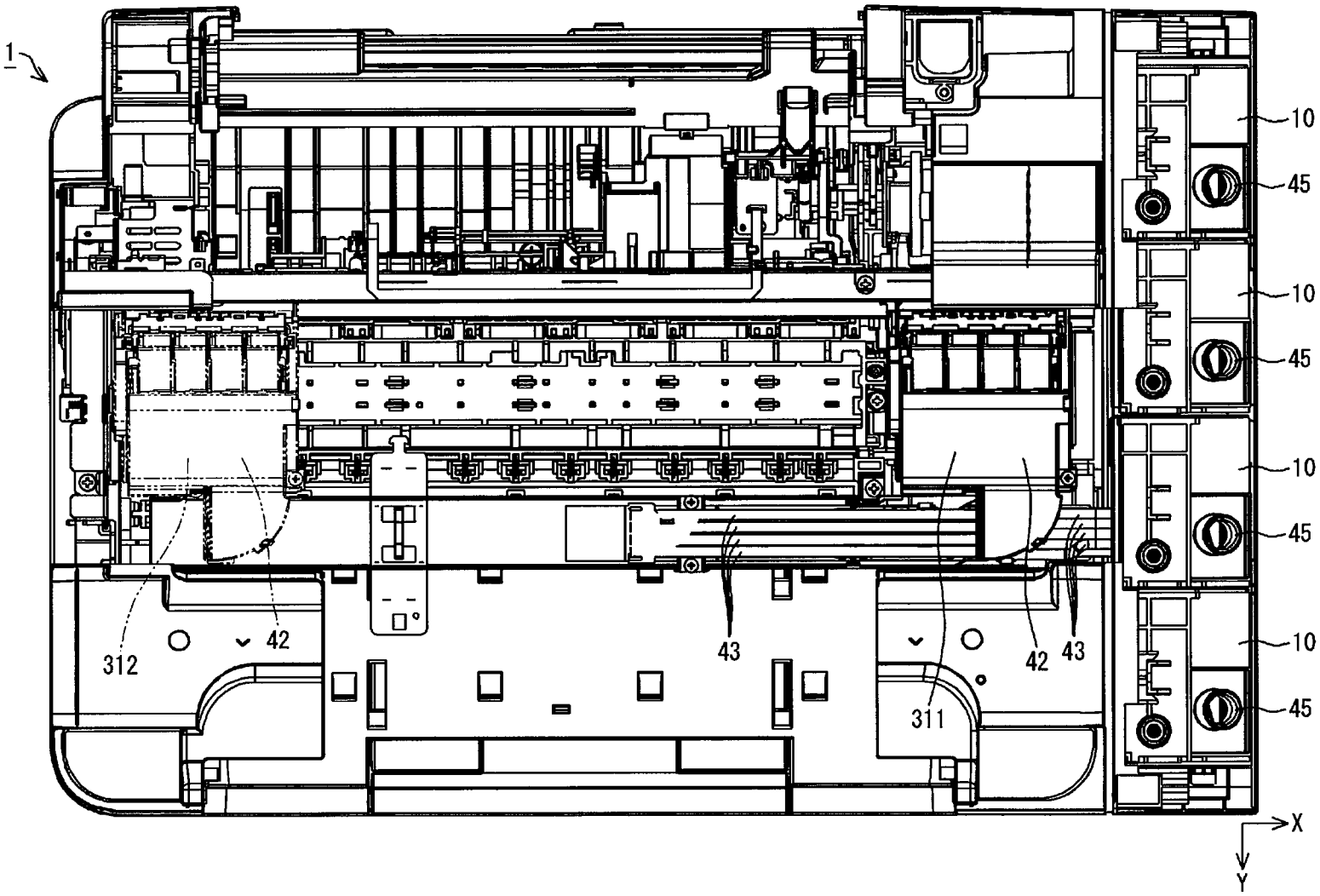
FIG. 29 is a plane view of the main configuration of the printer according to the first embodiment.

In the printer 1 in the present embodiment, as illustrated in FIG. 29, the print part 42 is reciprocatable in a movable region between a waiting position 311 and a turn position 312. The ink supply tubes 43 connected to the tank 10 and the print part 42 are flexibly movable forward and backward following the reciprocating motion of the print part 42. FIG. 29 does not illustrate the scanner unit 5 (FIG. 3) and the housing 7 for ease of understanding.

Figure 30:
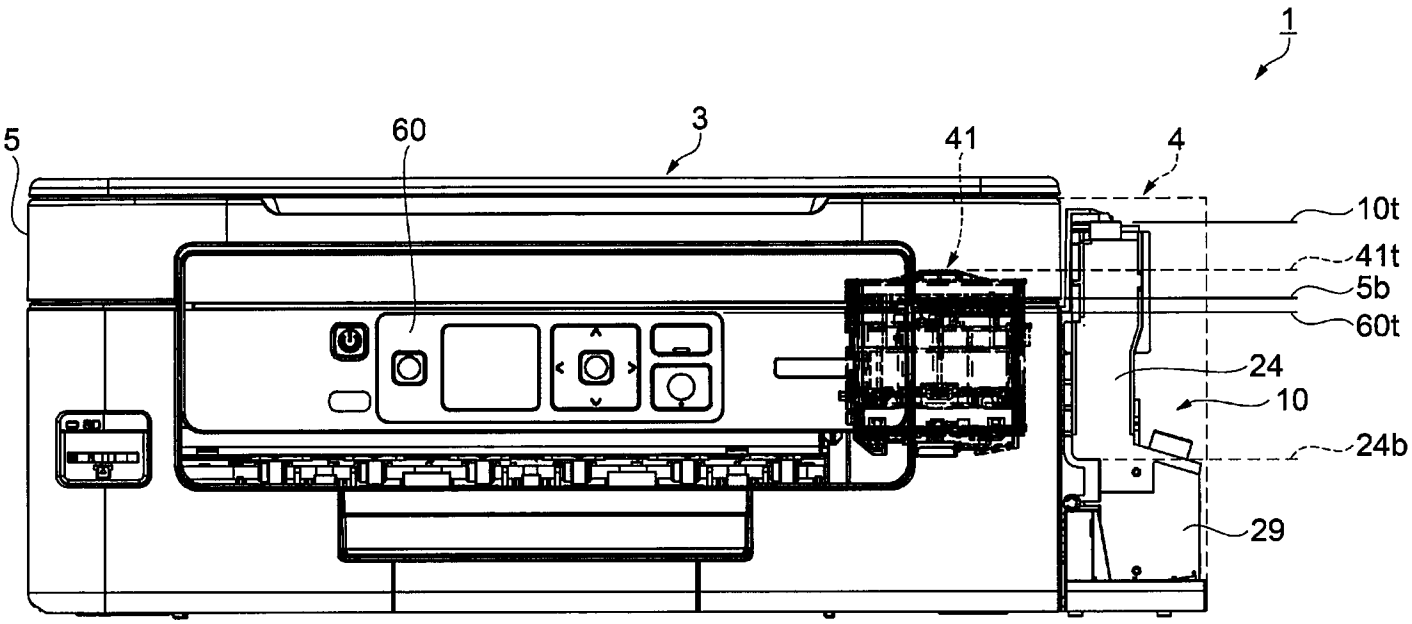
FIG. 30 is a diagram illustrating the positional relationship between the upper end of the tank and individual portions of a print part as seen from the front side of the printer according to the first embodiment.
Figure 31:
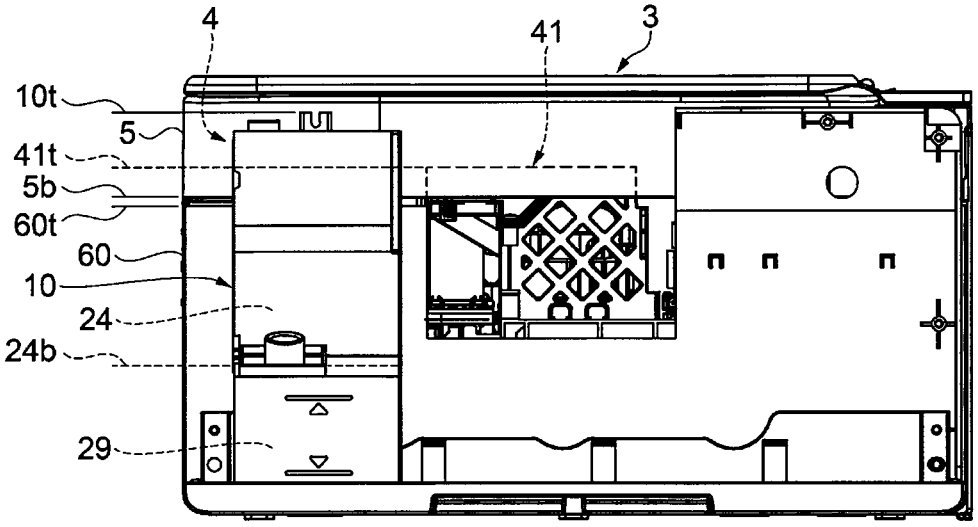
FIG. 31 is a diagram illustrating the positional relationship between the upper end of the tank and the individual portions of the print part as seen from the tank unit side according to the first embodiment.

In the printer 1 configured as described above, the positional relationship between the upper end of the tank 10 and the individual portions of the print unit 3 will be described with reference to the drawings. FIGS. 30 and 31 describe the positional relationship between the upper end of the tank 10 and the individual portions of the print part 42 in the first embodiment. FIG. 30 is an illustrative diagram as seen from the front side of the printer 1, and FIG. 31 is an illustrative diagram as seen from the tank unit 4 side.

Referring to FIGS. 30 and 31, an upper end 10*t* of the tank 10, an upper end 41*t* of the liquid injection mechanism part 41, and an upper end 60*t* of the operation panel 60 refer to the uppermost portions of the tank 10, the liquid injection mechanism part 41, and the operation panel 60 in the "use state" described above. For example, when there is an upward protrusion portion such as a rib, the protruding end of the protrusion portion is defined as "upper end". Referring to FIGS. 30 and 31, a lower end 5*b* of the scanner unit 5 and a lower end 24*b* of the air containment chamber (air containment part) 24 of the tank 10 refer to the lowermost portions of the scanner unit 5 and the air containment chamber (air containment part) 24 in the "use state". For example, when there is a downward protrusion portion, the protruding end of the protrusion portion is defined as "lower end.

As illustrated in FIGS. 30 and 31, the upper end 10*t* of the tank 10 in the tank unit 4 is positioned above the upper end 41*t* of the liquid injection mechanism part 41 in the print unit 3.

The upper end 10*t* of the tank 10 is positioned at a level equal to or higher than the upper end 60*t* of the operation panel 60. In the printer 1 in the present embodiment, the upper end 10*t* of the tank 10 is positioned above the upper end 60*t* of the operation panel 60.

The upper end 10*t* of the tank 10 is positioned above the lower end 5*b* of the scanner unit 5 that is positioned above the upper end 60*t* of the operation panel 60.

At least part of the air containment chamber (air containment part) 24 (the side above the lower end 24*b* of the air containment chamber 24) arranged above the ink containing part 29 of the tank 10 is positioned above the upper end 41*t* of the liquid injection mechanism part 41.

According to the printer 1 in the present embodiment, the following advantageous effects can be obtained.

In the printer 1 in the present embodiment, the upper end 10*t* of the tank 10 is positioned above the upper end 41*t* of the liquid injection mechanism part 41 in the use posture of the liquid injection mechanism part 41 that can change the position of the print medium P relative to the print part 42 including the print head as the liquid injection head.

According to this configuration, in the use posture, the upper end 10*t* of the tank 10 is positioned above the upper end 41*t* of the liquid injection mechanism part 41, which makes it possible to increase the volume of the tank 10 for storing the ink (the volume of the ink containing parts 29) to achieve larger capacity by using efficiently the upper space of the tank 10 in the printer 1. Therefore, it is possible to provide the printer 1 that has the large capacity of the tank 10 as the liquid container while suppressing increase in the footprint of the printer 1 (size increase in the X-axis direction and the Y-axis direction).

The printer 1 in the present embodiment includes the operation panel 60 with the operation portions such as switches for operating the printer 1 at a position at least partially overlapping in the vertical direction the liquid injection mechanism part 41 on the front surface 22 along the vertical direction of the print unit 3, and the upper end

10*t* of the tank 10 is positioned at a level equal to or higher than the upper end 60*t* of the operation panel 60 (the latter in the present embodiment).

The printer 1 in the present embodiment includes the scanner unit 5 that reads an image on a paper sheet and outputs data of the image, and the upper end 10*t* of the tank 10 is positioned above the lower end 5*b* of the scanner unit 5 that is positioned above the upper end 60*t* of the operation panel 60.

According to these configurations, the upper end 10*t* of the tank 10 is positioned above the lower end 5*b* of the scanner unit 5 that is arranged above the upper end 60*t* of the operation panel 60, which makes it possible to provide the printer 1 including the larger-capacity tank 10 while suppressing increase in the footprint of the printer 1.

The tank 10 in the present embodiment has the ink containing part 29 containing the ink and the air containment chamber (air containment part) 24 containing the air above the liquid level of the ink contained in the ink containing part 29, and at least part of the air containment chamber 24 (above the lower end 24*b* of the air containment chamber 24) is positioned above the upper end 41*t* of the liquid injection mechanism part 41.

According to this configuration, it is possible to increase the ink containing capacity of the tank 10 including the air containment chamber (air containment part) 24 while suppressing increase in the footprint of the printer 1, by using efficiently the upper space of the tank 10 in the printer 1.

The tank 10 has therein the air containment chamber (air containment part) 24 in the sufficiently size together with the ink containing part 29 to stabilize the internal pressure of the tank 10. This makes it possible to supply stably the ink from the tank 10 to the print head and suppress the leakage of the ink resulting from improper internal pressure.

The inside of the tank 10 in the present embodiment is divided into the ink containing part 29 as a liquid containing chamber containing an ink and the air containment chamber 24 as an air containment part having a plurality of air containment chambers.

According to this configuration, the inside of the tank 10 is divided into the ink containing part 29 containing the ink and the air containment chamber (air containment part) 24. This produces an advantageous effect of suppressing the leakage of the ink from the air opening port or the like of the air containment chamber (air containment part) 24 due to a change in the internal pressure of the tank 10.

The printer 1 in the first embodiment includes the plurality of (four in the present embodiment) tanks 10, and the upper ends 10*t* of the tanks 10 are positioned at the same height. The printer 1 is not limited to this configuration but may be configured, for example, such that the upper end 10*t* of any one of the plurality of tanks 10 in the use posture of the liquid injection mechanism part 41 is positioned above the upper end 41*t* of the liquid injection mechanism part 41 or positioned above the lower end 5*b* of the scanner unit 5.

Similarly, for example, at least part of the air containment chamber 24 in one of the plurality of tanks 10 is positioned above the upper end 41*t* of the liquid injection mechanism part 41.

B. Second Embodiment

Figure 32:
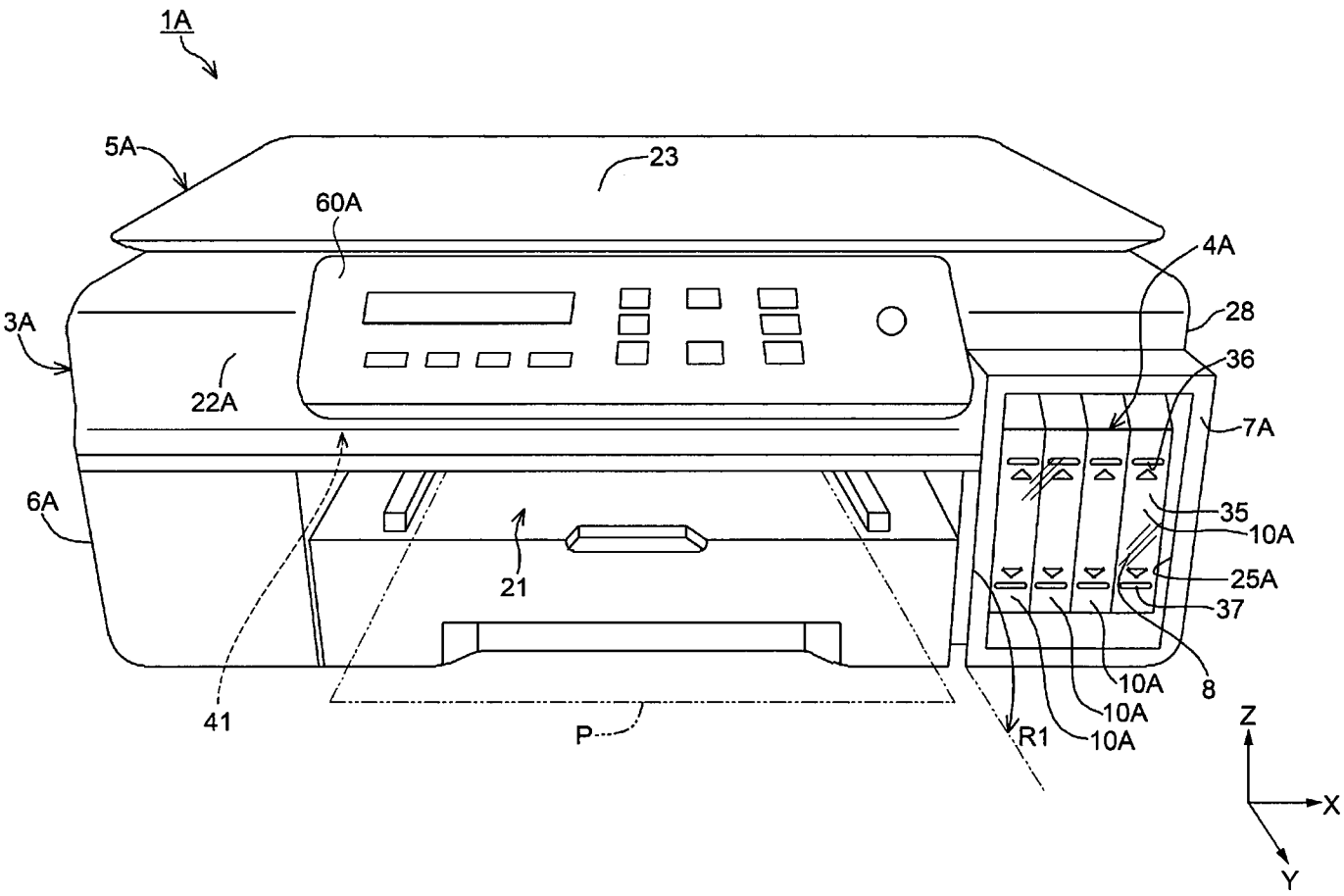
FIG. 32 is a perspective view of a main configuration of a printer according to a second embodiment.
Figure 33:
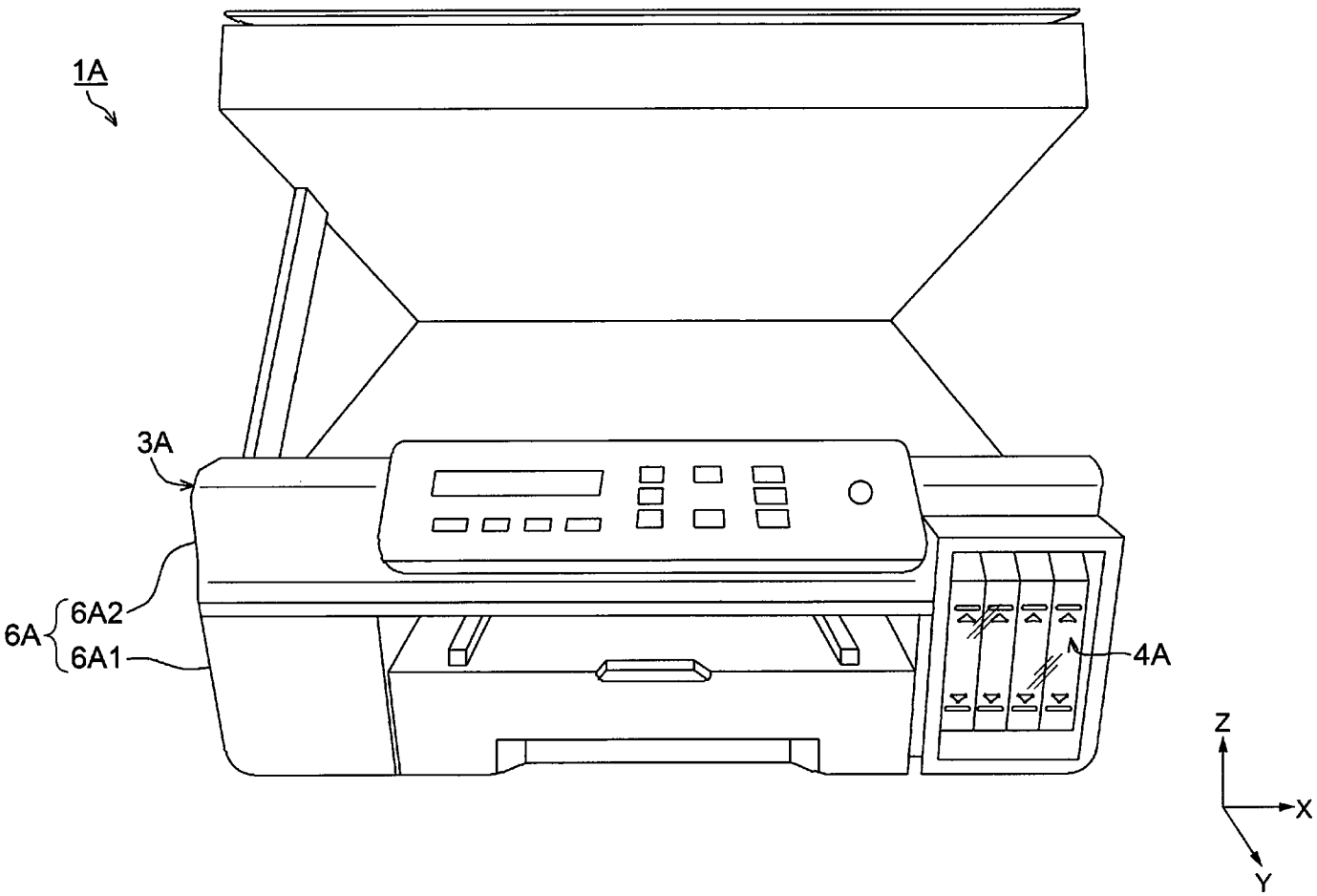
FIG. 33 is a perspective view of the main configuration of the printer according to the second embodiment.
Figure 34:
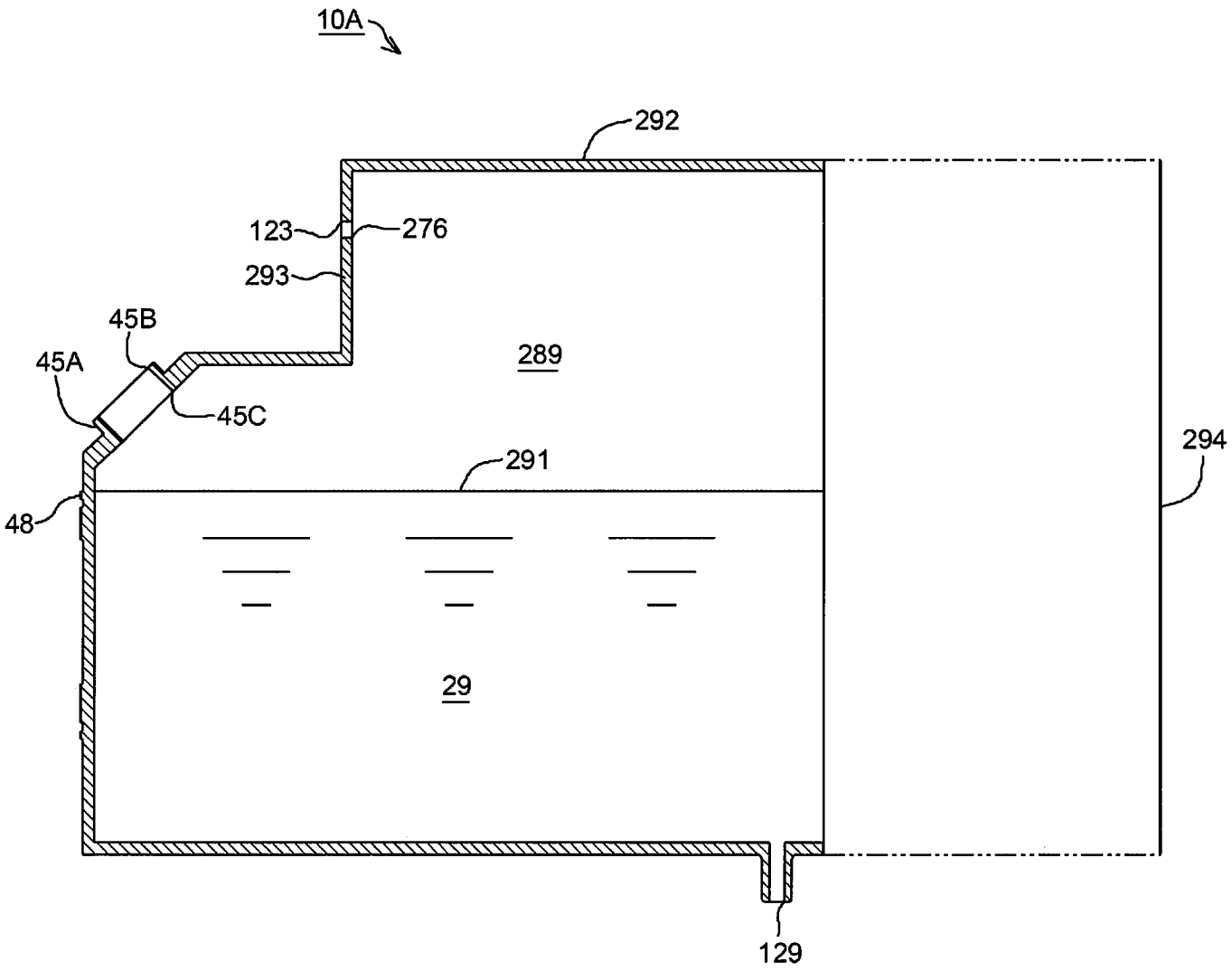
FIG. 34 is a diagram illustrating a general configuration of a tank according to the second embodiment.

FIGS. 32 and 33 are perspective views of a main configuration of a printer 1A according to a second embodiment. FIG. 34 is a diagram illustrating a general configuration of a tank 10A according to the second embodiment.

The printer 1A in the present embodiment will be described with reference to these drawings. The same components as those in the first embodiment will be given the same reference signs as those in the first embodiment and descriptions thereof will be omitted. The components slightly different in shape or the like from those in the first embodiment but having the same functions as those in the first embodiment will be given the same reference signs with the suffix "A" and duplicated descriptions of the functions will be omitted.

As illustrated in FIG. 32, the printer 1A in the present embodiment has a print unit 3A, a tank unit 4A, and a scanner unit 5A. The print unit 3A has a housing 6A that forms the outer case of the printer 1A. In the printer 1A, the tank unit 4A is stored in the housing 6A. The tank unit 4A has a plurality of (four in the present embodiment) tanks 10A.

The housing 6A and the scanner unit 5A constitute the outer case of the printer 1A. The printer 1A may not have the scanner unit 5A. The printer 1A may produce a print on a print medium P by an ink as an example of a liquid.

In the use state of the printer 1A, the four tanks 10A described above are aligned along the X axis. Accordingly, the X-axis direction can be defined as direction in which the four tanks 10A are aligned. Specifically, in the printer 1 in the first embodiment, the tanks 10 are arranged on the side (the side surface 28 side) of the housing 6 along the X-axis direction (for example, see FIG. 1), whereas in the printer 1A in the present embodiment, the tanks 10A are arranged on the front surface of the housing 6A along the Y-axis direction.

In the printer 1A, the scanner unit 5A is rotatable with respect to the print unit 3A. The scanner unit 5A also has the function of a lid for the print unit 3A. The operator can lift the scanner unit 5A in the Z-axis direction to rotate the scanner unit 5A with respect to the print unit 3A as illustrated in FIG. 33. Accordingly, the scanner unit 5A acting as the lid for the print unit 3A can be opened to the print unit 3A.

As illustrated in FIG. 32, the print unit 3A has the paper ejection portion 21. In the print unit 3A, the paper ejection portion 21 ejects the recording medium P. The surface of the print unit 3A with the paper ejection portion 21 is a front surface 22A of the print unit 3A.

In the approximately center of the front surface 22A of the print unit 3A, an operation panel 60A with operation portions such as switches for operating the printer 1A is provided above the paper ejection portion 21.

The printer 1A has a top surface 23 crossing the front surface 22A and a side surface 28 crossing the front surface 22A and the top surface 23. In the print unit 3A, the tank unit 4A is provided on the side surface 28 as a side part of the front surface 22A. The housing 6A has a window 25A. The window 25A is provided on the front surface 22A of the housing 6A.

The window 25A has light permeability. The tanks 10A are provided to overlap the window 25A. Accordingly, the operator using the printer 1A can see the tanks 10A through the window 25A. In the present embodiment, the window 25A is provided as an opening in the housing 6A. The window 25A provided as an opening is closed by a light-permeable member 8. Thus, the operator can see the tanks 10A through the window 25A as an opening. The member 8 closing the windows 25A may not be provided. Even if the member 8 closing the window 25A is not provided, the operator can see the tanks 10A through the window 25A as an opening.

In the present embodiment, the portions of the tanks 10A facing the window 25A are at least partially light-permeable. The inks in the tank 10A can be seen through the light-permeable portions of the tanks 10A.

Therefore, the operator can see the four tanks 10A through the window 25A to check the amounts of the inks in the tanks 10A. That is, at least portions of the tanks 10A facing the window 25A can be used as visual-recognition parts through which the amounts of inks can be seen.

The housing 6A has a cover 7A. The cover 7A is rotatable in an R1 direction illustrated in the drawing with respect to the housing 6A. In the print unit 3A, the cover 7A is provided on the front surface 22A. When the print unit 3A is seen in the −Y-axis direction, the cover 7A overlaps the tank 10A on the front surface 22A of the print unit 3A. When the cover 7A is rotated in the R1 direction illustrated in the drawing with respect to the housing 6A, the cover 7A opens with respect to the housing 6A. Opening the cover 7A with respect to the housing 6A allows the operator to access the liquid inlet portion (not illustrated) of the tank 10A from the outside of the housing 6A.

The housing 6A includes a first housing 6A1 and a second housing 6A2 as illustrated in FIG. 33. The first housing 6A1 and the second housing 6A2 overlap along the Z-axis direction. The first housing 6A1 is located along the −Z-axis direction of the second housing 6A2. The liquid injection mechanism part 41 including the tanks 10A and a print head as a liquid injection head (not illustrated) is stored between the first housing 6A1 and the second housing 6A2 (see FIG. 32). That is, the tanks 10A and the liquid injection mechanism part 41 are covered with the housing 6A. Accordingly, the tanks 10A and the liquid injection mechanism part 41 can be protected by the housing 6A.

In the foregoing example, the print unit 3A and the tank unit 4A are separate components. However, the tank unit 4A may be included in the print unit 3A.

In the present embodiment, the tank unit 4A has the plurality of (four) tanks 10A. However, the number of the tanks 10A is not limited to four but may be three or less, or larger than four.

Next, the tanks 10A in the present embodiment will be described in detail. The tanks are not limited to the structure and shape of the tanks 10 in the first embodiment. For example, as the tanks 10A illustrated in FIG. 34, the inside of each of the tanks 10A may not be divided into the ink container chamber and the air containment chamber but the same space in the inside of the tank 10A may have the ink containing part 29 containing the ink and the air containment part 289 containing the air above the liquid level 291 of the ink as in the fifth modification example. In the tanks 10A of the second embodiment, a space is formed above the liquid level 291 of the ink in the ink containing part 29 when the liquid level 291 of the ink has reached the upper limit mark 48. In the tanks 10A of the second embodiment, the space formed above the liquid level 291 of the ink constitutes the air containment part (the air containment chamber or the air chamber) 289. The communication port 276 is opened in the wall 293 of the case 292. The wall 293 corresponds to the first wall and is opposed to the sheet member 294. The case 292 is formed from the same material as that for the case 137, and the sheet member 294 is formed from the same material as that for the sheet member 138.

In the tank 10A of the second embodiment as well, the communication port 276 is formed in the tank 10A (the ink containing part 29 and the air containment part 289) at a position separated from the corner portion 281 where the wall 293 and the other walls cross each other. The wall 293 with the communication port 276 is opposed to the sheet member 294, and the communication port 276 is separated from the sheet member 294. In the tank 10A of the second embodiment, the plate wall 282 may be provided between the ink inlet port 45C and the communication port 276.

In the printer 1A configured as described above, the positional relationship between the upper end of the tank 10A and the individual portions of the print unit 3A is the same as that in the first embodiment except for the positional relationship with the operation panel 60A.

That is, in the use posture of the printer 1A in the second embodiment illustrated in FIGS. 32 and 33, the upper end of the tank 10A is positioned above the upper end of the liquid injection mechanism part 41.

In addition, in the use posture of the printer 1A in the present embodiment, the upper end of the tank 10A is positioned above the lower end of the scanner unit 5A. At least part of the air containment part 289 is positioned above the upper end of the liquid injection mechanism part 41.

According to this configuration, it is possible to increase the ink containing capacity of the tank 10A while suppressing increase in the footprint of the printer 1A, by using efficiently the upper space of the tank 10A in the printer 1A.

In the printer 1A of the present embodiment illustrated in FIGS. 32 and 33, for the sake of illustration, the positional relationship between the operation panel 60A and the upper end of the tank 10A does not satisfy the positional relationship in the first embodiment. However, the arrangement of the operation panel 60A and the position of the upper end of the tank 10A (the ink containing capacity of the tank 10A) can be changed such that the upper end of the tank 10A is positioned above the upper end of the operation panel 60A as in the first embodiment.

In the printer 1A of the second embodiment, the same space in the tank 10A has the ink containing part 29 containing the ink and the air containment part 289 containing the air above the liquid level 291 of the ink. Alternatively, the inside of the tank 10A may be divided into the ink container chamber and the air containment chamber.

C. Third Embodiment

Figure 35:
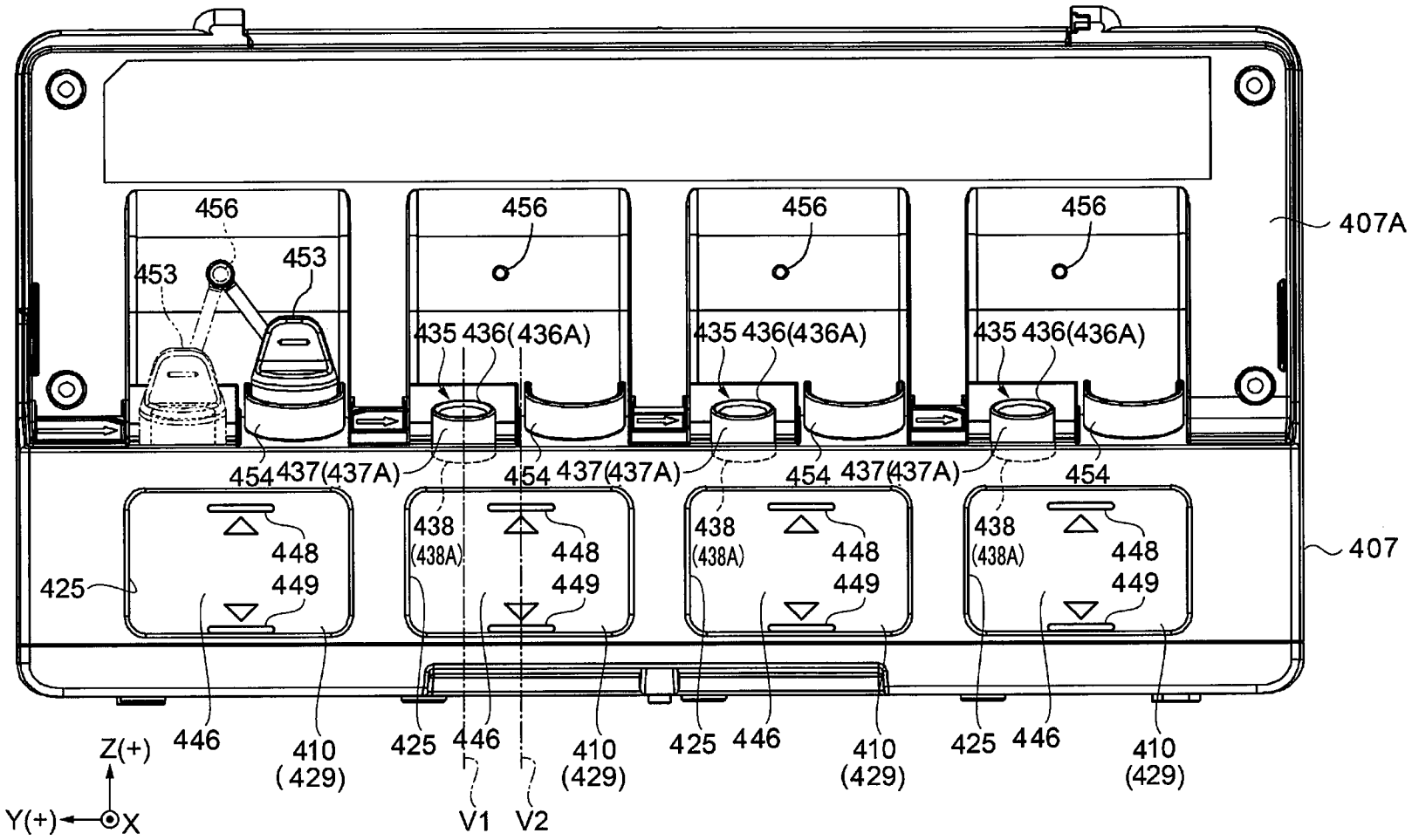
FIG. 35 is a schematic diagram illustrating the state of a tank unit according to a third embodiment.
Figure 36:
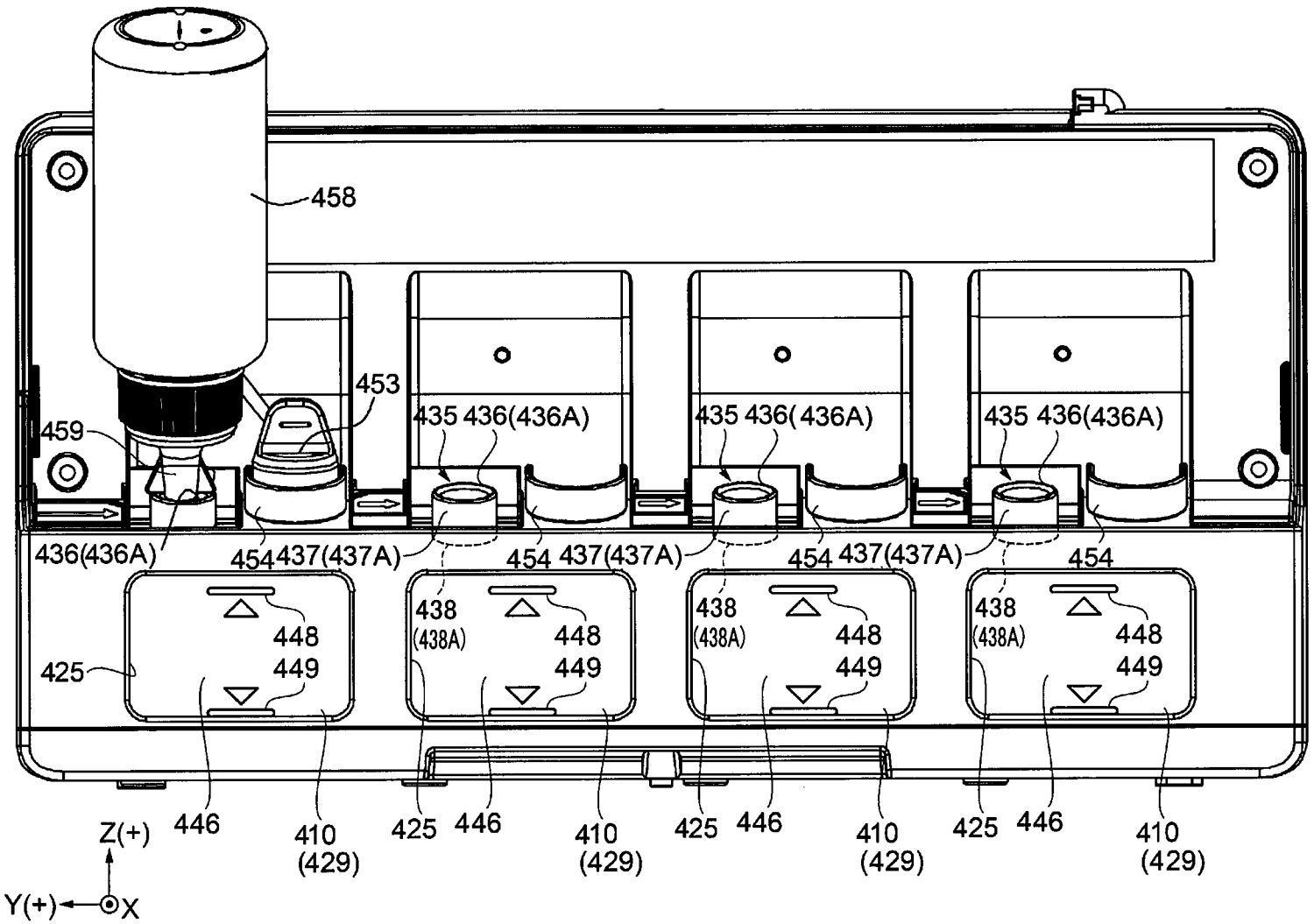
FIG. 36 is a schematic diagram illustrating the state of infusion of an ink into the tank unit.

FIG. 35 is a schematic diagram illustrating the state of a tank unit according to a third embodiment, and FIG. 36 is a schematic diagram illustrating the state of infusion of an ink into the tank unit. FIGS. 35 and 36 illustrate the tank unit 4 without the cover 47 to make the internal state easy to understand.

As illustrated in FIG. 35, tanks 410 are capable of containing an ink 417 (FIG. 41) to be supplied to the liquid injection head 40 (FIG. 3). Each of the tanks 410 has one liquid containing chamber 429 capable of containing the ink 417, one liquid inlet portion 435 that is capable of pouring the ink 417 into the liquid containing chamber 429, and a visual-recognition wall 446 that faces the window 425 and is arranged on the X (+) direction side.

Each of the tanks 410 has one liquid inlet portion 435 and one liquid containing chamber 429. Accordingly, only one kind of ink 417 is to be contained in the tank 410, which keeps the ink 417 from being mixed with other kinds of color inks 417.

The liquid inlet portion 435 is provided on a first wall 461 (see FIG. 37) and has a cylindrical portion 437, an outer end 436 opened to the outside (one end of the cylindrical portion 437), and an inner end 438 opened in the liquid containing chamber 429 (the other end of the cylindrical portion 437). In the present embodiment, the inner end 438 is a portion of the liquid inlet portion 435 in contact with a first inclination portion 461A of the first wall 461, more specifically, an inner end of the first wall 461 (first inclination portion 461A) facing the liquid containing chamber 429.

The outer end 436 has an opening 436A, the inner end 438 has an opening 438A, and the cylindrical portion 437 has a through hole 437A that communicates with the opening 436A and the opening 438A. In other words, the liquid inlet portion 435 includes the cylindrical portion 437 that has the through hole 437A communicating with the opening 436A in the outer end 436 and the opening 438A in the inner end 438. The operator can pour the ink 417 from the liquid inlet portion 435 into the liquid containing chamber 429.

The opening 436A in the outer end 436 of the cylindrical portion 437 of the liquid inlet portion 435 protrudes from the first wall 461 in the Z (+) direction and is arranged to be higher than the first wall 461. Accordingly, the ink 417 is unlikely to leak from the opening 436A in the outer end 436 of the liquid inlet portion 435 as compared to the case where the opening 436A in the outer end 436 of the liquid inlet portion 435 is arranged to be lower than the first wall 461.

The visual-recognition wall (visual-recognition surface) 446 is formed from a light-permeable member. The visual-recognition wall 446 has an upper limit mark 448 and a lower limit mark 449. The upper limit mark 448 is an example of "upper limit line", which is a sign indicating the index for the upper limit for the amount of the ink 417 that is infusible into the liquid containing chamber 429. The lower limit mark 449 is a sign for prompting the user to pour the ink 417 into the liquid containing chamber 429.

The operator can grasp correctly the state of the ink 417 in the liquid containing chamber 429 by the upper limit mark 448 and the lower limit mark 449, and can refill properly the liquid containing chamber 429 with the ink 417. Specifically, when the liquid level 417A of the ink 417 (see FIG. 41) comes closer to the lower limit mark 449, the operator refills the liquid containing chamber 429 with the new ink 417 such that the liquid level 417A does not exceed the upper limit mark 448 as the index for the upper limit for the amount of the ink 417.

The visual-recognition wall 446 may have other signs indicating the information about the ink 417 as well as the upper limit mark 448 and the lower limit mark 449. For example, the visual-recognition wall 446 may have signs such as a scale indicating the amount of the ink 417 and symbols indicating the color of the ink 417.

In the use posture, when the visual-recognition wall 446 is seen from the direction orthogonal to the visual-recognition wall 446 (the X-axis direction), a center line V1 passing through the liquid inlet portion 435 is arranged at a position different from the position of a center line V2 passing through the upper limit mark 448 and the lower limit mark 449.

When the center line V2 of the upper limit mark 448 is arranged at a position different from the position of the center line V1 of the liquid inlet portion 435, the upper limit mark 448 is arranged at a position separated from the liquid inlet portion 435, and the upper limit mark 448 is easier to see at the time of infusion of the ink 417 from the liquid inlet portion 435. Accordingly, the operator will not pour the ink 417 beyond the upper limit mark 448. This prevents a trouble that the ink 417 flows out of the liquid inlet portion 435 and leaks to the outside.

Further, if the ink 417 flows out of the liquid inlet portion 435 at the time of supplying with the ink 417, the outflowing ink 417 runs in the Z (−) direction. Accordingly, arranging the center line V2 of the upper limit mark 448 at a position different from the position of the center line V1 of the liquid inlet portion 435 in the Y direction makes the upper limit mark 448 and the lower limit mark 449 unlikely to be stained with the leaking ink 417.

A side wall portion 407A of the housing 407 has a connecting portion 456, and a cap 453 is attached to the connecting portion 456. The cap 453 is rotatable with a supporting point at the connecting portion 456. The side wall portion 407A has a receiving pan 454.

When the predetermined ink 417 is contained in the liquid containing chamber 429 of the tank 410, the cap 453 seals the opening 436A in the outer end 436 of the liquid inlet portion 435 to suppress the evaporation of the ink 417 in the liquid containing chamber 429 as illustrated by two-dot chain lines in the drawing. To pour the ink 417 from the liquid inlet portion 435, the cap 453 is removed and placed on the receiving pan 454 as illustrated by solid lines in the drawing.

Although FIG. 35 illustrates one cap 453, the caps 453 are actually attached to the four tanks 410. That is, the number of the caps 453 in the present embodiment is four. The four caps 453 seal the openings 436A of the outer ends 436 of the liquid inlet portions 435 of the four tanks 410.

As illustrated in FIG. 36, in the printer 1, the ink 417 is poured (supplied) into any of the tanks 410 by a liquid pouring container 458. The liquid pouring container 458 has a nozzle part 459 that is capable of discharging the ink 417. The nozzle part 459 has a tubular structure. The ink 417 in the liquid pouring container 458 is discharged to the outside of the liquid pouring container 458 via the nozzle part 459.

With the cap 453 removed from the liquid inlet portion 435, the operator inserts the nozzle part 459 of the liquid pouring container 458 into the opening 436A of the outer end 436 of the liquid inlet portion 435 and then pours (supplies) the ink 417 in the liquid pouring container 458 into the tank 410.

Figure 37:
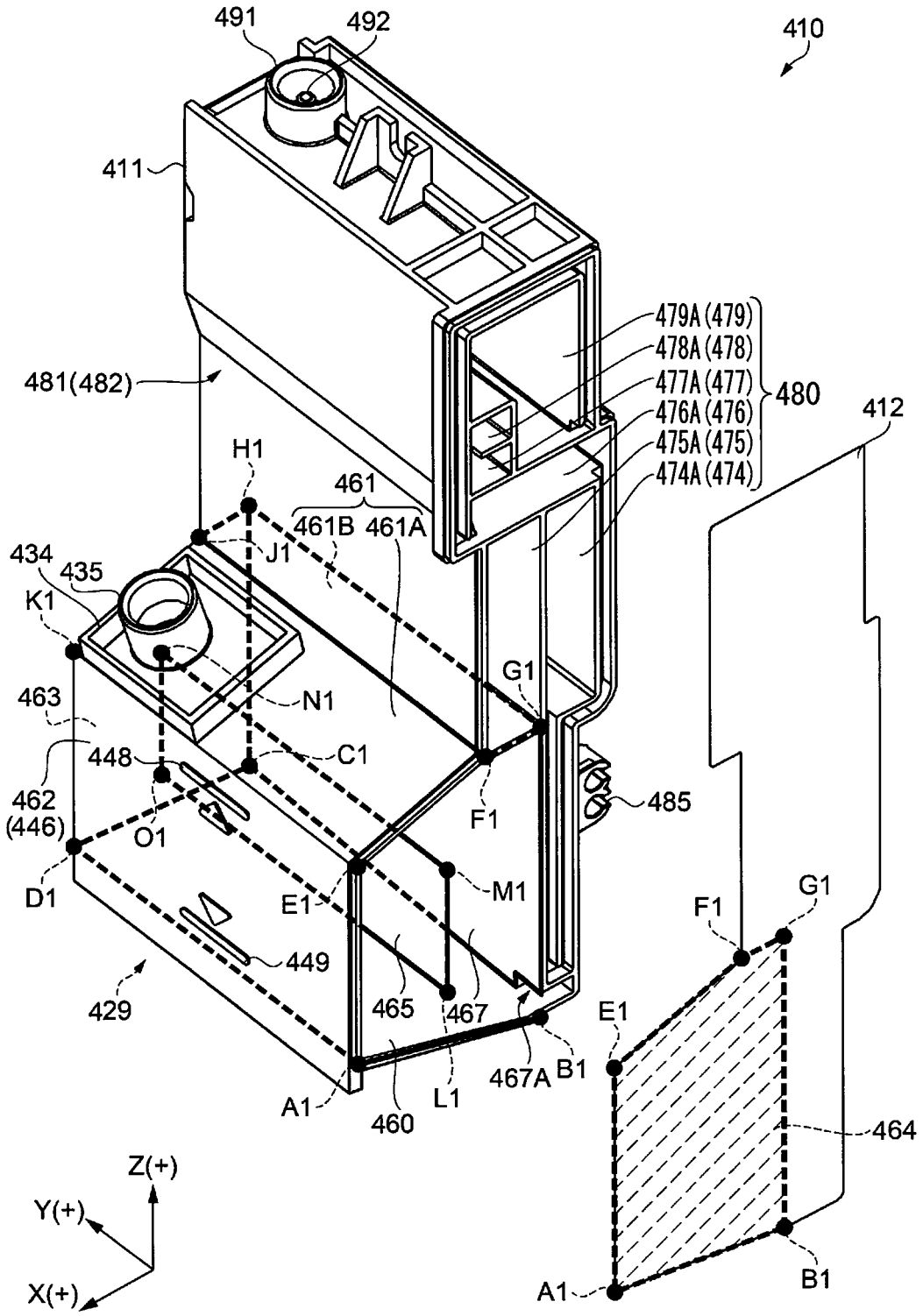
FIG. 37 is an exploded perspective view of a tank when a visual-recognition wall is seen from a high side.
Figure 38:
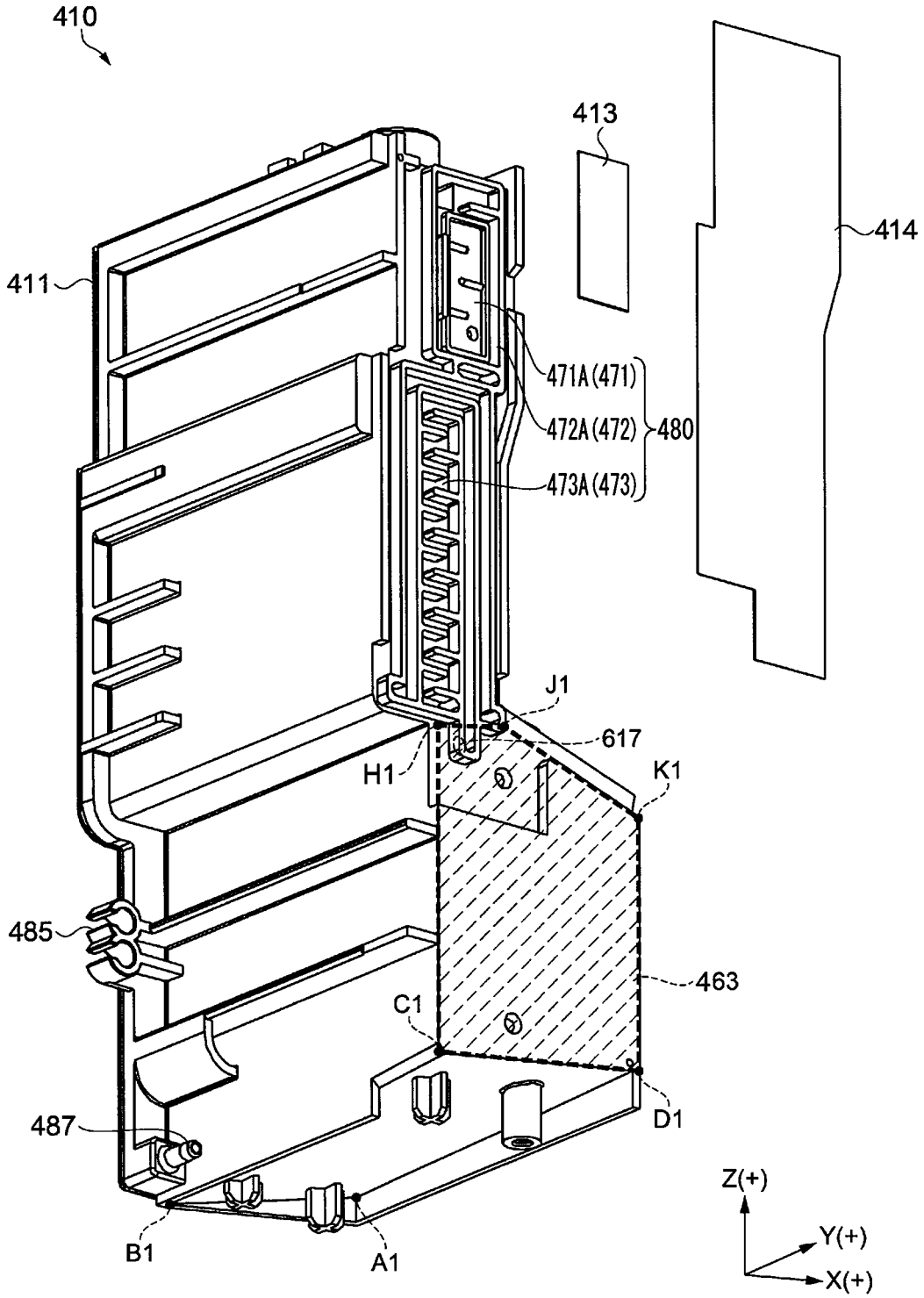
FIG. 38 is an exploded perspective view of the tank when a wall opposed to the visual-recognition wall is seen from a low side.
Figure 39:
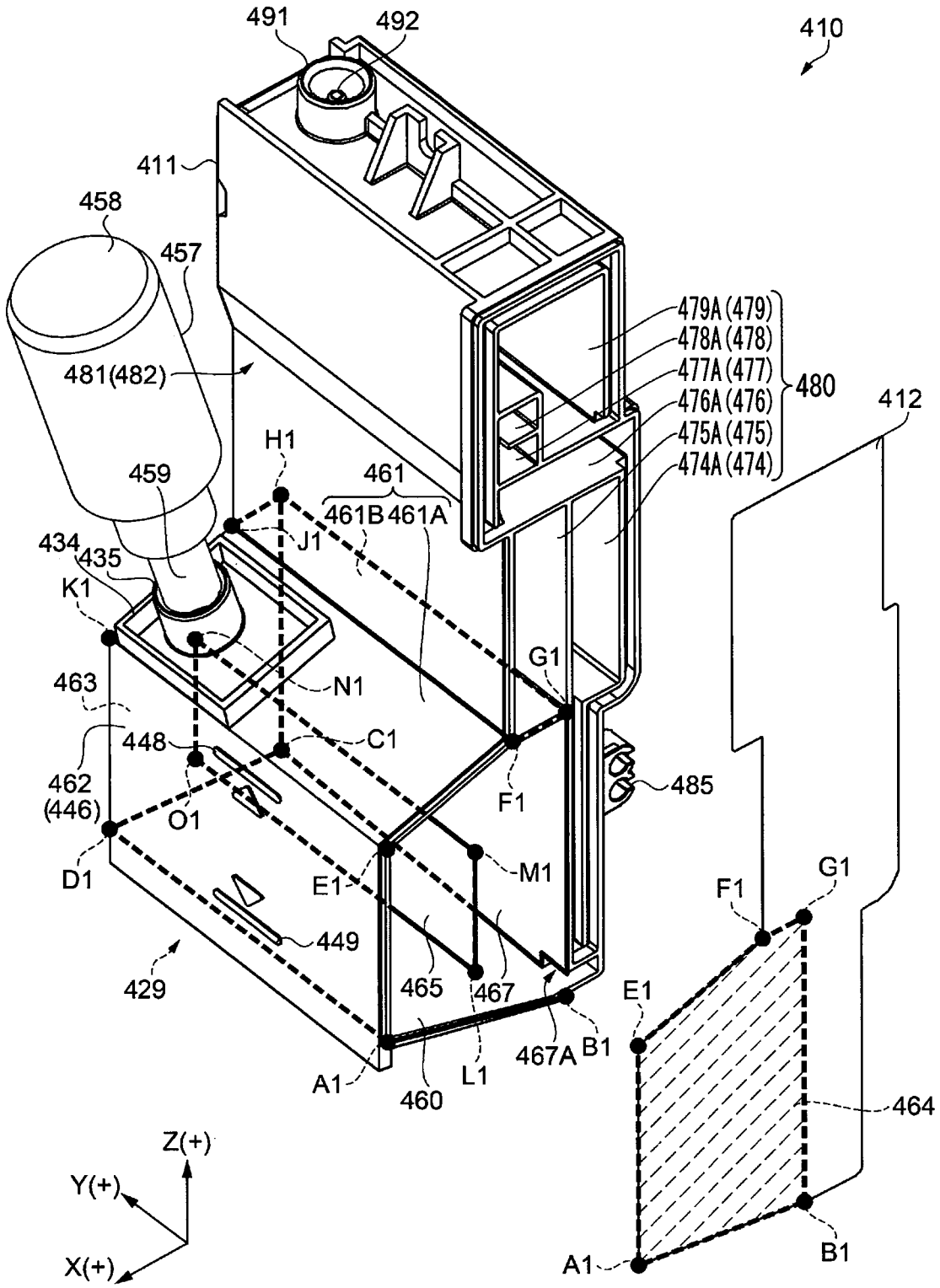
FIG. 39 is a diagram schematically illustrating the state of pouring an ink from a liquid pouring container into a liquid containing chamber.

FIG. 37 is an exploded perspective view of a liquid container when a visual-recognition wall is seen from a high side. FIG. 38 is an exploded perspective view of the liquid container when a wall opposed to the visual-recognition wall is seen from a low side. FIG. 38 is also an exploded perspective view of the tank 410 as seen from the direction opposite to the direction illustrated in FIG. 37. FIG. 39 is a diagram schematically illustrating the state of pouring the ink from the liquid pouring container into the liquid containing chamber, which corresponds to FIG. 37.

As illustrated in FIGS. 37 and 38, each of the tanks 410 includes a first member 411, a second member 412, a third member 413, and a fourth member 414.

The first member 411 constitutes the main unit of the tank 410 that is formed by molding a thermoplastic resin, for example. On the upper wall of the first member 411 on the Z (+) direction side, an air introduction part 492 and a cylindrical wall 491 surrounding the air introduction part 492 are provided (see FIG. 37).

The second member 412 is a resin film, for example, that is joined to the wall of the first member 411 on the Y (−) direction side, by welding, for example (see FIG. 37).

The third member 413 and the fourth member 414 are joined to the wall of the first member 411 on the Y (+) direction side, by welding, for example (see FIG. 38). The third member 413 is disposed between the first member 411 and the fourth member 414 to seal the concave portion 471 of the first member 411 that communicates with the air introduction part 492. The third member 413 is a water-proof breathable resin film made from a material low in liquid permeability and high in air permeability. The fourth member 414 is a resin film, for example.

On the wall of the first member 411 on the Y (+) direction side, provided are the concave portion 471 communicating with the air introduction part 492, a concave portion 472 surrounding the concave portion 471, and a concave portion 473 arranged on the Z (−) direction side of the concave portion 472 (see FIG. 38).

On the wall of the first member 411 on the Y (−) direction side, provided are a concave portion 474, a concave portion 475, a concave portion 476, a concave portion 477, a concave portion 478, and a concave portion 479 are provided from the wall of the first member 411 on the Z (−) direction side toward the wall of the first member 411 on the Z (+) direction side (along the Z (+) direction) (see FIG. 37).

The concave portion 471 of the first member 411 is sealed with the third member 413 to form a space 471A. The concave portions 472 and 473 of the first member 411 are sealed with the fourth member 414 to form spaces 472A and 473A (see FIG. 38).

The concave portions 474, 475, 476, 477, 478, and 479 of the first member are sealed with the second member 412 to form spaces 474A, 475A, 476A, 477A, 478A, and 479A (see FIG. 37).

The space 471A, the space 472A, the space 473A, the space 474A, the space 475A, the space 476A, the space 477A, the space 478A, and the space 479A communicate with one another to form a long air flow path. The air flow path formed by the space 471A, the space 472A, the space 473A, the space 474A, the space 475A, the space 476A, the space 477A, the space 478A, and the space 479A is an example of an "air chamber" that will be hereinafter called air chamber 480.

The space 471A, the space 472A, the space 473A, the space 474A, the space 475A, the space 476A, the space 477A, the space 478A, and the space 479A may communicate with each other in this order, or the space 471A, the space 479A, the space 472A, the space 478A, the space 473A, the space 477A, the space 476A, the space 474A, and the space 475A may communicate with each other in this order, for example. That is, the space 471A, the space 472A, the space 473A, the space 474A, the space 475A, the space 476A, the space 477A, the space 478A, and the space 479A can communicate with each other in an arbitrary order.

One side of the air chamber 480 communicates with the air introduction part 492, and the other side of the air chamber 480 communicates with the liquid containing chamber 429 via the communication hole 617 (see FIG. 38). That is, the air is introduced into the liquid containing chamber 429 through the air introduction part 492, the air chamber 480, and the communication hole 617.

The communication hole 617 allowing the air chamber 480 and the liquid containing chamber 429 to communicate with each other is provided closer to the fifth wall 467 than the liquid inlet portion 435.

The air chamber 480 has the role of suppressing the evaporation of the ink 417 contained in the liquid containing chamber 429 and suppressing the leakage of the ink 417 from the liquid containing chamber 29. Therefore, the air flow path in the air chamber 480 is preferably long. Accordingly, the space 471A, the space 472A, the space 473A, the space 474A, the space 475A, the space 476A, the space 477A, the space 478A, and the space 479A preferably communicate with each other so that the air flow path in the air chamber 480 becomes long.

The third member 413 provided in the air chamber 480 prevents the ink 417 contained in the liquid containing chamber 429 from leaking from the air introduction part 492.

The liquid containing chamber 429 is provided on the Z (−) direction side of the tank 410. The air chamber 480 is provided on the Z (+) direction side of the tank 410. That is, the tank 410 includes the air chamber 480 above the liquid containing chamber 429.

The air chamber 480 has a wall 481 positioned above the liquid inlet portion 435 (the liquid containing chamber 429). The wall 481 has a concave portion 482 that constitutes part of the wall of the first member 411 on the X (+) direction side and is recessed in the X (−) direction. The concave portion 482 is an example of a "concave portion" in the present application.

A tube hold part 485 is provided on the wall of the first member 411 on the X (−) direction side to hold the ink supply tube 43 (see FIG. 37). An ink supply part 487 is provided on the wall (the fifth wall 467) of the first member 411 on the Z (−) direction side (see FIG. 38). The ink supply part 487 communicates with the print part 42 by the ink supply tube 43.

As illustrated in FIG. 39, the concave portion 482 is separated from the side wall 457 of the liquid pouring container 458 when the ink 417 is poured from the liquid pouring container 458 for pouring the ink 417 into the liquid containing chamber 429 into the liquid inlet portion 435.

When the ink 417 is poured from the liquid pouring container 458 into the liquid inlet portion 435, the liquid pouring container 458 does not contact the wall 481 of the air chamber 480. Accordingly, the posture of the liquid pouring container 458 becomes stable so that the ink 417 can be stably poured into the liquid containing chamber 429. For example, it is possible to prevent the trouble that the posture of the liquid pouring container 458 does not become stable, it is difficult to pour stably the ink 417 into the liquid containing chamber 429, and thus the ink 417 leaks to the outside from the liquid inlet portion 435.

FIGS. 37 and 38 illustrate the liquid containing chamber 429 by thick solid lines or thick broken lines. Further, in FIGS. 37 and 38, reference signs A, B, C, D, E, G, H, and K are added to the portions (peak points) where the sides constituting the outer lines of the walls 461, 462, 463, 464, 465, 467 and the bottom wall 460 of the liquid containing chamber 29 cross each other so that the shapes and positions of the walls 461, 462, 463, 464, 465, 467 and the bottom wall 460 can be easily understood. Hereinafter, the peak points of the walls 461, 462, 463, 464, 465, 467 and the bottom wall 460 will be called points A, B, C, D, E, G, H, and K.

Next, an overview of the liquid containing chamber 429 will be provided with reference to FIGS. 37 and 38.

The liquid containing chamber 429 has the first wall 461, the second wall 462, the third wall 463, the fourth wall 464, the reinforcement wall 465, the fifth wall 467, and the bottom wall 460 (see FIG. 37).

The first wall 461 defines the liquid containing chamber 429 and is arranged on the Z (+) direction side of the liquid containing chamber 429. The second wall 462 is arranged on the X (+) direction side of the liquid containing chamber 429. The third wall 463 is arranged on the Y (+) direction side of the liquid containing chamber 429. The fourth wall 464 is arranged on the Y (−) direction side of the liquid containing chamber 429. The fifth wall 467 is arranged on the X (−) direction side of the liquid containing chamber 429. The bottom wall 460 is arranged on the Z (−) direction side of the liquid containing chamber 429.

In the use posture, the bottom wall 460 constitutes the bottom surface (the lowest surface) of the liquid containing chamber 429.

The first wall 461, the second wall 462, the third wall 463, the fifth wall 467, and the bottom wall 460 constitute part of the first member 411, which are constituent elements of the first member 411. In the drawing, the fourth wall 464 is a hatched portion of the second member 412, which is a constituent element of the second member 412. The ink 417 is contained in the space surrounded by the first wall 461, the second wall 462, the third wall 463, the fourth wall 464, the fifth wall 467, and the bottom wall 460.

More specifically, the portion surrounded by a point E1, a point G1, a point H1, and a point K1 constitutes the first wall 461. The first wall 461 includes a first inclination portion 461A that is arranged outside (the X (+) direction side) with respect to the wall 481 and a flat portion 461B that is arranged inside (the X (−) direction side) with respect to the wall 481. The first inclination portion 461A is a portion that is surrounded by the point E1, a point F1, a point J1, and the point K1, and is arranged on the second wall 462 side. The flat portion 461B is a portion that is surrounded by the point F1, the point G1, the point H1, and the point J1 and is arranged on the fifth wall 467 side.

In the present embodiment, the first wall 461 includes the first inclination portion 461A described above. The first wall 461 may not be inclined but may be flat on the whole (with no difference in height in the Z-axis direction). In the present embodiment, the first wall 461 includes the first inclination portion 461A and the flat portion 461B. However, the first wall 461 may not include the flat portion 461B but the entire first wall 461 may be an inclination portion with a difference in height in the Z-axis direction.

The points E1 and K1 in the first inclination portion 461A are lower than the points F1 and J1 in the first inclination portion 461A. The first inclination portion 461A is lower on the second wall 462 side. That is, the first inclination portion 461A is inclined such that the second wall 462 side is lower. The first inclination portion 461A has the liquid inlet portion 435 that protrudes in the Z (+) direction. The liquid inlet portion 435 is provided on the second wall 462 side of the first inclination portion 461A.

As described above, the liquid containing chamber 429 has the second wall 462 that extends in a direction crossing the first wall 461, the first wall 461 has the first inclination portion 461A that is inclined such that the second wall 462 side is lower, and the liquid inlet portion 435 is provided on the second wall 462 side (the first inclination portion 461A) of the first wall 461.

The first inclination portion 461A further has a liquid leakage prevention wall 434 that surrounds the liquid inlet portion 435. Specifically, the first wall 461 (the first inclination portion 461A) has the liquid leakage prevention wall 434 that protrudes at a position separated from the liquid inlet portion 435 and prevents leakage of the ink 417 from the liquid inlet portion 435.

For example, when the ink 417 leaks from the liquid inlet portion 435 to the outside because the operator did not pour properly the ink 417 from the liquid pouring container 458 into the liquid inlet portion 435, the leaking ink 417 is blocked by the liquid leakage prevention wall 434. Accordingly, it is possible to prevent the leaking ink 417 from flowing to the outside of the liquid leakage prevention wall 434.

The liquid leakage prevention wall 434 is provided outside the liquid inlet portion 435. The height of the liquid leakage prevention wall 434 from the first wall 461 may be smaller than the liquid inlet portion 435, may be identical to the liquid inlet portion 435, or may be larger than the liquid inlet portion 435. The liquid leakage prevention wall 434 has a square shape but may be a donut shape or any other shape, for example.

The portion surrounded by the point A1, the point E1, the point K1, and a point D1 constitutes the second wall 462. The second wall 462 extends in a direction crossing the first wall 461, the third wall 463, the fourth wall 464, and the bottom wall 460. The second wall 462 is the visual-recognition wall 446 through which the liquid level in the liquid containing chamber 429 can be seen from the outside. The second wall 462 is formed from a light-permeable member.

Specifically, the second wall 462 constitutes the visual-recognition wall 446 that has the upper limit mark 448 indicating the index for the upper limit of amount of the ink 417 infusible into the liquid containing chamber 429 and allows the liquid level 417A in the liquid containing chamber 429 to be seen from the outside.

The portion surrounded by the point D1, the point C1, the point H1, and the point K1 constitutes the third wall 463. The third wall 463 extends in a direction crossing the first wall 461, the second wall 462, the fifth wall 467, and the bottom wall 460 (see FIG. 37). The portion of the first member 411 hatched by oblique broken lines constitutes the third wall 463 (see FIG. 38).

The portion surrounded by the point A1, the point B1, the point G1, and the point E1, that is, the portion of the second member 412 hatched by broken lines constitutes the fourth wall 464. The fourth wall 464 is opposed to the third wall 463 and extends in a direction crossing the first wall 461, the second wall 462, and the bottom wall 460 (see FIG. 37).

The portion surrounded by the point B1, the point G1, the point H1, and the point C1 constitutes the fifth wall 467. The fifth wall 467 is opposed to the second wall 462 and extends in a direction crossing the first wall 461, the third wall 463, the fourth wall 464, and the bottom wall 460 (see FIG. 37). The fifth wall 467 has an opening 467A on the Z (−) direction side of the portion crossing the fourth wall 464.

In the use posture, the opening 467A is provided at the lowest portion of the liquid containing chamber 429. The opening 467A communicates with the ink supply part 487. Specifically, the ink 417 contained in the liquid containing chamber 429 is supplied to the print part 42 through the opening 467A, the ink supply part 487, and the ink supply tube 43.

The portion surrounded by the point L1, the point M1, the point N1, and the point O1 is the reinforcement wall 465. The reinforcement wall 465 is opposed to the second wall 462 and is arranged between the second wall 462 and the fifth wall 467. The reinforcement wall 465 is not in contact with the second wall 462, the fifth wall 467, and the bottom wall 460 but has clearances from the second wall 462, the fifth wall 467, and the bottom wall 460. One end of the reinforcement wall 465 is in contact with the third wall 463, and the other end of the reinforcement wall 465 is in contact with the fourth wall 464.

In the first member 411, the reinforcement wall 465 is a wall extending in the Y direction with reference to the third wall 463 and has clearances from the second wall 462, the fifth wall 467, and the bottom wall 460. When the second member 412 is joined to the first member 411, the other end of the reinforcement wall 465 is arranged in contact with the fourth wall 464 (the second member 412) to support the fourth wall 464 (the second member 412).

The reinforcement wall 465 may not be provided.

The portion surrounded by the point A1, the point B1, the point C1, and the point D1 constitutes the bottom wall 460. The bottom wall 460 is opposed to the first wall 461 and extends in a direction crossing the second wall 462, the third wall 463, the fourth wall 464, and the fifth wall 467 (see FIG. 37).

In the bottom wall 460, the point A1, the point C1, and the point D1 are higher than the point B1.

The point A1 and the point D1 are arranged on the second wall 462 side, and the point B1 is arranged on the fifth wall 467 side. Accordingly, the bottom wall 460 is higher on the second wall 462 side. Accordingly, the bottom wall 460 is inclined such that the second wall 462 side is higher and the fifth wall 467 side is lower. That is, the bottom wall 460 has a second inclination portion inclined such that the second wall 462 side is higher.

In other words, the liquid containing chamber 429 has the second wall 462 that extends in the direction crossing the first wall 461 and the bottom wall 460 that extends in the direction crossing the second wall 462 and is opposed to the first wall 461, and the bottom wall 460 has the second inclination portion inclined such that the second wall 462 side is higher.

The point C1 and the point D1 are arranged on the third wall 463 side, and the point B1 is arranged on the fourth wall 464 side. Accordingly, the bottom wall 460 is higher on the third wall 463 side and lower on the fourth wall 464 side. That is, the bottom wall 460 has a third inclination portion inclined from the third wall 463 to the fourth wall 464 such that the fourth wall 464 side is lower.

In other words, the liquid containing chamber 429 has the third wall 463 that extends in the direction crossing the first wall 461, the second wall 462, and the bottom wall 460 and the fourth wall 464 that is opposed to the third wall 463, and the bottom wall 460 has the third inclination portion inclined from the third wall 463 to the fourth wall 464 such that the fourth wall 464 side is lower.

The opening 467A is an outlet of the ink 417 in the liquid containing chamber 429 for supplying the ink 417 to the ink supply part 487, which is provided at the lowest portion of the liquid containing chamber 429. Accordingly, the bottom wall 460 is inclined to be lower with increasing proximity to the opening 467A and higher with decreasing proximity to the opening 467A.

Arranging the opening 467A as an outlet of the ink 417 at the lowest portion of the liquid containing chamber 429 makes the ink 417 in the liquid containing chamber 429 likely to be discharged from the opening 467A. This prevents waste of the ink 417 left in the liquid containing chamber 429, for example.

Figure 40:
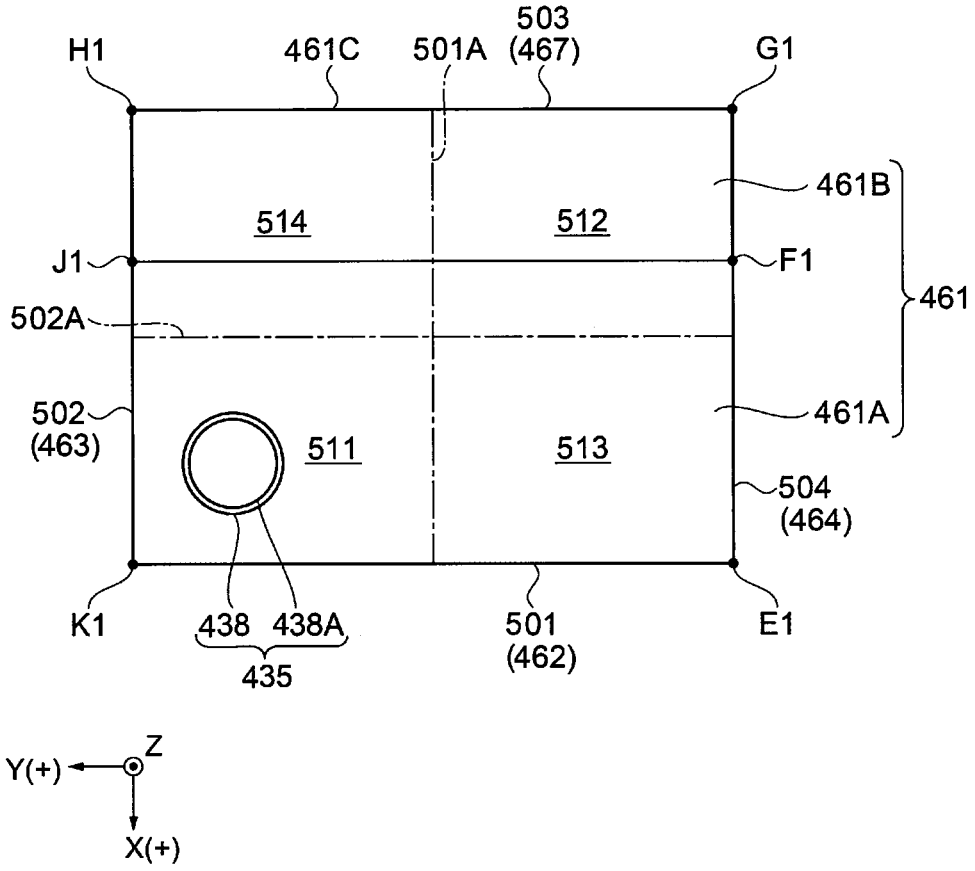
FIG. 40 is a schematic plane view of a first wall that is projected onto a horizontal plane in a use posture.
Figure 41:
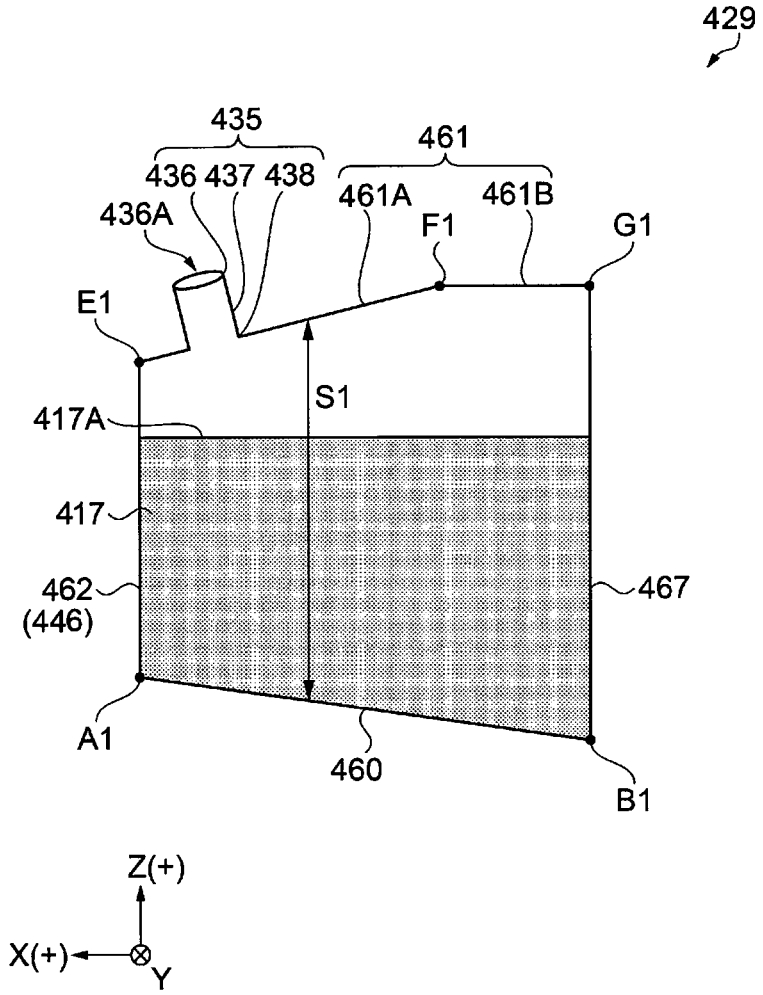
FIG. 41 is a schematic view of the tank seen in a direction from a fourth wall toward a third wall in the use posture.
Figure 42:
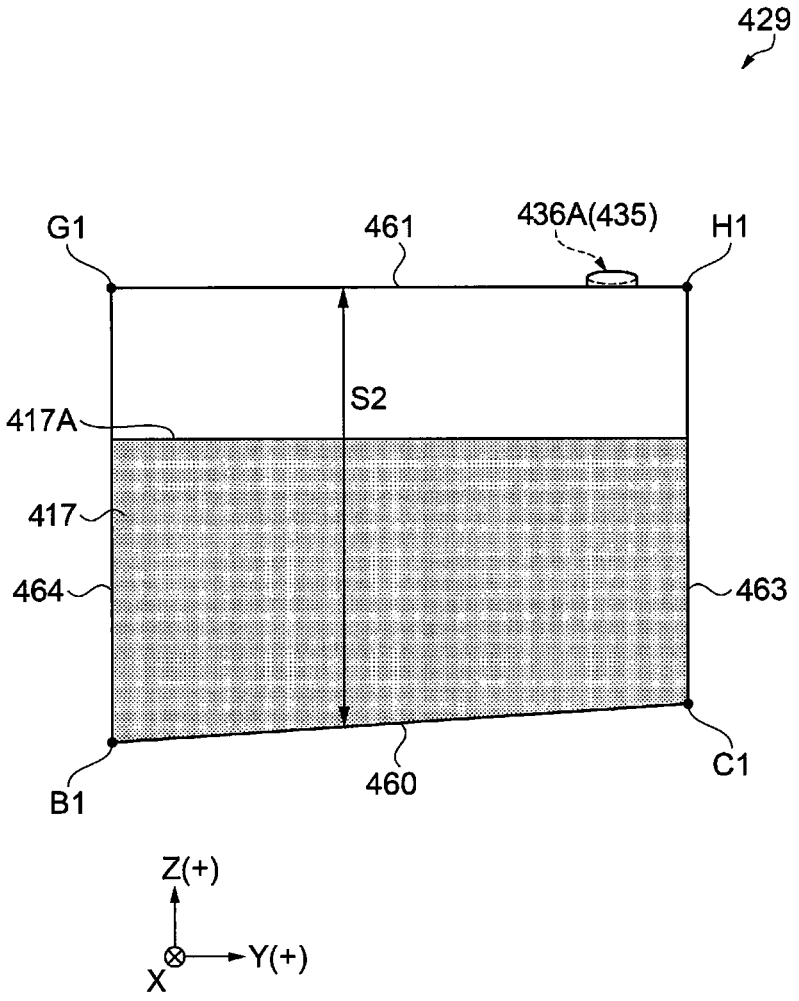
FIG. 42 is a schematic view of the tank seen in a direction from a fifth wall toward a second wall in the use posture.
Figure 43:
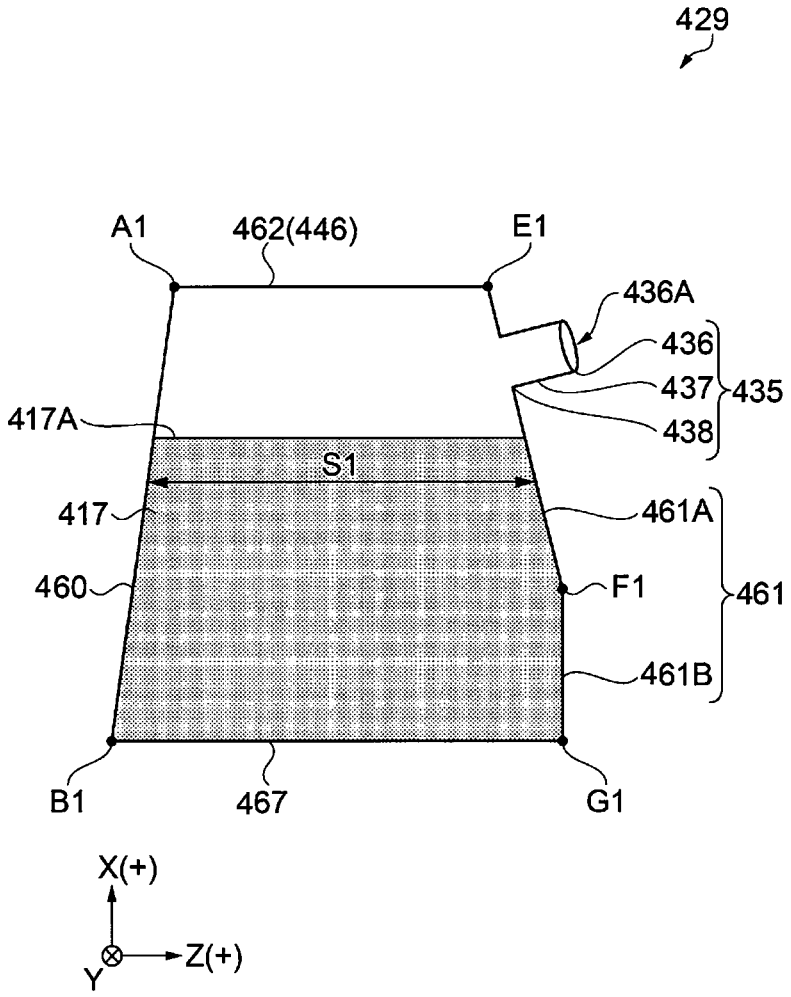
FIG. 43 is a schematic view of the tank having fallen down in a clockwise direction from the state illustrated in FIG. 41.
Figure 44:
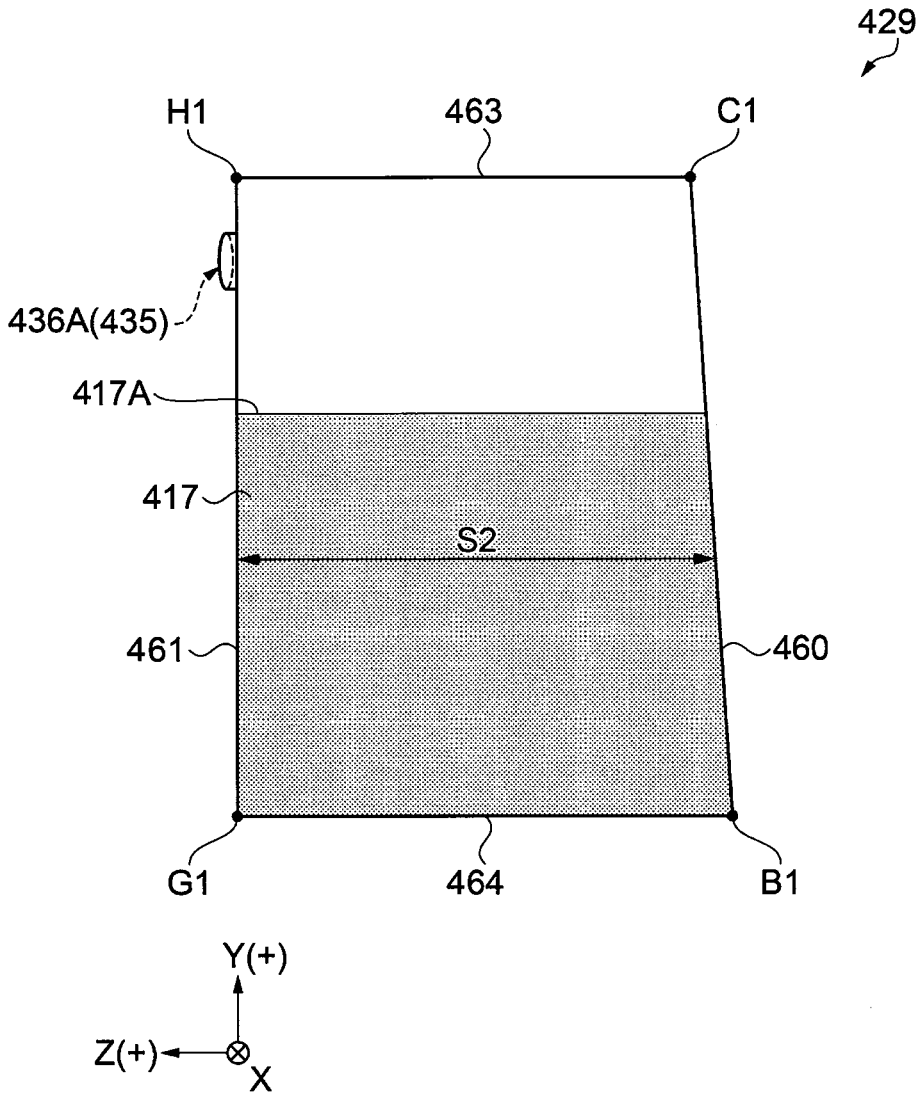
FIG. 44 is a schematic view of the tank having fallen down in a counterclockwise direction from the state illustrated in FIG. 42.

FIG. 40 is a schematic plane view of the first wall 461 that is projected onto a horizontal plane (XY plane) in the use posture. FIG. 41 is a schematic view of the liquid container seen in a direction from the fourth wall toward the third wall in the use posture. FIG. 42 is a schematic view of the liquid container seen in a direction from the fifth wall toward the second wall in the use posture. FIG. 43 is a schematic view of the liquid container having fallen down in a clockwise direction from the state illustrated in FIG. 41. FIG. 44 is a schematic view of the liquid container having fallen down in a counterclockwise direction from the state illustrated in FIG. 42.

FIGS. 41 and 43 illustrate the bottom wall 460 and the walls 461, 462, and 467 but do not illustrate the other walls 463, 464, and 465. FIGS. 42 and 44 illustrate the bottom wall 460 and the walls 461, 463, and 464 but do not illustrate the other walls 462, 465, and 467. FIGS. 41 to 44 illustrate the state in which the ink 417 is poured in the liquid containing chamber 429 close to the upper limit mark 448.

In the following description, the posture of the tank 410 having fallen down as illustrated in FIG. 43 will be called first falling posture. That is, the first falling posture is the posture of the liquid containing chamber 429 with the fifth wall 467 on the bottom surface (the lowest surface). In addition, the posture of the tank 410 having fallen down as illustrated in FIG. 44 will be called second falling posture. That is, the second falling posture is the posture of the liquid containing chamber 429 with the fourth wall 464 on the bottom surface (the lowest surface).

Specifically, as illustrated in FIG. 40, when the first wall 461 in the use posture is projected onto a horizontal plane (XY plane), the first wall 461 forms a quadrilateral 461C that has a first side 501, a second side 502 crossing the first side 501, a third side 503 opposed to the first side 501, and a fourth side 504 opposed to the second side 502. That is, the first wall 461 forms the quadrilateral 461C that has the first side 501 and the second side 502 crossing the first side 501.

The first side 501 is the side where the first wall 461 and the second wall 462 cross each other. The second side 502 is the side where the first wall 461 and the third wall 463 cross each other. The third side 503 is the side where the first wall 461 and the fifth wall 467 cross each other. The fourth side 504 is the side where the first wall 461 and the fourth wall 464 cross each other.

The quadrilateral 461C is divided into four regions by a first center line 501A passing through the center of the first side 501 and a second center line 502A passing through the center of the second side 502. The first center line 501A and the second center line 502A are indicated by one-dot chain lines in the drawing.

Specifically, the quadrilateral 461C has a first region 511, a second region 512, a third region 513, and a fourth region 514 that are defined by the first center line 501A and the second center line 502A.

The first region 511 is a region surrounded by the first center line 501A, the second center line 502A, the second wall 462, and the third wall 463. The first region 511 is arranged on the first wall 461 on the side closer to the second wall 462 and the third wall 463.

The second region 512 is a region surrounded by the first center line 501A, the second center line 502A, the fourth wall 464, and the fifth wall 467. The second region 512 is arranged on the first wall 461 on the side closer to the fourth wall 464 and the fifth wall 467.

The third region 513 is a region surrounded by the first center line 501A, the second center line 502A, the second wall 462, and the fourth wall 464. The third region 513 is arranged on the first wall 461 on the side closer to the second wall 462 and the fourth wall 464.

The fourth region 514 is a region surrounded by the first center line 501A, the second center line 502A, the third wall 463, and the fifth wall 467. The fourth region 514 is arranged on the first wall 461 on the side closer to the third wall 463 and the fifth wall 467.

The liquid inlet portion 435 is provided such that the inner end 438 is arranged in any of the four regions 511, 512, 513, and 514. In the present embodiment, the liquid inlet portion 435 is provided such that the inner end 438 is arranged in the first region 511 out of the four regions 511, 512, 513, and 514. That is, the liquid inlet portion 435 is provided on the first wall 461 on the side closer to the third wall 463 than the fourth wall 464 and on the side closer to the second wall 462 than the fifth wall 467.

As illustrated in FIGS. 41 and 42, in the use posture, the bottom wall 460 is arranged at the lowest position, and the first wall 461 and the opening 436A in the liquid inlet portion 435 are arranged at high positions. Accordingly, the ink 417 in the liquid containing chamber 429 is unlikely to leak from the opening 436A in the liquid inlet portion 435.

As illustrated in FIG. 41, the first wall 461 has the first inclination portion 461A inclined such that the second wall 462 side is lower. Accordingly, the first wall 461 is lower with increasing proximity to the second wall 462 and is higher with increasing proximity to the fifth wall 467. The bottom wall 460 opposing to the first wall 461 has the second inclination portion inclined such that the second wall 462 side is higher. Accordingly, the bottom wall 460 is higher with increasing proximity to the second wall 462 and is lower with increasing proximity to the fifth wall 467. Accordingly, a distance S1 between the bottom wall 460 and the first wall 461 is lengthened from the second wall 462 toward the fifth wall 467. Therefore, the liquid containing chamber 429 is widened from the second wall 462 toward the fifth wall 467.

As illustrated in FIG. 42, the bottom wall 460 has the third inclination portion inclined from the third wall 463 toward the fourth wall 464 such that the fourth wall 464 side is lower. Accordingly, the bottom wall 460 is higher with increasing proximity to the third wall 463 and is lower with increasing proximity to the fourth wall 464. Accordingly, a distance S2 between the bottom wall 460 and the first wall 461 is lengthened from the third wall 463 toward the fourth wall 464. Therefore, the liquid containing chamber 429 is widened from the third wall 463 toward the fourth wall 464.

When the tank 410 falls down due to a trouble such as improper infusion of the ink 417 into the tank 410 or improper movement of the printer 1, if the liquid inlet portion 435 is arranged in the center of the quadrilateral 461C (the crossing portion between the first center line 501A and the second center line 502A) and the ink 417 is poured into the liquid containing chamber 429 near the upper limit mark 448, the liquid level 417A of the ink 417 will become higher than the opening 436A in the liquid inlet portion 435 so that the ink 417 will leak from the opening 436A in the liquid inlet portion 435.

As illustrated in FIG. 43, in the first falling posture, the fifth wall 467 becomes the bottom surface (the lowest surface) and the second wall 462 becomes the top surface (the highest surface). The liquid inlet portion 435 is provided on the side closer to the second wall 462 and thus is arranged at a high position together with the second wall 462.

In addition, the liquid containing chamber 429 is widened from the second wall 462 toward the fifth wall 467, which allows the liquid level 417A of the ink 417 to be kept low as compared to the case in which the liquid containing chamber 429 is widened from the fifth wall 467 toward the second wall 462.

Therefore, the opening 436A in the liquid inlet portion 435 is arranged at a high position and the liquid level 417A of the ink 417 is kept low, which makes the ink 417 unlikely to leak from the opening 436A in the liquid inlet portion 435.

As illustrated in FIG. 44, in the second falling posture, the fourth wall 464 becomes the bottom surface (the lowest surface) and the third wall 463 becomes the top surface (the highest surface). The liquid inlet portion 435 is provided on the side closer to the third wall 463 and thus is arranged at a high position together with the third wall 463.

Further, the liquid containing chamber 429 is widened from the third wall 463 toward the fourth wall 464, which allows the liquid level 417A of the ink 417 to be kept low as compared to the case in which the liquid containing chamber 429 is widened from the fourth wall 464 toward the third wall 463.

Therefore, the opening 436A in the liquid inlet portion 435 is arranged at a high position and the liquid level 417A of the ink 417 is kept low, which makes the ink 417 unlikely to leak from the opening 436A in the liquid inlet portion 435.

Although not illustrated, the communication hole 617 allowing the air chamber 480 and the liquid containing chamber 429 to communicate with each other is provided closer to the fifth wall 467 than the liquid inlet portion 435. Accordingly, if the liquid containing chamber 429 falls down such that the fifth wall 467 becomes the bottom surface of the liquid containing chamber 429, the ink 417 in the liquid containing chamber 429 moves to the air chamber 480 via the communication hole 617. This reduces the risk that the ink 417 leaks from the opening 436A in the liquid inlet portion 435.

As described above, when the liquid inlet portion 435 is positioned in the center of the quadrilateral 461C, the ink 417 becomes likely to leak from the opening 436A in the liquid inlet portion 435 in both the first falling posture and the second falling posture. In the present embodiment, providing the liquid inlet portion 435 in the first region 511 of the quadrilateral 461C makes the ink 417 unlikely to leak from the opening 436A in the liquid inlet portion 435 in both the first falling posture and the second falling posture.

Figure 45:
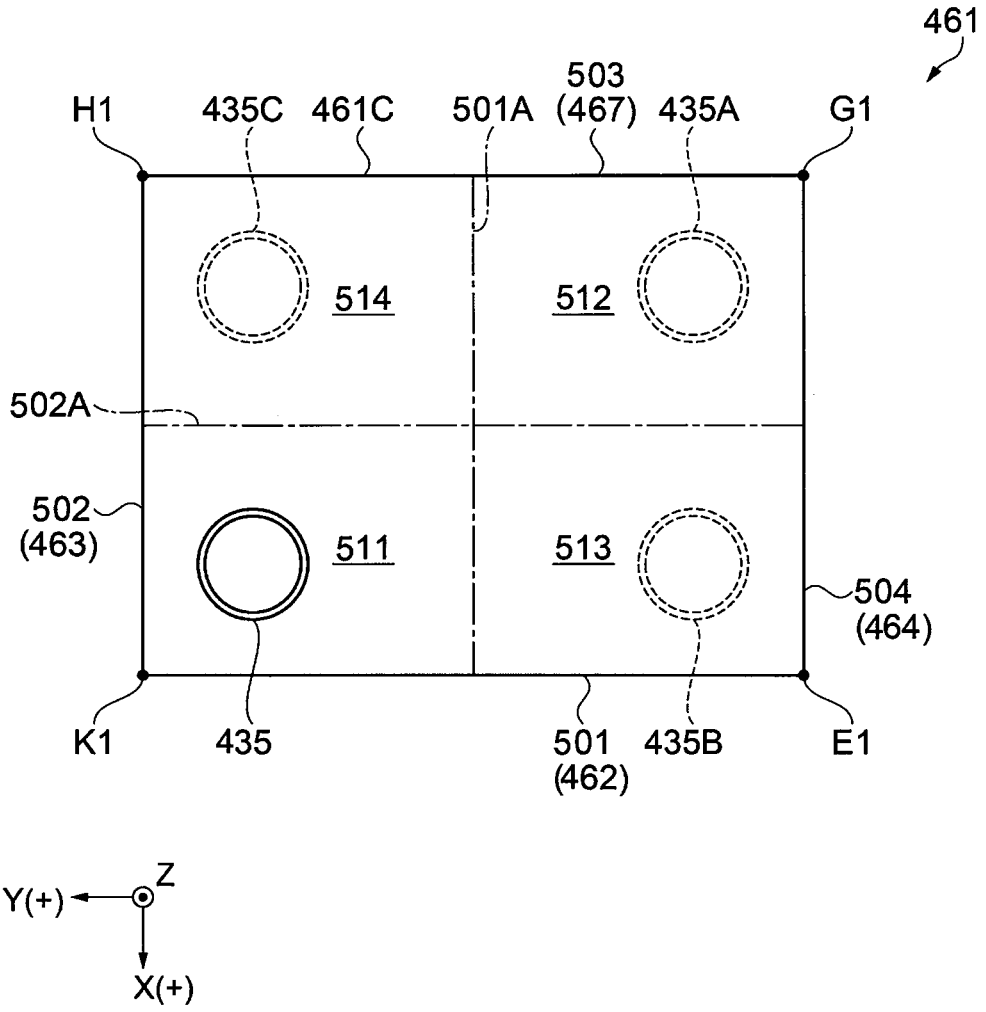
FIG. 45 is a schematic view of preferred arrangement positions of liquid inlet portions.

FIG. 45 is a schematic view of preferred arrangement positions of the liquid inlet portions, which corresponds to FIG. 40. FIG. 45 illustrates the arrangement position of the liquid inlet portion 435 in the present embodiment by solid lines and illustrates the arrangement positions of other preferred liquid inlet portions 435A, 435B, and 435C by broken lines.

As illustrated in FIG. 45, the liquid inlet portion 435 arranged in the first region 511 in the present embodiment is separated from the fourth wall 464 and the fifth wall 467. Accordingly, in the first falling posture in which the fifth wall 467 becomes the bottom surface and the second falling posture in which the fourth wall 464 becomes the bottom surface, the liquid inlet portion 435 is arranged at a high position to make the ink 417 unlikely to leak from the liquid inlet portion 435.

When the liquid inlet portion 435A indicated by broken lines in the drawing is arranged in the second region 512, the liquid inlet portion 435A is separated from the second wall 462 and the third wall 463. Accordingly, in the falling posture in which the second wall 462 becomes the bottom surface (hereinafter, called third falling posture) and the falling posture in which the third wall 463 becomes the bottom surface (hereinafter, called fourth falling posture), the liquid inlet portion 435A is arranged at a high position to make the ink 417 unlikely to leak from the liquid inlet portion 435A.

When the liquid inlet portion 435B indicated by broken lines in the drawing is arranged in the third region 513, the liquid inlet portion 435B is separated from the third wall 463 and the fifth wall 467. Accordingly, in the fourth falling posture in which the third wall 463 becomes the bottom surface and the first falling posture in which the fifth wall 467 becomes the bottom surface, the liquid inlet portion 435B is arranged at a high position to make the ink 417 unlikely to leak from the liquid inlet portion 435B.

When the liquid inlet portion 435C indicated by broken lines in the drawing is arranged in the fourth region 514, the liquid inlet portion 435C is separated from the second wall 462 and the fourth wall 464. Accordingly, in the third falling posture in which the second wall 462 becomes the bottom surface and the second falling posture in which the fourth wall 464 becomes the bottom surface, the liquid inlet portion 435C is arranged at a high position to make the ink 417 unlikely to leak from the liquid inlet portion 435C.

In this way, arranging the liquid inlet portion 435 in any of the first region 511 to the fourth region 514 of the quadrilateral 461C makes the ink 417 unlikely to leak in any of the first falling posture to the fourth falling posture.

Therefore, in the liquid inlet portion 435, the inner end 438 is preferably arranged in any of the four regions (the first region 511 to the fourth region 514).

As described above, the print unit 3 has the liquid injection head 40 and the tanks 410 capable of containing the inks 417 to be supplied to the liquid injection head 40.

Each of the tanks 410 includes the liquid containing chamber 429 capable of containing the ink 417 and the liquid inlet portion 435 capable of pouring the ink 417 into the liquid containing chamber 429. The liquid inlet portion 435 is formed on the first wall 461 defining the liquid containing chamber 429 and has the outer end 436 opened to the outside and the inner end 438 opened in the liquid containing chamber 429. When the first wall 461 in the use posture is projected onto a horizontal plane, the first wall 461 has a shape of the quadrilateral 461C having the first side 501 and the second side 502 crossing the first side 501. The quadrilateral 461C is divided into the four regions 511, 512, 513, and 514 by the first center line 501A passing through the center of the first side 501 and the second center line 502A passing through the center of the second side 502. The inner end 438 of the liquid inlet portion 435 is arranged in any of the four regions 511, 512, 513, and 514 (the first region 511 in the present embodiment).

Further, the first wall 461 has the liquid leakage prevention wall 434 that protrudes at a position separated from the liquid inlet portion 435 and surrounds the liquid inlet portion 435.

According to this configuration, in the print unit 3, the ink 417 is unlikely to leak from the liquid inlet portion 435 even when the tank 410 falls down due to improper infusion of the ink 417 into the tank 410 or improper movement of the printer 1. If the ink 417 leaks from the liquid inlet portion 435, the leaking ink 417 is blocked by the liquid leakage prevention wall 434 to prevent the ink 417 from flowing to the outside of the liquid leakage prevention wall 434.

Therefore, it is possible to suppress loss of the ink 417 leaking from the liquid inlet portion 435 to the outside and harmful effects of the ink 417 leaking from the liquid inlet portion 435 to the outside (for example, a malfunction resulting from ink stains). This achieves the print unit 3 that operates in a stable manner while suppressing waste of the ink 417.

D. Fourth Embodiment

Figure 46:
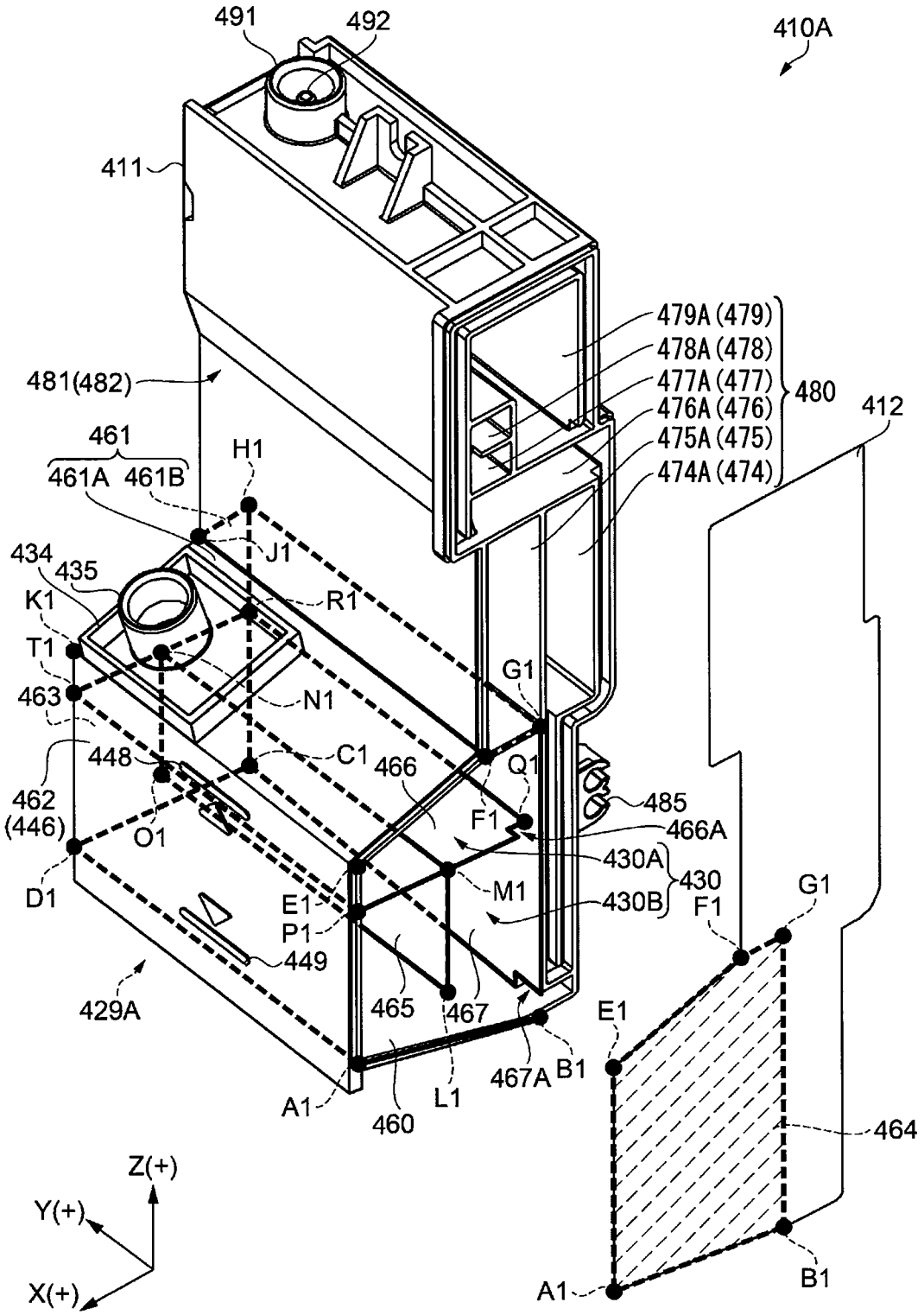
FIG. 46 is an exploded perspective view of a tank in a printer according to a fourth embodiment.
Figure 47:
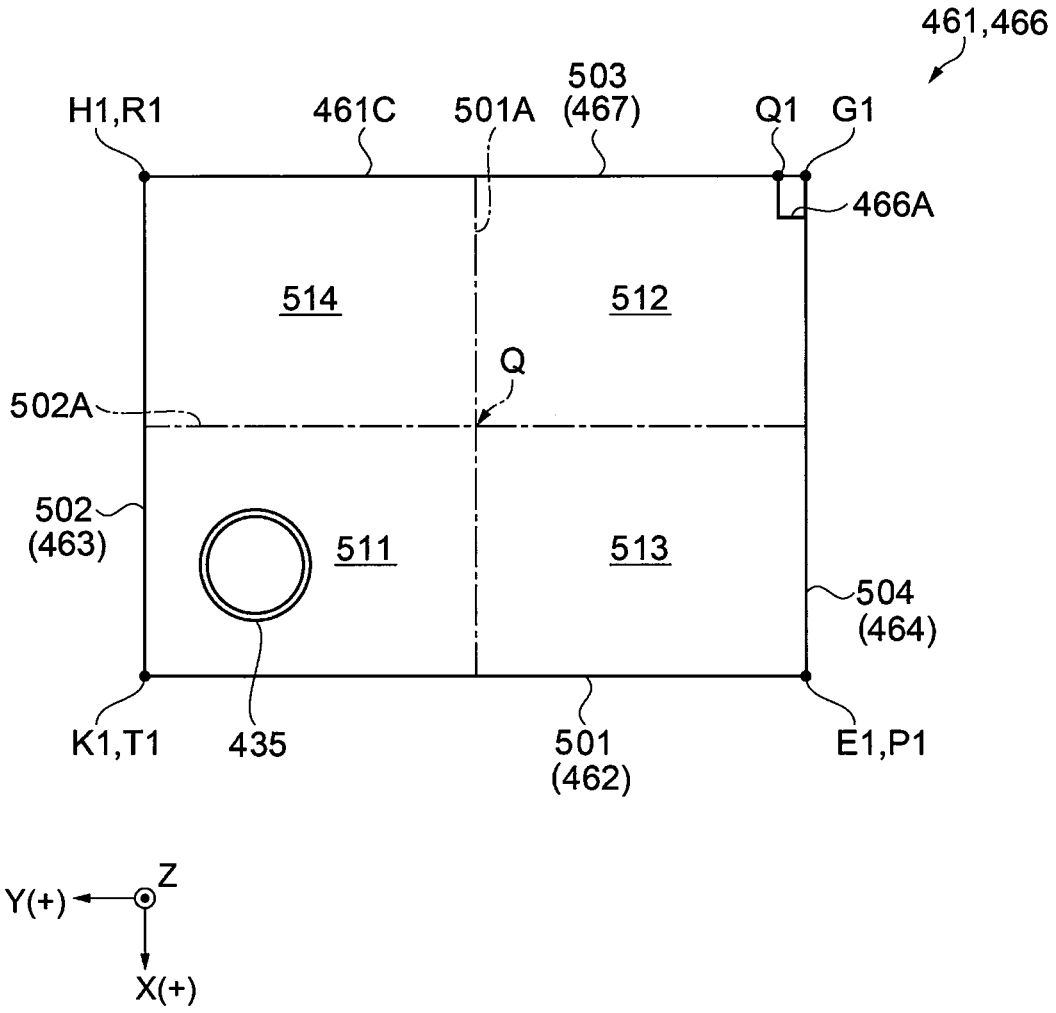
FIG. 47 is a schematic view of a first wall and a sixth wall that are projected onto a horizontal plane in the use posture.
Figure 48:
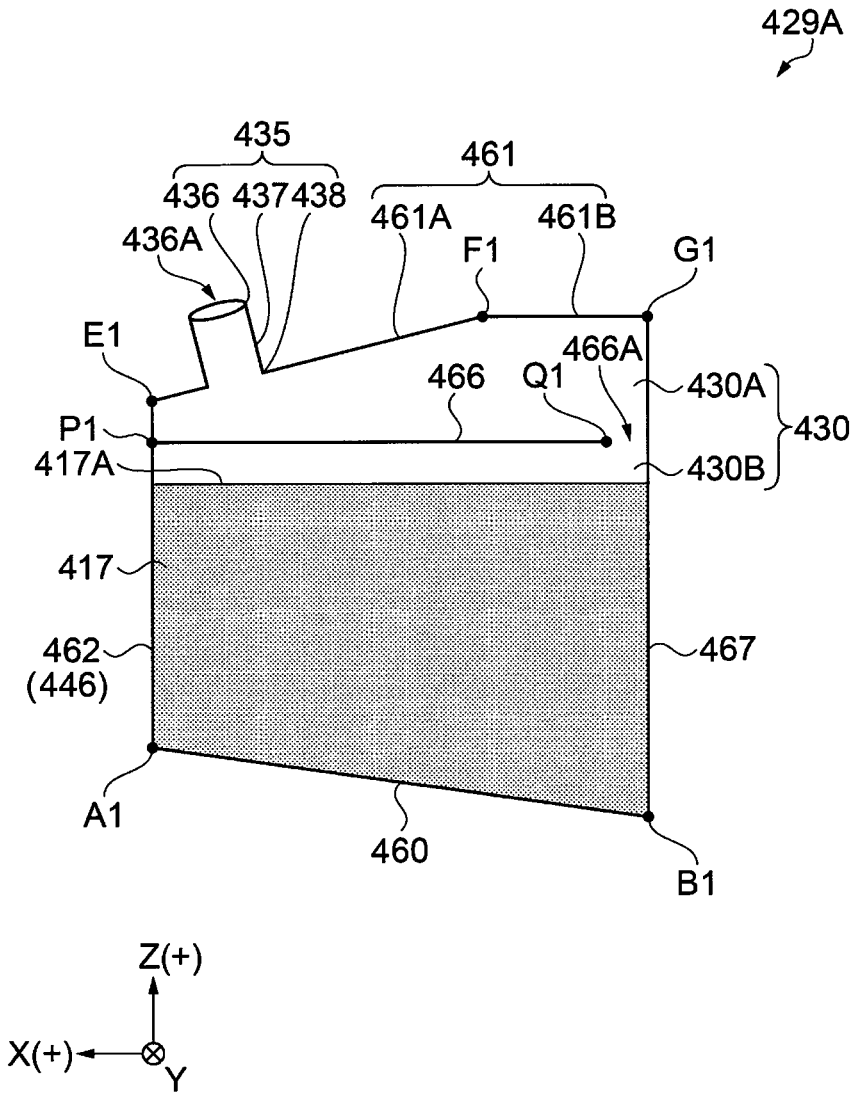
FIG. 48 is a schematic view of the tank seen in a direction from a fourth wall toward a third wall in the use posture.
Figure 49:
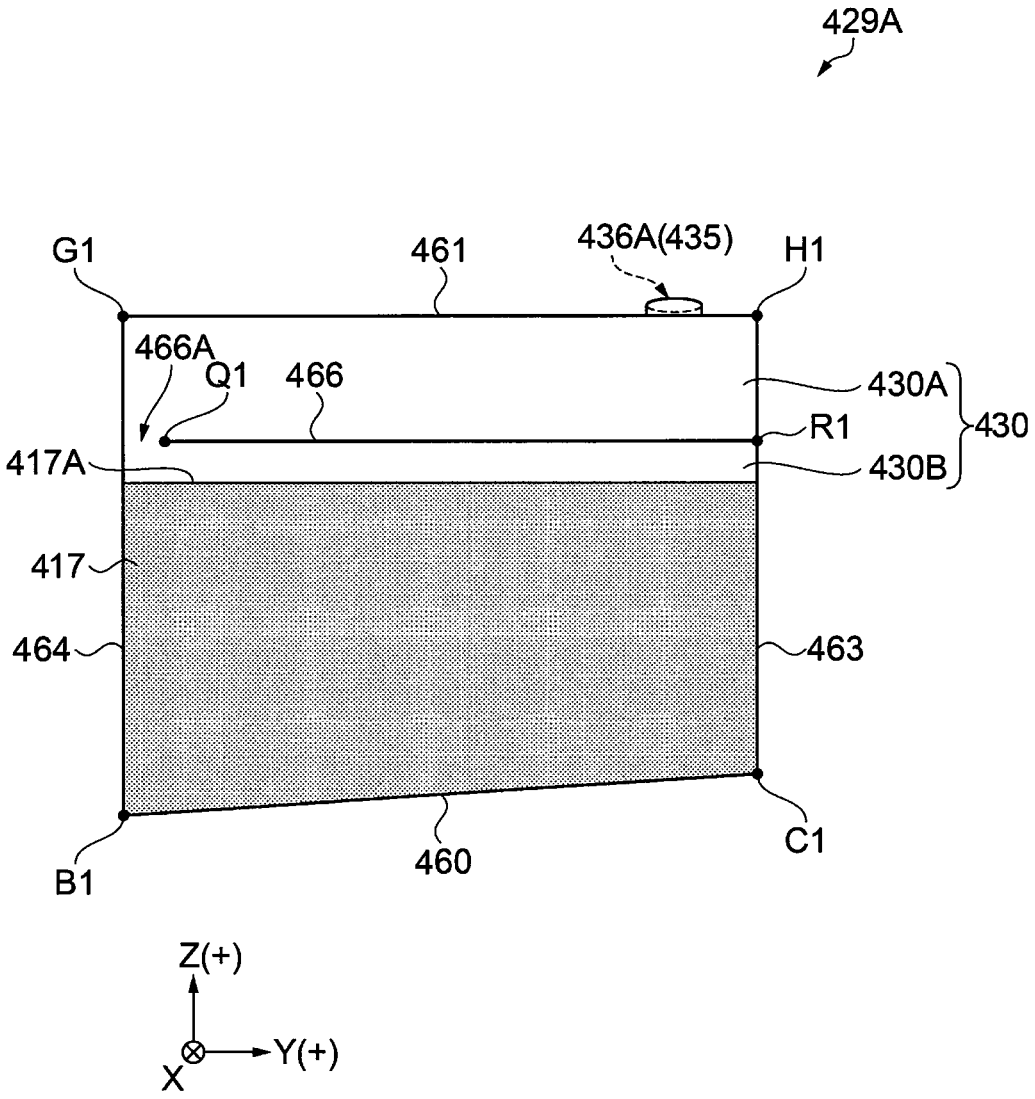
FIG. 49 is a schematic view of the tank seen in a direction from a fifth wall toward a second wall in the use posture.
Figure 50:
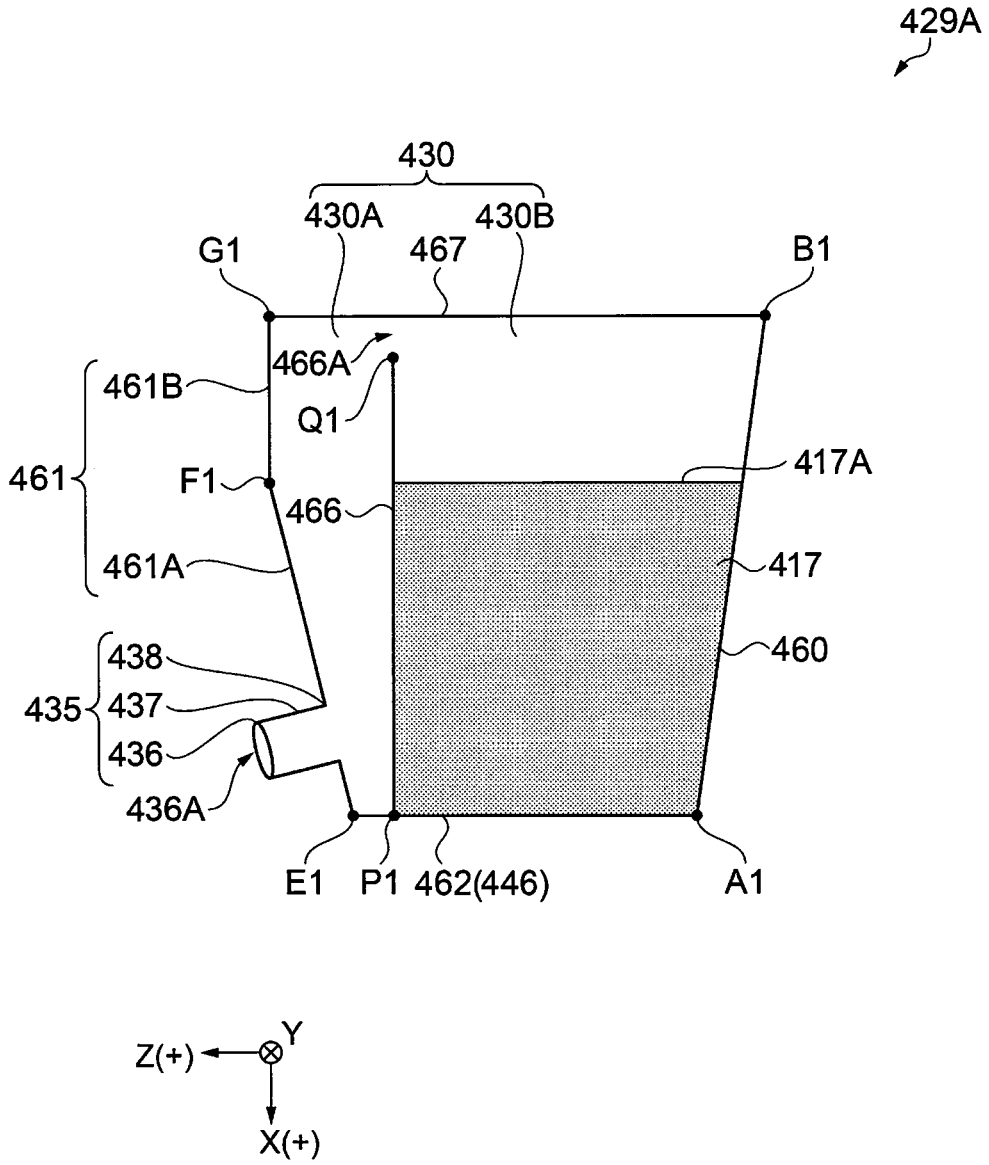
FIG. 50 is a schematic view of the tank having fallen down in a counterclockwise direction from the state illustrated in FIG. 48.
Figure 51:
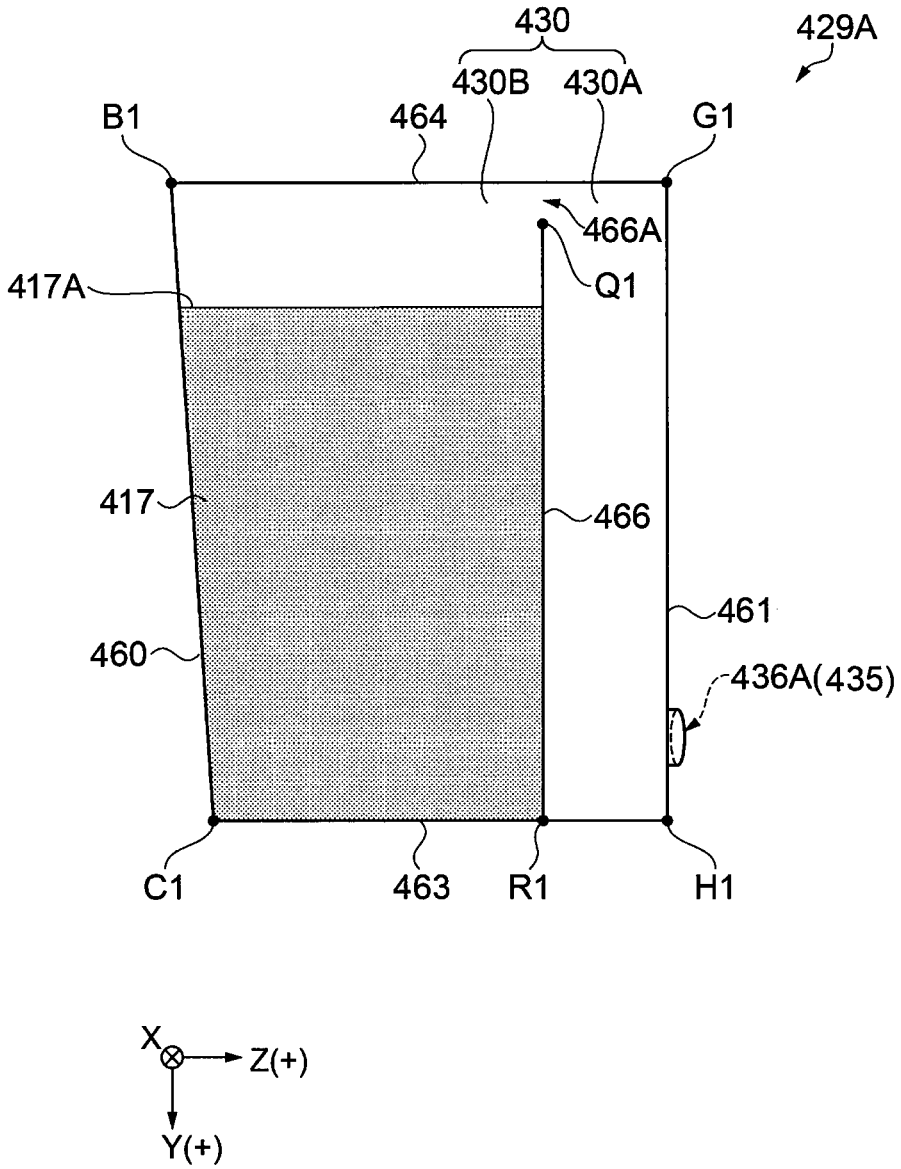
FIG. 51 is a schematic view of the tank having fallen down in a clockwise direction from the state illustrated in FIG. 49.

FIG. 46 is an exploded perspective view of a tank in a printer according to a fourth embodiment, which corresponds to FIG. 37. FIG. 47 is a schematic view of the first wall and the sixth wall that are projected onto a horizontal plane (XY plane) in the use posture, which corresponds to FIG. 40. FIG. 48 is a schematic view of a liquid container seen in a direction from the fourth wall toward the third wall in the use posture, which corresponds to FIG. 41. FIG. 49 is a schematic view of the liquid container seen in a direction from the fifth wall toward the second wall in the use posture, which corresponds to FIG. 42. FIG. 50 is a schematic view of the liquid container having fallen down in a counterclockwise direction from the state illustrated in FIG. 48. FIG. 51 is a schematic view of the liquid container having fallen down in a clockwise direction from the state illustrated in FIG. 49.

FIGS. 48 to 51 illustrate the state in which the ink 417 is poured in the liquid containing chamber 429 close to the upper limit mark 448.

The posture of a tank 410A having fallen down in the state illustrated in FIG. 50 will be called fifth falling posture, and the posture of the tank 410A having fallen down in the state illustrated in FIG. 51 will be called sixth falling state. Specifically, the fifth falling posture is the posture of a liquid containing chamber 429A in which the second wall 462 becomes the bottom surface (the lowest surface), and the sixth falling posture is the posture of the liquid containing chamber 429A in which the third wall 463 becomes the bottom surface (the lowest surface).

The liquid containing chamber 429A of the tank 410A according to the present embodiment will be described mainly focusing on the differences from the third embodiment with reference to FIGS. 46 to 51. The same components as those of the third embodiment will be given the same reference signs and duplicated descriptions thereof will be omitted.

As illustrated in FIG. 46, the liquid containing chamber 429A of the tank 410A according to the present embodiment has the reinforcement wall 465 that is opposed to the second wall 462 and a sixth wall 466 that connects the second wall 462 and the fifth wall 467 at a position between the first wall 461 and the bottom wall 460. That is, the liquid containing chamber 429A has the sixth wall 466, which is different from the liquid containing chamber 429 of the third embodiment. The other components of the present embodiment are the same as the third embodiment.

The sixth wall 466 is formed in contact with the second wall 462, the third wall 463, the fifth wall 467, and the fourth wall 464. Accordingly, an internal space 430 of the liquid containing chamber 429A is divided by the sixth wall 466 into two internal spaces 430A and 430B. The first internal space 430A constitutes the internal space 430 surrounded by the sixth wall 466, the second wall 462, the third wall 463, the fourth wall 464, and the first wall 461, and is arranged on the Z (+) direction side (the first wall 461 side) of the second internal space 430B. The second internal space 430B constitutes the internal space 430 surrounded by the sixth wall 466, the second wall 462, the third wall 463, the fourth wall 464, and the bottom wall 460, and is arranged on the Z (−) direction side (the bottom wall 460 side) of the first internal space 430A.

The first internal space 430A is an example of an "internal space of the liquid containing chamber on the side closer to the first wall than the sixth wall". The second internal space 430B is an example of an "internal space on the side closer to the bottom wall than the sixth wall".

The reinforcement wall 465 supports the second member 412 and increases the bonding strength of the second member 412 to the first member 411. The reinforcement wall 465 also supports the sixth wall 466 and increases the strength of the sixth wall 466.

The reinforcement wall 465 may not be provided.

The sixth wall 466 has an opening 466A that allows the first internal space 430A and the second internal space 430B to communicate with each other. The opening 466A is provided at a corner where the fourth wall 464 and the fifth wall 467 cross each other.

In the case of forming the opening 466A in the second region 512, the opening 466A may not be provided at the corner where the fourth wall 464 and the fifth wall 467 cross each other but may be provided with one side in the center of the second region 512 not including the fourth wall 464 and the fifth wall 467.

As illustrated in FIG. 47, when the first wall 461 and the sixth wall 466 are projected onto a horizontal plane (XY plane), the first wall 461 and the sixth wall 466 form the quadrilateral 461C. The quadrilateral 461C is divided into four regions (the first region 511, the second region 512, the third region 513, and the fourth region 514) by the first center line 501A passing through the center of the first side 501 and the second center line 502A passing through the center of the second side 502.

The first wall 461 has the inner end 438 of the liquid inlet portion 435 in the first region 511.

The sixth wall 466 has the opening 466A that allows the first internal space 430A and the second internal space 430B to communicate with each other. When the sixth wall 466 in the use posture is projected onto a horizontal plane (XY plane), the opening 466A is positioned in the second region 512 diagonal to the first region 511 with the inner end 438 of the liquid inlet portion 435. That is, the opening 466A is most separated from the inner end 438 of the liquid inlet portion 435.

In other words, the opening 466A is positioned in the second region 512 in point symmetry to the first region 511 (with the liquid inlet portion 435) with respect to a central point Q where the center lines 501A and 502A cross each other.

As illustrated in FIGS. 48 and 49, in the present embodiment, when the operator pours the ink 417 into the liquid containing chamber 429A with the upper limit mark 448 as the index for the upper limit of the amount of the ink 417, the ink 417 is contained in the second internal space 430B of the liquid containing chamber 429A. That is, the sixth wall 466 is provided such that, when the operator pours the ink 417 into the liquid containing chamber 429A with the upper limit of the amount of the ink 417, the ink 417 is contained in the second internal space 430B of the liquid containing chamber 429A.

The ink 417 contained in the second internal space 430B is covered with the sixth wall 466 so that the ink 417 is unlikely to move from the second internal space 430B to the first internal space 430A. For example, even when the liquid level 417A of the ink 417 is swung, the ink 417 is unlikely to move toward the liquid inlet portion 435. Accordingly, the ink 417 is unlikely to leak from the liquid inlet portion 435 communicating with the first internal space 430A as compared to the case without the sixth wall 466.

As illustrated in FIG. 50, in the fifth falling posture, the second wall 462 becomes the bottom surface (the lowest surface) and thus the liquid inlet portion 435 near the second wall 462 is placed at a low position. The opening 466A is most separated from the inner end 438 of the liquid inlet portion 435 and thus the opening 466A is placed at a high position in the fifth falling posture.

That is, in the fifth falling posture, the liquid inlet portion 435 is placed at a low position and the opening 466A is placed at a high position.

In the fifth falling posture, the opening 466A is placed at a high position and thus the ink 417 contained in the second internal space 430B is unlikely to move to the first internal space 430A. Accordingly, the ink 417 is unlikely to leak from the liquid inlet portion 435 communicating with the first internal space 430A.

As illustrated in FIG. 51, in the sixth falling posture, the third wall 463 becomes the bottom surface (the lowest surface) and thus the liquid inlet portion 435 near the third wall 463 is placed at a low position. The opening 466A is most separated from the inner end 438 of the liquid inlet portion 435 and thus the opening 466A is placed at a high position in the sixth falling posture.

That is, in the sixth falling posture, the liquid inlet portion 435 is placed at a low position and the opening 466A is placed at a high position.

In the sixth falling posture, the opening 466A is placed at a high position and thus the ink 417 contained in the second internal space 430B is unlikely to move to the first internal space 430A. Accordingly, the ink 417 is unlikely to leak from the liquid inlet portion 435 communicating with the first internal space 430A.

As illustrated in FIGS. 50 and 51, the sixth wall 466 is parallel to the X axis and the Y axis but the sixth wall 466 may not necessarily be configured so. For example, the sixth wall 466 may be inclined to the left side of FIG. 50.

In the tank 410A according to the present embodiment, the liquid inlet portion 435 is provided in the first region 511. This makes it possible to provide the same advantageous effect as that of the third embodiment that the ink 417 is unlikely to leak from the liquid inlet portion 435 in both the first falling posture and the second falling posture.

In addition, in the tank 410A according to the present embodiment, it is possible to provide a new advantageous effect that the ink 417 is unlikely to leak from the liquid inlet portion 435 in both the fifth falling posture and the sixth falling posture in which the liquid inlet portion 435 is placed at a low position.

The opening 466A may be included in any of the first region 511 to the fourth region 514. However, the positional relationship between the opening 466A and the liquid inlet portion 435 is preferably as described below. When the liquid inlet portion 435 is arranged in the second region 512, the opening 466A is preferably arranged in the first region 511 diagonal to the second region 512. When the liquid inlet portion 435 is arranged in the third region 513, the opening 466A is preferably arranged in the fourth region 514 diagonal to the third region 513. When the liquid inlet portion 435 is arranged in the fourth region 514, the opening 466A is preferably arranged in the third region 513 diagonal to the fourth region 514.

The present invention is not limited to the foregoing embodiments but can be modified as appropriate without deviating from the gist or idea of the invention that can be read from the scope of the claims and the specification. Besides the foregoing embodiments, various modifications are possible. Some modification examples will be described below.

First Modification Example

Figure 52:
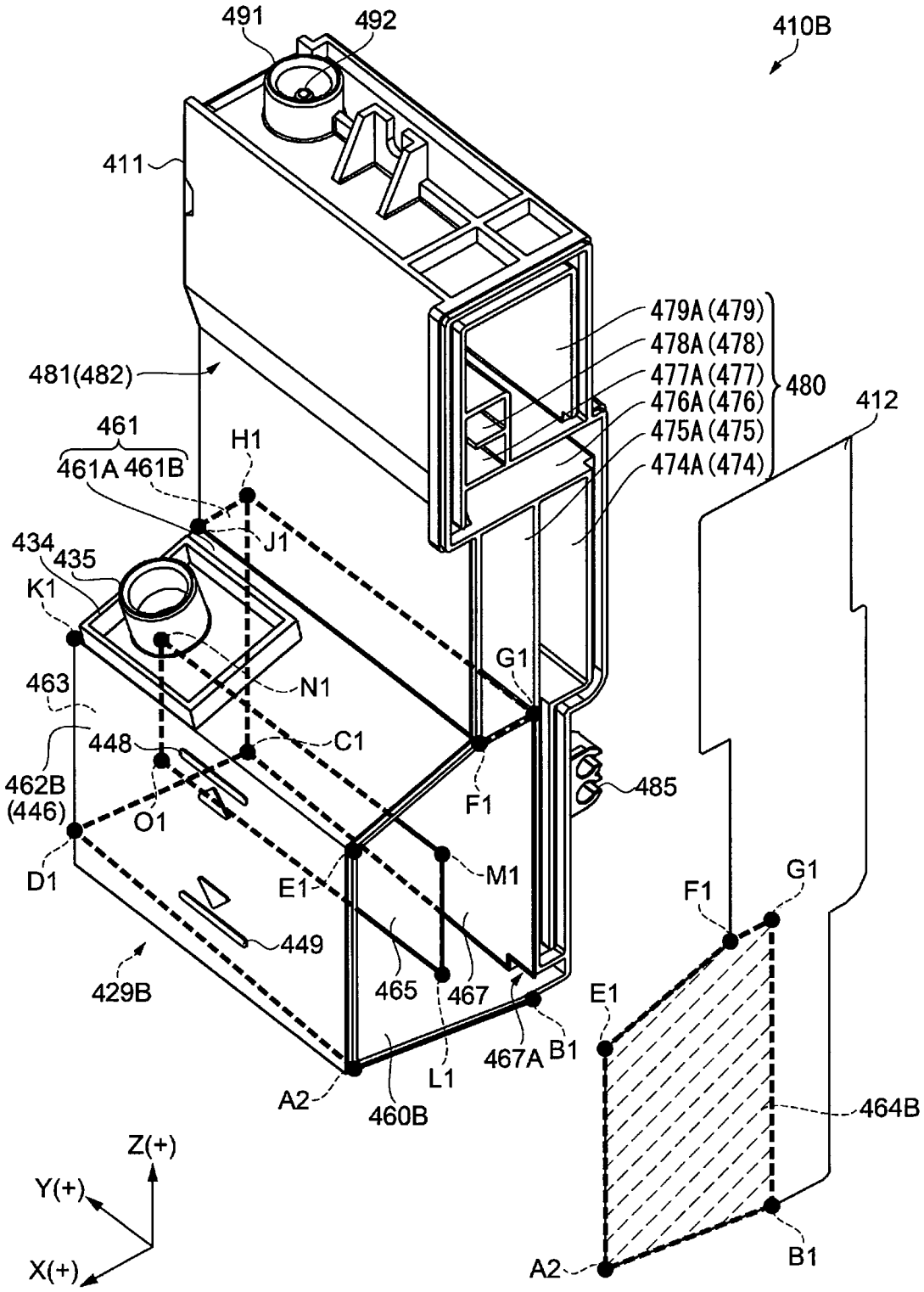
FIG. 52 is an exploded perspective view of a tank according to the first modification example when a visual-recognition wall is seen from a high side.
Figure 53:
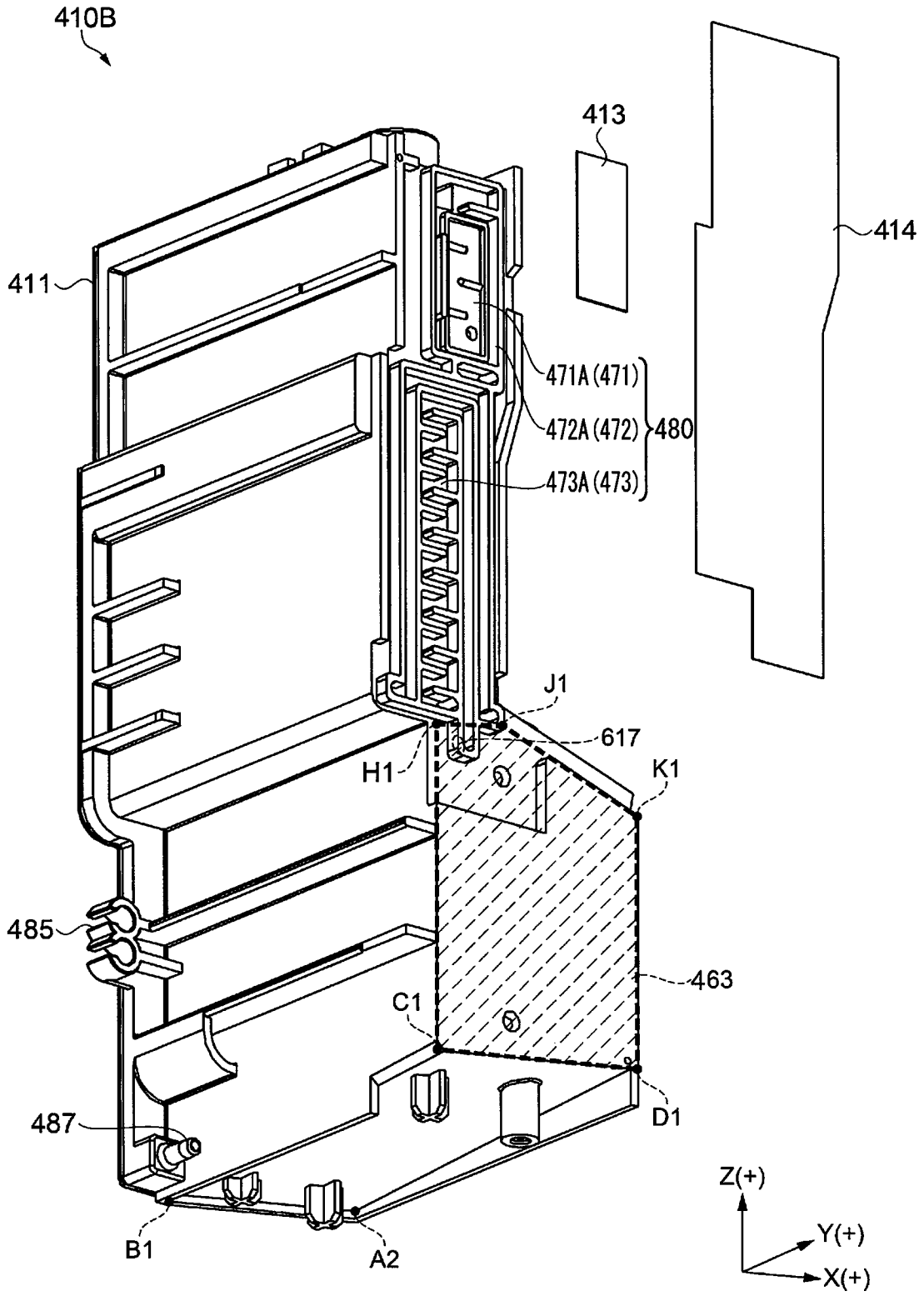
FIG. 53 is an exploded perspective view of the tank according to the first modification example when a wall opposed to the visual-recognition wall is seen from a low side.

FIG. 52 is an exploded perspective view of a liquid container according to a first modification example when a visual-recognition wall is seen from a high side, which corresponds to FIG. 37. FIG. 53 is an exploded perspective view of the liquid container according to the first modification example when a wall opposed to the visual-recognition wall is seen from a low side, which corresponds to FIG. 38.

A tank 410B according to the first modification example is different from the tank 410 according to the third embodiment in the shape of a liquid containing chamber 429B. The other components of the first modification example are the same as those of the third embodiment.

The first modification example will be described mainly focusing on the differences from the third embodiments with reference to FIGS. 52 and 53. The same components as those of the third embodiment will be given the same reference signs and duplicated descriptions thereof will be omitted.

As illustrated in FIGS. 52 and 53, the liquid containing chamber 429B includes the first wall 461, a second wall 462B, the third wall 463, a fourth wall 464B, the reinforcement wall 465, the fifth wall 467, and a bottom wall 460B.

The first wall 461, the third wall 463, the reinforcement wall 465, and the fifth wall 467 are the same as those of the third embodiment and thus descriptions thereof will be omitted.

The portion surrounded by a point A2, the point E1, the point K1, and the point D1 constitutes the second wall 462B. The portion surrounded by the point A2, the point B1, the point G1, and the point E1, that is, the portion hatched by broken lines constitutes the fourth wall 464B. The portion surrounded by the point A2, the point B1, the point C1, and the point D1 constitutes the bottom wall 460B.

The point A2 as a vertex of the second wall 462B, the fourth wall 464B, and the bottom wall 460B corresponds to the point A1 (see FIG. 37) as a vertex of the second wall 462, the fourth wall 464, and the bottom wall 460 according to the third embodiment. The point A2 in the present modification example is arranged at a lower position than the point A1 in the third embodiment. This is one of the differences of the present modification example from the third embodiment.

In the present modification example, the point A2 is arranged at the position that is lower than the point C1 and the point D1 and at the same height as the point B1. That is, the point A2 and the point B1, and the point C1 and the point D1 are arranged at the respectively same heights, and the point A2 and the point B1 are arranged at positions lower than the point C1 and the point D1.

In the bottom wall 460B, the point D1 on the second wall 462B side is arranged at a higher position than the point B1 on the fourth wall 464B side and the fifth wall 467 side. Accordingly, the bottom wall 460B has a second inclination portion inclined such that the second wall 462B side is higher.

The matter that "the bottom wall has an inclination portion inclined such that the second wall side is higher" in the subject application corresponds to the state in which at least part of the side of the bottom wall 460B connecting the point A2 and the point D1 is higher in the Z (+) direction and the bottom wall 460B has an inclination portion inclined from the higher portion.

In the bottom wall 460B, the point C1 and the point D1 on the third wall 463 side are arranged at higher positions than the point A2 and the point B1 on the fourth wall 464B side. Accordingly, the bottom wall 460B has a third inclination portion inclined from the third wall 463 to the fourth wall 464B such that the fourth wall 464B side is lower.

The matter that "the bottom wall has an inclination portion inclined from the third wall to the fourth wall such that the fourth wall side is lower" in the subject application corresponds to the state in which the bottom wall 460B has an inclination portion inclined from the third wall 463 to the fourth wall 464B such that at least part of the side of the bottom wall 460B connecting the point A2 and the point B1 is lower in the Z (−) direction.

In the present modification example, the liquid inlet portion 435 is provided in the first region 511. This makes it possible to provide the same advantageous effect as that of the third embodiment that the ink 417 is unlikely to leak from the liquid inlet portion 435 in both the first falling posture and the second falling posture.

Further, the position of the point A2 as a vertex of the liquid containing chamber 429B in the present modification example is placed at a lower position than the point A1 as a vertex of the liquid containing chamber 429 in the third embodiment, and thus the volume of the liquid containing chamber 429B in the present modification example is larger than the volume of the liquid containing chamber 429 in the third embodiment. As a result, the liquid containing chamber 429B in the present modification example can contain a larger amount of the ink 417 than the liquid containing chamber 429 in the third embodiment.

Second Modification Example

Figure 54:
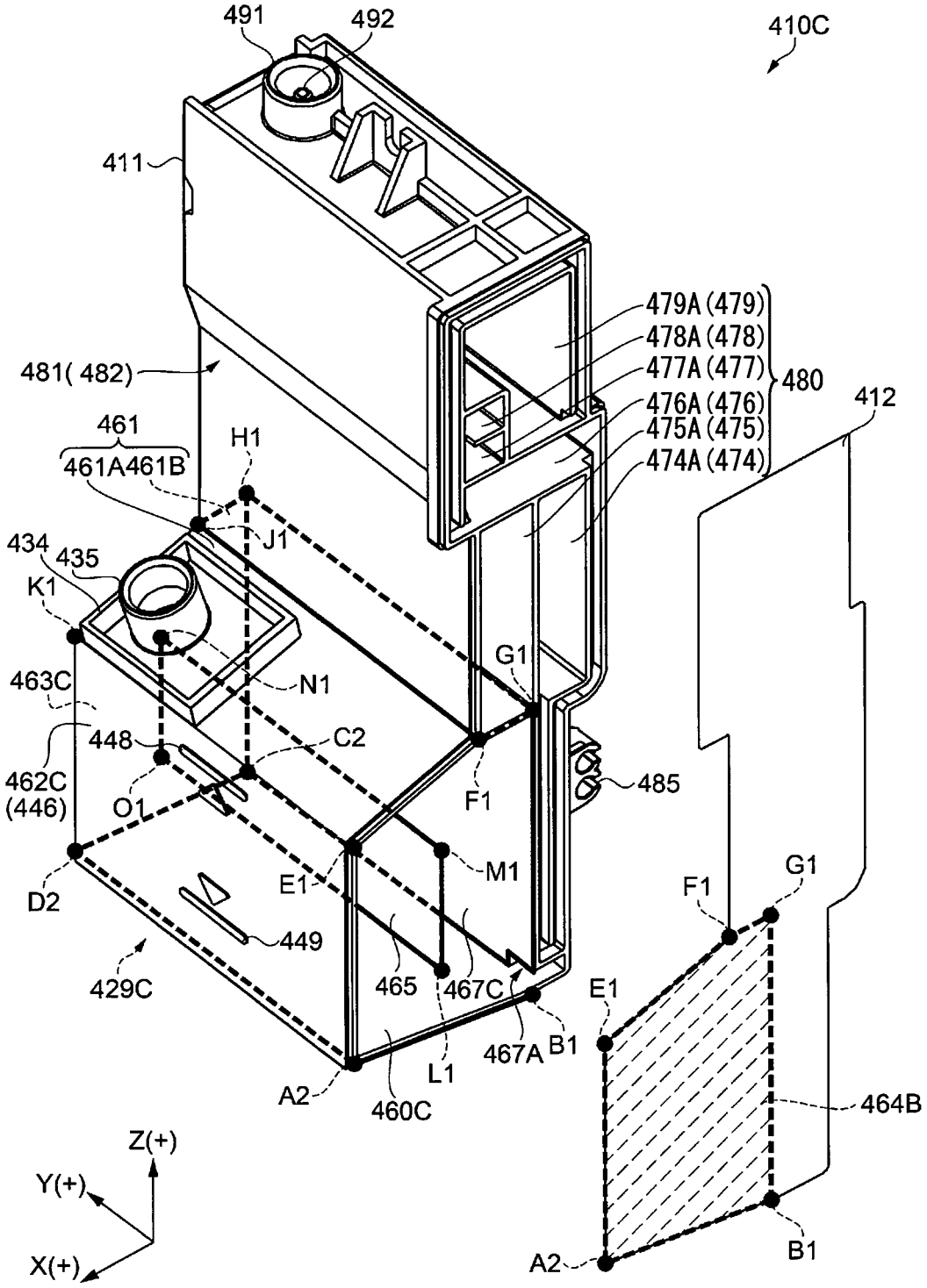
FIG. 54 is an exploded perspective view of a tank according to the second modification example when a visual-recognition wall is seen from a high side.

FIG. 54 is an exploded perspective view of a liquid container according to a second modification example when a visual-recognition wall is seen from a high side, which corresponds to FIG. 37.

A liquid containing chamber 429C of a tank 410C according to the second modification example is different from the liquid containing chamber 429B of the tank 410B according to the first modification example, but the other components of the second modification example are the same as those of the first modification example.

The second modification example will be described mainly focusing on the differences from the first modification example with reference to FIG. 54. The same components as those of the third embodiment will be given the same reference signs and duplicated descriptions thereof will be omitted.

As illustrated in FIG. 54, the liquid containing chamber 429C includes the first wall 461, a second wall 462C, a third wall 463C, the fourth wall 464B, the reinforcement wall 465, a fifth wall 467C, and a bottom wall 460C.

The first wall 461, the fourth wall 464B, and the reinforcement wall 465 are the same as those of the first modification example and thus descriptions thereof will be omitted.

The portion surrounded by the point A2, the point E1, the point K1, and a point D2 constitutes the second wall 462C. The portion surrounded by the point D2, a point C2, the point H1, and the point K1 constitutes the third wall 463C. The portion surrounded by the point B1, the point G1, the point H1, and the point C2 constitutes the fifth wall 467C. The portion surrounded by the point A2, the point B1, the point C2, and the point D2 constitutes the bottom wall 460C.

The point D2 in the second wall 462C, the third wall 463C, and the bottom wall 460C corresponds to the point D1 in the second wall 462B, the third wall 463, and the bottom wall 460B in the first modification example (see FIG. 52). The point D2 in the present modification example is placed at a lower position than the point D1 in the first modification example. This is one of the differences of the present modification example from the first modification example.

The point C2 in the third wall 463C, the fifth wall 467C, and the bottom wall 460C corresponds to the point C1 in the third wall 463, the fifth wall 467, and the bottom wall 460B in the first modification example (see FIG. 52). The point C2 in the present modification example is placed at a lower position than the point C1 in the first modification example. This is another one of the differences of the present modification example from the first modification example.

The point C2 and the point D2 are arranged at the same height as the point A2 and the point B1. That is, the point A2 and the point B1, and the point C2 and the point D2 are arranged at the respectively same heights. Accordingly, the bottom wall 460C surrounded by the point A2, the point B1, the point C2, and the point D2 has no inclination portion and is arranged along the XY plane (horizontal plane). As a result, the bottom wall 460C is arranged at a lower position than the bottom wall 460B in the first modification example. Therefore, the liquid containing chamber 429C according to the present modification example is larger in volume than the liquid containing chamber 429B according to the first modification example and can contain a larger amount of the ink 417.

Third Modification Example

In the foregoing embodiments, the plurality of tanks 410 are formed separately from one another, and the liquid container capable of containing the ink to be supplied to the liquid injection head 40 includes one liquid containing chamber 429 capable of containing the ink 417 and one liquid inlet portion 435 capable of pouring the ink 417 into the liquid containing chamber 429.

The liquid container may be configured such that the plurality of tanks 410 are integrated into one liquid container. Specifically, the liquid container capable of containing the ink to be supplied to the liquid injection head 40 may have a liquid containing chamber capable of containing the ink and a liquid inlet portion capable of pouring the ink into the liquid containing chamber. In this case, the one liquid container has the plurality of liquid containing chambers, and the plurality of liquid containing chambers are individually divided to contain different kinds of liquids.

In each of the forgoing embodiments, examples, and modification examples, the liquid injection apparatus may be a liquid injection apparatus that consumes a liquid other than an ink by injecting, discharging, or applying. The state of the liquid discharged as minute liquid droplets from the liquid injection apparatus includes grains, teardrops, and threads. The liquid here is a material that can be consumed by the liquid injection apparatus. The liquid may be any of substances in a liquid phase, that is, high-viscous or low-viscous liquid materials, sol, gel water, and other fluidal materials such as inorganic solvents, organic solvents, solutions, liquid resins, and liquid metals (metallic melts). The liquid may be any of not only substances in a liquid state but also particles of functional solid material such as pigments or metallic grain that are dissolved, dispersed, or mixed in a solvent. Typical examples of the liquid include inks as described above in relation to the foregoing embodiments, liquid crystal, and others. The ink here may be any of various liquid compositions such as general water-based inks and oil-based inks, gel inks, and hot-melt inks. Further, the ink may be a sublimation transfer ink. The sublimation transfer ink may be, for example, an ink including a sublimation color material such as a sublimation dye. As a printing method, such a sublimation transfer ink is injected onto a transfer medium by the liquid injection apparatus, the transfer medium is brought into contact with a print form and is heated to sublimate the color material and transfer the color material to the print form. The print form is a T shirt, a smartphone, or the like. In this way, the ink containing a sublimation color material allows printing on various kinds of print forms (print medium). Specific examples of the liquid injection apparatus include liquid crystal displays, electroluminescence (EL) displays, surface-emitting displays, and liquid injection apparatuses that inject a liquid containing electrode material or color material for use in manufacture of color filters in a dispersed or dissolved state. In addition, the liquid injection apparatus may be any of liquid injection apparatuses that inject a bioorganic substance for use in manufacture of biochips, liquid injection apparatuses that are used as precision bio-pipettes to inject a liquid specimen, textile printing devices, micro dispensers, and others. Further, the liquid injection apparatus may be any of liquid injection apparatuses that inject a lubricant onto precision machinery such as clocks and cameras in a pinpointing manner and liquid injection apparatuses that inject a transparent resin liquid such as an ultraviolet curing resin onto a substrate to form micro hemispherical lenses (optical lenses) for use in optical communication elements and others. The liquid injection apparatus may be a liquid injection apparatus that injects an acid or alkaline etching liquid to etch a substrate or the like.

The present invention is not limited to the foregoing embodiments, examples, and modification examples but can be implemented in various configurations without deviating from the gist of the present invention. For example, the technical features of the embodiments corresponding to the technical features of the aspects described in the summary of the invention, examples, and modification examples can be replaced or combined as appropriate to solve some or all of the foregoing problems or achieve some or all of the foregoing advantages. The technical features may be deleted as appropriate unless they are described as essential therein.

REFERENCE SIGNS LIST

A . . . printer, 3,3A . . . printer unit, 4,4A . . . tank unit, 5, 5A . . . scanner unit, 5*b* . . . lower end, 6,6A . . . housing, 6A1 . . . first housing, 6A2 . . . second housing, 7 . . . housing, 7A . . . cover, 8 . . . member, 10,10A . . . tank, 10*t* . . . upper end, 21 . . . paper ejection portion, 22,22A . . . front surface, 23 . . . top surface, 24 . . . air containment chamber, 24*b* . . . lower end, 25,25A . . . window, 26 . . . front surface, 27 . . . top surface, 28 . . . side surface, 29 . . . ink containing part, 31 . . . document cover, 32 . . . document placement plane, 40 . . . liquid injection head, 41 . . . liquid injection mechanism part (mechanism unit), 41*t* . . . upper end, 42 . . . print part, 43 . . . ink supply tube, 44 . . . sign, 45 . . . inlet part, 45A . . . cylindrical portion, 45B, 45B1-45B4 . . . ink introduction port, 45C . . . ink inlet port, 46 . . . visual-recognition surface, 47 . . . cover, 48 . . . upper limit mark, 49 . . . lower limit mark, 51 . . . first housing, 52 . . . second housing, 52A . . . main unit, 53,53A-53D . . . cap, 54,54A-54D . . . receiving pan, 60,60A . . . operation panel, 60*t* . . . upper end, 71 . . . covered part, 72, 73 . . . wall, 74 . . . opening portion, 81,81A-81D . . . concave portion, 82,82A-82D . . . inclined wall, 83 . . . one side, 84,84A-84D . . . connecting portion, 85 . . . anchorage portion, 86 . . . cover portion, 88 . . . skirt portion, 89 . . . grip portion, 91 . . . connected portion, 92 . . . concave portion, 94 . . . infusion container, 95 . . . nozzle part, 96 . . . positioning part, 101-116 . . . surface, 121 . . . surrounding wall, 122 . . . air release part, 123 . . . air opening port, 124 . . . cylindrical wall, 125 . . . fixed part, 126 . . . leg part, 127 . . . overhang part, 128 . . . ink supply part, 129 . . . ink supply port, 131 . . . tube hold part, 132,133 . . . rib, 135 . . . front surface, 137 . . . case, 138 . . . sheet member, 141-149 . . . concave portion, 151 . . . joint portion, 152 . . . water-proof breathable film, 153 . . . sheet member, 154-158 . . . concave portion, 161,162 . . . partition wall, 163 . . . joint portion, 171-189,219 . . . division wall, 201-

204 . . . connecting portion, 205 . . . cut portion, 211-218, 222,261-276 . . . communication hole, 221 . . . concave portion, 231-236,251,252 . . . buffer chamber, 241-243,253-255 . . . communication path, 245 . . . air communication path, 246 . . . support portion, 260 . . . flow path, 281 . . . corner portion, 282 . . . plate wall, 285 . . . first inner surface, 286 . . . second inner surface, 287 . . . convex portion, 289 . . . air containment part (air containment chamber or air chamber), 291 . . . ink, 291 . . . liquid level, 292 . . . case, 293 . . . wall, 294 . . . sheet member, 301 . . . seal member, 311 . . . waiting position, 312 . . . turn position, 407 . . . housing, 407A . . . side wall portion, 410,410A-410C . . . tank, 411 . . . first member, 412 . . . second member, 413 . . . third member, 414 . . . fourth member, 417 . . . ink, 417A . . . liquid level, 425 . . . window, 429 . . . liquid containing chamber, 430 . . . internal space, 430A . . . first internal space, 430B . . . second internal space, 434 . . . liquid leakage prevention wall, 435,435A-435C . . . liquid inlet portion, 436 . . . outer end, 436A . . . opening, 437 . . . cylindrical portion, 437A . . . through hole, 438 . . . inner end, 438A . . . opening, 440 . . . liquid injection head, 446 . . . visual-recognition wall, 448 . . . upper limit mark, 449 . . . lower limit mark, 453 . . . cap, 454 . . . receiving pan, 456 . . . connecting portion, 457 . . . side wall, 458 . . . liquid pouring container, 459 . . . nozzle part, 460,460B,460C . . . bottom wall, 461 . . . first wall, 461A . . . first inclination portion, 461B . . . flat portion, 461C . . . quadrilateral, 462,462B . . . second wall, 463,463C . . . third wall, 464,464B . . . fourth wall, 465 . . . reinforcement wall, 466 . . . sixth wall, 466A . . . opening, 467,467C . . . fifth wall, 467A . . . opening, 471-479 . . . concave portion, 471A-479A . . . space, 480 . . . air chamber, 481 . . . wall, 482 . . . concave portion, 485 . . . tube hold part, 487 . . . ink supply part, 491 . . . cylindrical wall, 492 . . . air introduction part, 501 . . . first side, 501A . . . first center line, 502 . . . second side, 502A . . . second center line, 503 . . . third side, 504 . . . fourth side, 501A . . . first center line, 502A . . . second center line, 511 . . . first region, 512 . . . second region, 513 . . . third region, 514 . . . fourth region, 617 . . . communication hole, P . . . print medium (recording medium), Q . . . central point, V1 . . . center line, V2 . . . center line

The invention claimed is:

1. A liquid container comprising:

a first chamber that is surrounded by a plurality of walls and is configured to contain a liquid;

a liquid inlet port for pouring the liquid into the first chamber;

an air opening port that is opened to air;

a liquid lead-out port that leads the liquid out of the first chamber;

an air lead-in port that is formed in, out of the plurality of walls surrounding the first chamber, a first wall different from the wall constituting a top surface; and an air communication path that allows the air opening port and the air lead-in port to communicate with each other, wherein the air lead-in port is separated from a corner portion where the first wall crosses with another wall.

2. The liquid container according to claim 1, wherein out of the plurality of walls, the wall opposed to the first wall is formed from a film.

3. The liquid container according to claim 1, wherein the air communication path includes a second chamber, and the second chamber is positioned on an upstream side of the first chamber in a path of the air flowing from the air opening port through the air lead-in port into the first chamber.

4. The liquid container according to claim 1, wherein, in the first chamber, the first wall has a convex portion protruding from the first wall toward the opposing side in the first chamber, at least at part of an outer periphery of the air lead-in port.

5. The liquid container according to claim 4, wherein the convex portion is formed in a cylindrical shape to surround the entire periphery of the air lead-in port.

6. The liquid container according to claim 1, wherein the air communication path includes a communication flow path connecting to the air lead-in port, the air lead-in port is circular in shape, and an inner diameter of the air lead-in port is identical to a width of a cross section opening of the communication flow path.

7. The liquid container according to claim 1, wherein in the first chamber, the first wall has a first inner surface and a second inner surface protruding more inward of the first chamber than the first inner surface, and the air lead-in port is opened to the second inner surface.

8. The liquid container according to claim 1, wherein the liquid lead-out port is formed on a side opposed to the first wall.

9. The liquid container according to claim 1, further comprising a second convex portion that surrounds the air opening port.

10. The liquid container according to claim 1, wherein the plurality of walls include a visual-recognition wall through which a liquid level in the first chamber is visible, the visual-recognition wall extends in a direction crossing a horizontal direction in a use posture of the liquid container, the visual-recognition wall has an upper limit mark indicating an index for an upper limit of an amount of the liquid that can be poured into the first chamber, and the air lead-in port is positioned above the upper limit mark.

11. The liquid container according to claim 3, wherein the plurality of walls include a visual-recognition wall through which a liquid level in the first chamber is visible, the visual-recognition wall extends in a direction crossing a horizontal direction in a use posture of the liquid container, the visual-recognition wall has an upper limit mark indicating an index for an upper limit of an amount of the liquid that can be poured into the first chamber, and when a liquid level in the first chamber reaches the upper limit mark, a volume of the second chamber is equal to or larger than a volume of the liquid.

12. The liquid container according to claim 10, wherein, in a state in which the liquid in the first chamber has reached the upper limit mark in the use posture, when the liquid container is changed to a posture in which the visual-recognition wall is oriented downward, the air lead-in port is positioned above a level of the liquid in the first chamber.

13. The liquid container according to claim 1, wherein the liquid inlet port is provided in, out of the plurality of walls, a second wall that extends in a direction crossing the first wall, and a plate wall protruding from the second wall inward of the first chamber is provided between the liquid inlet port and the air lead-in port.

14. A liquid container that is configured to contain a liquid to be supplied to a liquid injection head, comprising:

one liquid containing chamber that is configured to contain the liquid; and one liquid inlet portion that is configured to pour the liquid into the liquid containing chamber, wherein the liquid inlet portion is formed in a first wall defining the liquid containing chamber and has an outer end opened to outside and an inner end opened in the liquid containing chamber, when the first wall in a use posture is projected onto a horizontal plane, the first wall has a shape of a quadrilateral with a first side and a second side crossing the first side, the quadrilateral is divided into four regions by a first center line passing through a center of the first side and a second center line passing through a center of the second side, and the liquid inlet portion is provided such that the inner end is arranged in any of the four regions.

15. The liquid container according to claim 14, wherein the liquid containing chamber has a second wall extending in a direction crossing the first wall, and the first wall has an inclination portion that is inclined such that the second wall side is lower, and the liquid inlet portion is provided on the second wall side of the first wall.

16. The liquid container according to claim 14, wherein the liquid containing chamber has a second wall that extends in a direction crossing the first wall, and a bottom wall that extends in a direction crossing the second wall and is opposed to the first wall, and the bottom wall has an inclination portion that is inclined such that the second wall side is higher.

17. The liquid container according to claim 16, wherein the liquid containing chamber further has a third wall that extends in a direction crossing the first wall, the second wall, and the bottom wall and a fourth wall that is opposed to the third wall, the liquid inlet portion is provided on the first wall on a side closer to the third wall than the fourth wall, and the bottom wall has an inclination portion that is inclined from the third wall toward the fourth wall such that the fourth wall side is lower.

18. The liquid container according to claim 15, wherein the second wall has an upper limit line that indicates an index for an upper limit of an amount of the liquid that can be poured into the liquid containing chamber and constitutes a visual-recognition wall through which a liquid level in the liquid containing chamber is visible from outside, and when the visual-recognition wall in the use posture is seen from a direction orthogonal to the visual-recognition wall, a center line passing through a center of the liquid inlet portion is arranged at a position different from a center line passing through a center of the upper limit line.

19. The liquid container according to claim 14, wherein the first wall includes a liquid leakage prevention wall that protrudes in such a manner as to separate from the liquid inlet portion and surrounds the liquid inlet portion.

* * * * *